US006995516B2

(12) United States Patent
Aoki et al.

(10) Patent No.: US 6,995,516 B2
(45) Date of Patent: Feb. 7, 2006

(54) DRIVE CIRCUIT, DISPLAY DEVICE, AND DRIVING METHOD

(75) Inventors: Tadashi Aoki, Kanagawa (JP); Kazunori Katakura, Kanagawa (JP); Aoji Isono, Kanagawa (JP); Kazuhiko Murayama, Kanagawa (JP); Kenji Shino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 10/167,666

(22) Filed: Jun. 13, 2002

(65) Prior Publication Data

US 2002/0195966 A1 Dec. 26, 2002

(30) Foreign Application Priority Data

| | | |
|---|---|---|
| Jun. 15, 2001 | (JP) | 2001-181841 |
| Aug. 20, 2001 | (JP) | 2001-248978 |
| Sep. 27, 2001 | (JP) | 2001-296397 |
| Jun. 7, 2002 | (JP) | 2002-167096 |

(51) Int. Cl.
*G09G 3/10* (2006.01)

(52) U.S. Cl. ..... 315/169.3; 315/169.4; 345/76; 345/77

(58) Field of Classification Search ..... 315/169.3, 315/169.4; 345/76, 77
See application file for complete search history.

(56) References Cited

U.S. PATENT DOCUMENTS 4,904,895 A 2/1990 Tsukamoto et al. ..... 313/336
5,066,883 A 11/1991 Yoshioka et al. ..... 313/309

(Continued)

FOREIGN PATENT DOCUMENTS

JP 64-31332 2/1989
JP 2-257551 10/1990

(Continued)

OTHER PUBLICATIONS

M.L. Elinson et al., *The Emission of Hot Electrons and the Field Emission of Electrons from Tin Oxide*, Radio Engineering and Electronic Physics, Jul. 1965, pp. 1290–1296.

G. Dittmer, *Electrical Conduction and Electron Emission of Discontinuous Thin Films*, Thin S lid Films, vol. 9, (1972) pp. 317–328.

(Continued)

*Primary Examiner*—David Vu
(74) *Attorney, Agent, or Firm*—Fitzpatrick, Cella, Harper & Scinto

(57) ABSTRACT

A drive waveform signal which is level controlled by discontinuous levels including a minimum level corresponding to luminance brightness gradation data which is not 0, at least one non-minimum level corresponding to larger luminance brightness gradation data, and an intermediate level between the minimum and non-minimum level. The signal, which is employed to drive an image display unit, is given pulse width control with discontinuous pulse width, and has a portion, controlled with the minimum level, in its trailing edge, and a portion, controlled with the intermediate level just before the former portion, when it has the portion controlled by the non-minimum level.

19 Claims, 30 Drawing Sheets

U.S. PATENT DOCUMENTS

| | | | | |
|---|---|---|---|---|
| 5,455,597 | A | 10/1995 | Nakamura et al. | 345/75 |
| 5,477,110 | A | 12/1995 | Smith et al. | 315/169.3 |
| 5,555,000 | A | 9/1996 | Sarrasin et al. | 345/75 |
| 5,569,974 | A | 10/1996 | Morikawa et al. | 313/310 |
| 5,593,335 | A | 1/1997 | Suzuki et al. | 445/50 |
| 5,654,607 | A | 8/1997 | Yamaguchi et al. | 313/495 |
| 5,659,329 | A | 8/1997 | Yamanobe et al. | 345/74 |
| 5,682,085 | A | 10/1997 | Suzuki et al. | 315/169.1 |
| 5,818,403 | A | 10/1998 | Nakamura et al. | 345/74 |
| 6,157,137 | A | 12/2000 | Suzuki et al. | 315/169.1 |
| 6,195,076 | B1 | 2/2001 | Sakuragi et al. | 345/74 |
| 6,294,876 | B1 | 9/2001 | Ando et al. | 315/169.1 |
| 6,404,135 | B1 | 6/2002 | Shino | 315/169.1 |
| 6,489,940 | B1 | 12/2002 | Aoki | 345/93 |
| 2002/0154101 | A1 | 10/2002 | Abe et al. | 345/204 |
| 2003/0025687 | A1 | 2/2003 | Shino et al. | 345/204 |
| 2003/0038792 | A1 | 2/2003 | Murayama et al. | 345/204 |
| 2003/0063108 | A1 | 4/2003 | Isono et al. | 345/690 |
| 2004/0001039 | A1 | 1/2004 | Shino et al. | 345/100 |

FOREIGN PATENT DOCUMENTS

| | | |
|---|---|---|
| JP | 3-55738 | 3/1991 |
| JP | 4-28137 | 1/1992 |
| JP | 5-212905 | 8/1993 |
| JP | 6-230338 | 8/1994 |
| JP | 06-342636 | 12/1994 |
| JP | 7-181917 | 7/1995 |
| JP | 8-22261 | 1/1996 |
| JP | 9-281928 | 10/1997 |
| JP | 9-319327 | 12/1997 |
| JP | 10-39825 | 2/1998 |
| JP | 10-112391 | 4/1998 |
| JP | 10-153759 | 6/1998 |
| JP | 11-15430 | 1/1999 |
| JP | 11-288247 | 10/1999 |
| JP | 3049061 | 3/2000 |
| JP | 2000-172217 | 6/2000 |

OTHER PUBLICATIONS

M. Hartwell et al., *Strong Electron Emission From Patterned Tin–Indium Oxide Thin Films*, International Electron Devices Meeting (1975) pp. 519–521.

Araki et al., *Electroforming and Electron Emission of Carbon Thin Films*, Electron Beam Laboratory, Faculty of Engineering, Osaka University (1981) pp. 22–29 (English Abstract n p. 22).

W.P. Dyke, et al., *Field Emission*, Advances in Electronics and Electron Physics, vol. 8, Academic Press Inc. (1956) pp. 89–185.

C.A. Spindt et al., *Physical Properties of Thin–film Field Emission Cathodes with Molybdenum Cones*, J. Appl. Phys., vol. 47, No. 12 (1976) pp. 5248–5263.

C.A. Mead, *Operation of Tunnel–Emission Devices*, Journal of Applied Physics, vol. 32, No. 4, (1961) pp. 646–652.

PRIOR ART

PRIOR ART

DRIVE CIRCUIT, DISPLAY DEVICE, AND DRIVING METHOD

BACKGROUND OF THE INVENTION

1. Field of the Invention

The present invention relates to a drive circuit for generating a driving waveform corresponding to brightness data; a display device therewith; a driving method for generating the driving waveform; and more specifically to a method of driving a light-emitting device in an image display device provided with an image display panel having the matrix wiring of a plurality of light-emitting devices.

2. Related Background Art

Up to now, two kinds of electron emission devices, that is, a hot cathode device and a cold cathode device are known. Among these, as a cold cathode device, for example, a surface conduction electron-emitting device, a field emission type device (hereafter, an FE type device), a metal/insulating film/metal type discharge device (hereafter, an MIM type device), etc. are known. As a surface conduction electron-emitting device, for example, a device disclosed in an article of "M. I. Elinson, Radio Eng., Electron Phys., 10,1290 (1965)", and other examples described later are known.

A surface conduction electron-emitting device uses a phenomenon that electron emission occurring by letting a current in a thin film with a small area, which is formed on a substrate, in parallel with a film surface. As this surface conduction electron-emitting device, besides the device by Elinson et al. where an $SnO_2$ thin film is used, a device consisting of an Au thin film (G. Dittmer: Thin Solid Films, 9,317 (1972)), a device consisting of $In_2O_3/SnO_2$ thin film (M. Hartwell and C. G. Fonstad: IEEE Trans. ED Conf., 519 (1975)), a device consisting of a carbon thin film (Hisashi Araki, et al.: Vacuum, 26th volume, No. 1, 22 (1983)), and the like were reported.

As a typical example of the device structure of these surface conduction electron-emitting devices, a plan of the above-mentioned device by M. Hartwell et al. is shown in FIG. 28. In the figure, reference numeral 3001 denotes a substrate and numeral 3004 denotes an electro conductive thin film made of metallic oxide formed by sputtering. The electro conductive thin film 3004 is formed in H-shaped plane geometry as shown in the figure. An electron emission part 3005 is formed by performing the energization processing which is called below-mentioned energization forming, to this electro conductive thin film 3004. A gap L in the figure is set within 0.5 and 1 mm, and w is set at 0.1 mm. In addition, although the electron emission unit 3005 is shown in rectangular geometry in the center of the electro conductive thin film 3004 from convenience of illustration, this is schematic and is not necessarily expressing the location or geometry of an actual electron emission unit faithfully.

In the above-described surface conduction electron-emitting devices including the device by M. Hartwell et al., it is common to form the electron emission unit 3005 by performing the energization processing, called energization forming, to the electro conductive thin film 3004 before performing electron emission. Namely, the energization forming means to form the electron emission unit 3005 in a highly resistive state electrically by applying a fixed DC voltage or, for example, a DC voltage, which increases at a very slow rate which is about 1 V/min, to both ends of the electro conductive thin film 3004, to locally break or deform the electro conductive thin film 3004, or to change its quality. In addition, a crack arises in a portion of the electro conductive thin film 3004 which is locally broken, deformed or changed in quality. When a proper voltage is applied to the electro conductive thin film 3004 after the above-described energization forming, electron emission occurs near the above-described crack.

As examples of FE type devices, for example, devices reported by the articles of "W. P. Dyke & W. W. Dolan, Field emission, Advance in Electron Physics, 8, 89 (1956)", and "C. A. Spindt, Physical properties of thin film field emission cathodes with molybdenum cones, J. Appl. Phys., 47, 5248 (1976)" are known.

As a typical example of device structure of an FE type, a sectional view of the above-mentioned device by C. A. Spindt et al. is shown in FIG. 29. In this figure, reference numeral 3010 denotes a substrate, numeral 3011 does emitter wiring made of conductive material, numeral 3012 does an emitter cone, numeral 3013 does an insulating layer, and numeral 3014 does a gate electrode. This device makes field emission occur from an end portion of the emitter cone 3012 by applying a proper voltage between the emitter cone 3012 and gate electrode 3014. In addition, as another device structure of the FE type device, there is also an example of arranging an emitter and gate electrodes nearly in parallel with a substrate plane on a substrate except the laminated structure as shown in FIG. 29.

As an example of an MIM type device, for example, a device reported in an article of "C. A. Mead, Operation of tunnel emission Devices, and J. Appl. Phys., 32, 646 (1961)" is known. A typical example of the device structure of an MIM type device is shown in FIG. 30. This figure is a sectional view, and in the figure, reference numeral 3020 denotes a substrate, numeral 3021 does a lower electrode made of metal, numeral 3022 does a thin insulating layer with the thickness of about 100 Å, and numeral 3023 does an upper electrode made of metal with the thickness of about 80 to 300 Å. In the MIM type device, electron emission is made to occur from a surface of the upper electrode 3023 by applying a proper voltage between the upper electrode 3023 and lower electrode 3021.

Since the above-described cold cathode device can obtain electron emission at low temperature in comparison with a hot cathode device, it does not need a heater for heating. Hence, since its structure is simpler than that of a hot cathode device, it is possible to produce a fine device. In addition, even if plenty of devices are arranged in high density on a substrate, it is seldom to generate problems such as a thermofusion of a substrate. Moreover, differently from slow response speed of a hot cathode device due to an action by the heating of a heater, the cold cathode device also has an advantage that response speed is quick. For this reason, researches for applying a cold cathode device have been done actively.

For example, a surface conduction electron-emitting device has an advantage that plenty of devices can be formed over a large area since the surface conduction electron-emitting device is simple in structure and is easily produced. Then, as disclosed in, for example, Japanese Patent Application Laid-Open No. 64-31332 applied by the present applicant, methods for arranging and driving many devices have been studied. In addition, as for the application of surface conduction electron-emitting devices, image formation apparatuses such as an image display unit and an image recording device, a source of a charged beam, and the like have been studied.

In particular, as for the application to image display units, as disclosed in, for example, U.S. Pat. No. 5,066,883, Japanese Patent Application Laid-Open No. 2-257551, Japanese Patent Application Laid-Open No. 4-28137, and the like, image display units where a surface conduction electron-emitting device and phosphor which emits light by irradiation of an electron beam are combined and used have been studied. The image display units where a surface conduction electron-emitting device and phosphor are combined and used are expected in characteristics superior to those of conventional image display units where other methods are used. For example, even if it is compared with an LCD which has spread in recent years, it can be said that it is excellent in terms of not requiring a backlight since it is a spontaneous light type unit, and in terms of a wide viewing angle.

In addition, a method of arranging and driving plenty of FE type devices is disclosed in U.S. Pat. No. 4,904,895. In addition, as an example of applying an FE type device to an image display unit, for example, a flat plate type display unit reported by R. Meyer et al. is known (R. Meyer: Recent Development on Microtips Display at LETI, Tech. Digest of 4th Int. Vacuum Microelectronics Conf., Nagahama, pp. 6–9 (1991)).

In addition, as an example of applying plenty of MIM type devices to an image display unit is disclosed in Japanese Patent Application Laid-Open No. 3-55738. Furthermore, a unit where an EL (electroluminescence) device is used is disclosed in, for example, Japanese Patent Application Laid-Open No. 09-281928 as an image display unit where a device other than an electron emission device is used.

The present inventor et al. has tried, for example, a multi-electron beam source by an electric wiring method shown in FIG. 31. Thus, it is a multi-electron beam source where plenty of electron emission devices are arranged two-dimensionally, and are wired in a matrix as shown in the figure.

In the figure, reference numeral 1 schematically denotes an electron emission device, numeral 2 does row-directional wiring, and numeral 3 does column-directional wiring. The row-directional wiring 2 and the column-directional wiring 3 have wiring resistance 4 and 5, wiring inductance 6 and 7, and wiring capacitance 8. In addition, although the device is shown in a 4×4 matrix for the convenience of illustration, of course, the scale of the matrix is not necessarily restricted to this, but in the case of, for example, a multi-electron beam source for an image display unit, a sufficient number of devices for performing desired image display are arranged and wired.

In a multi-electron beam source where the matrix wiring of electron emission devices is performed, proper electric signals are applied to the wirings in the row and column directions so as to make a desired electron beam output.

A pulse width modulation waveform is shown in FIG. 32. For example, so as to drive electron emission devices in an arbitrary row in a matrix, selection potential Vs is applied to the wiring in the direction of a row selected, and non-selective potential Vns is simultaneously applied to the row-directional wirings not selected. Drive potential Ve for outputting an electron beam is applied to column-directional wirings in synchronizing with this. According to this method, a voltage of Ve-Vs is applied to the electron emission devices in the row selected, and a voltage of Ve-Vns is applied to the electron emission devices in the non-selective rows. An electron beam with desired intensity is outputted only from an electron emission device in a selected row if Ve, Vs, and Vns are made to be proper potential. In addition, since the response speed of a cold cathode device is high, if the length of time for applying drive potential Ve is changed, it is possible to change the length of time when the electron beam is outputted. Similarly, it is possible to control an electron beam also by a method which is called level modulation and which controls luminance brightness by changing potentials and current values which are applied to the column-directional wirings.

By the way, in a display unit having the effective pixel count of 1920×1080, a frame rate of 60 Hz, and 10-bit gradation, in the case of a pulse level modulation, in letting a level of energy, applied to a device, be Pi, the resolution of $Pi/2^{10}=Pi/1024$ is needed. In voltage drive, since pi becomes several volts, the resolution of several millivolts is required in a driving waveform over the whole screen of 1920×1080 pixels. It is difficult to realize this value when considering characteristics of an IC, a printed circuit board, and a power supply which constitute a drive circuit.

On the other hand, in the case of a pulse width modulation, time for driving one scanning line is 1/(60×1080)≈15 μsec. When 10-bit pulse width modulation is performed, minimum pulse width is 1/(60×1080×210)≈15 ns, and hence, the minimum pulse width resolution of 15 ns is needed.

However, wiring shown in FIG. 31 is equivalent to a low-pass filter with a cut-off frequency determined by wiring inductance (L), wiring capacitance (c), and wiring resistance (R). When signal wiring and display wiring which have such low-pass characteristics are driven by a line sequential-pulse width modulation (PWM) driving system consisting of frequency spectrum components higher than a cut-off frequency, as shown in FIG. 33, leading and trailing waveform of a PWM waveform which is applied to a device become dull, and hence, display quality in low luminance brightness is degraded. In particular, a synthetic waveform with an output waveform of a scan circuit 11 which is applied to the electron emission device 1 becomes a waveform whose level becomes low when the pulse width modulation driving waveform at low gradation is applied from an information electrode drive circuit 10. That is, since a level of a driving waveform which consists of only high frequency spectrum components, that is, a pulse width modulation driving waveform at low gradation becomes low, it is not possible to display an image at desired gradation in a low gradation region.

In addition, also when a constant current pulse with short time length is supplied from a control constant current source to a multi-electron source where great many electron emission devices are wired in a matrix, electrons are hardly emitted. When a constant current pulse is supplied for a comparatively long period, of course, electrons begin to be emitted, but long leading time was needed until electron emission began.

FIG. 33 is a time chart for explaining this, and as shown in the figure, even if a control constant current source supplies a short current pulse, a current If hardly flows into an electron emission device. In addition, even when a long pulse is supplied, the drive current If which flows into an electron emission device becomes a waveform with large leading time. Although a cold cathode type electron emission device itself has high-speed responding capability, a current waveform supplied to the electron emission device becomes dull, and hence, a waveform of an emission current Ie is also deformed as a result.

In a multi-electron source where simple matrix wiring is performed, as the scale of a matrix is enlarged, parasitic capacitance (wiring capacity) increases in connection with it. Main portions of parasitic capacitors exist in intersections of row-directional wiring and column-directional wiring, and this equivalent circuit is shown in FIG. 34. When a control constant current source 9 connected to column-directional wiring 3 starts to supply a constant current Il, the current is spent for charging a parasitic capacitor 8 in a starting stage not to serve as a drive current of the electron emission device 1. For this reason, the effective response speed of the electron emission device falls.

In addition, as for voltage drive, there are the following troubles to be solved. Generally, on a display unit using a device where a current flows with drive as a light emitting device, for example, LED, EL, FED, SED, etc., wiring resistance is designed to be low. Hence, its equivalent circuit is a model which is shown in FIG. 31 and is constituted by parasitic capacitance, parasitism resistance, and parasitism inductance. If a conventional voltage driving method is applied to such a circuit, since a charging current i flows into a parasitic capacitance by the application of a voltage, a leading edge of a driving waveform becomes dull. Furthermore, by a self-induction action of the parasitism inductance, electromotive force U=—Lx(di/dt) arises, overshoot and ringing arise, and the application of an abnormal voltage to a light emitting device arises.

In recent years, demand for display units with a large area, high resolution, and fine gradation has been remarkable, parasitic inductance and parasitic capacitance of wiring have increased in connection with it, and hence, elimination of gradations in a low luminance brightness region which is caused by dullness, an overshoot, and ringing of a leading edge of a driving waveform have become increasingly important problems to be solved.

In addition, it has become a problem that it becomes impossible that a driving waveform by simple pulse width control and pulse height value control guarantees the monotonicity of gradation because of changes and dispersion of voltage/luminescence intensity characteristics of light emitting devices.

In addition, for example, as disclosed in Japanese Patent Application Laid-Open No. 09-319327, a method and the like have been performed, the method in which a charge voltage is applied in addition to a drive current pulse by a control current source for supplying a drive current pulse to the above-described cold cathode device, a voltage source for charging parasitic capacitors of a multi-electron source at high speed, and charge voltage application means of electrically connecting the above-described voltage source with the above-described column-directional wiring in synchronizing it with an leading edge of the above-described drive current pulse, until charging to the parasitic capacitance of wiring is almost completed. When such drive is performed, it becomes possible to guarantee the linearity of gradation.

In addition, in Japanese Patent Application Laid-Open No. 8-22261, a driving waveform which has a period longer than a period of a time slot of a conventional PWM waveform is realized by dividing each word of a digital image signal into a plurality of sub words and assigning a PWM waveform, whose level is low, to a lower sub word, and a PWM waveform, whose level is high, to a higher sub word, and the deterioration of image display quality in low luminance brightness is prevented.

In addition, in Japanese Patent Application No. 10-39825, a problem of necessity of frequency increase of a PWM operating frequency which poses a problem with an increase of gradations is solved by making it possible to reduce a frequency in a pulse width modulation circuit with a drive method of having second pulse width modulation output means of outputting a binary signal whose high and low voltages are V1 and V2 respectively according to a luminance signal, and second pulse width signal output means of cutting the above-described binary signal in predetermined pulse width according to the above-described luminance signal.

Furthermore, in Japanese Patent Application No. 11-015430, fine gradation is easily realized by using a pulse driving waveform including information on M X N gradations, defined by pulse width control corresponding to M gradations, and pulse height value control corresponding to N gradations, as a voltage pulse.

However, in the drive by the conventional pulse width modulation, there is a further possibility of inducing large electromagnetic wave noise, i.e., the spurious radiation of an electromagnetic wave at leading and trailing edges of a driving waveform depending on gradation.

In addition, in a multi-electron beam source where many electron emission devices described above are arranged in a matrix, there is a problem that a voltage applied to each device becomes smaller as the device is apart from its feeding terminal due to a voltage drop caused by an influence of its wiring resistance, and in consequence, the discharge electron distribution of each device does not become uniform. Then, when this multi-electron emission device is applied to an image display unit, there is a problem that image quality deteriorates due to a voltage drop caused by a wiring resistor.

This will be described by using FIGS. 34 and 35. FIG. 34 shows an example of a substrate of a multi-electron beam source. In the figure, reference numeral 1 denotes an electron emission device, numeral 2 does a selection electrode (row-directional wiring), numeral 3 does an information electrode (column-directional wiring), numeral 9 does a selection circuit, numeral 10 does a modulation circuit, and numeral 12 does the substrate.

In addition, FIG. 35 is a perspective view of an image display panel where the substrate 11 of a multi-electron beam source shown in FIG. 34 is used. In the figure, reference numeral 13 denotes a metal back, numeral 14 does a fluorescent screen, numeral 15 does a faceplate, and numeral 16 does a current from an electron source.

Now, it is assumed that a certain selection electrode 2 is selected and all the pixels connected to the selection electrode lit up. An equivalent circuit at this time is shown in FIG. 36. In the figure, reference numeral 16 denotes a current component which flows from an information electrode to the selection electrode through an electron emission device, and numeral 4 does a resistive component of the selection electrode.

A current flowing into the selection electrode to each device is made into the same value If, and it is assumed that the resistance of a selection electrode per pixel is rf. Potential on the selection electrode at this time is calculated.

A current which flows into Rf5 is If, and an amount of a voltage drop by Rf5 is If·rf. A current which flows into Rf4 is 2·If, and an amount of a voltage drop by Rf4 is 2·IF·rf. Similarly, an amount of a voltage drop in each resistive component is calculated, and the result of calculating the potential of each portion on the selection electrode is shown in FIG. 37. In addition, here, the case of Ve>Vs is shown.

A remarkable point is that potential rises as a place is apart from a feeding point since currents flow into the selection electrode 2 when potential Vs is outputted from the selection circuitry 9 which is the feeding point, and the potential rises at the most distant edge by 21·If·rf. FIGS. 38A, 38B and 38C show driving waveforms applied to a pixel in the most distant edge at this time. In the figure, FIG. 38A shows a potential waveform applied to a selection electrode, FIG. 38B shows a potential waveform applied to an information electrode, and FIG. 38C shows a voltage waveform applied to the selected electron emission device. It can be seen that a voltage applied to the device falls because selection potential becomes Vs' from Vs.

Although this voltage dispersion does not pose a problem so much when a resistive component of a selection electrode is very small, for example, if the resistive component of a selection electrode is large due to an increase of screen size of an image display unit etc., the dispersion of the voltage cannot be disregarded. In addition, when a pixel count increases and the current which flows into a selection electrode increases, the voltage dispersion becomes large.

When this voltage dispersion arises, a voltage applied to an electron emission device differs every device, and in particular, an electron emission device near a feeding point and an electron emission device which is apart from the feeding point are not given the same voltage, and hence, difference arises in the amount of electron emission. This appears as the difference of luminance brightness between pixels which are elements which emit light by an electron beam emitted from its electron emission device, and leads to the degradation of display quality as an image display unit.

It is disclosed in Japanese Patent Application Laid-Open No. 10-112391 to make plenty of light emitting devices emit light uniformly, and to realize excellent characteristics as an image display unit by paying attention to the resistance of a wiring electrode and a current flowing in the wiring electrode in an X-Y matrix type organic EL display unit, adopting a drive method of performing driving with a current source connected to a voltage source with a drive voltage of Vcc while providing a data electrode in low resistance wiring and a scan electrode in high resistance wiring, and making the drive voltage Vcc at this time be equal to or more than a specific voltage satisfying conditions under which the current source surely performs constant current operation even if there is dispersion in wiring resistance depending on a location of a light emitting device which is a pixel.

In addition, it is mentioned in Japanese Patent No. 3049061 to divide a trailing edge of a signal, applied to modulation wiring (information signal wiring), into a plurality of steps. In addition, in Japanese Patent Application Laid-Open No. 7-181917, a method is mentioned, the method which is for generating a driving waveform by using two or more voltages corresponding to a singular or plural number of unit drive blocks and stacking these unit drive blocks in the pulse width and level directions.

SUMMARY OF THE INVENTION

An aspect of the drive circuit of a light-emitting device according to the present invention is configured as follows. To emit the light-emitting device with the brightness corresponding to brightness data, the drive circuit drives the light-emitting device by the driving waveform whose pulse width is controlled in a unit of slot width $\Delta t$ and whose level in each slot is controlled at least in n stages of $A_1$ to $A_n$ (where n is an integer equal to or larger than 2, and $0<A_1<A_2<\ldots<A_n$). In the circuit, all driving waveforms having a rising portion up to a predetermined level $A_k$ (where k is an integer equal to or larger than 2 and equal to and smaller than n) rise up to the predetermined level $A_k$ through each level in order at least by one slot from a level $A_1$ to a level $A_{k-1}$.

According to the aspect of the present invention, the light-emitting device can be correctly driven by stepwise raising the driving waveform. When the rising portion of the driving waveform has a level higher than the level $A_k$, it is not desired to raise the driving waveform suddenly after the level $A_k$ has been reached. Therefore, in the above mentioned aspect of the present invention, it is desired that the level $A_k$ is the maximum level of the driving waveform (at least in the rising portion).

Another aspect of the drive circuit of a light-emitting device according to the present invention can be configured as follows. To emit the light-emitting device with the brightness corresponding to brightness data, the drive circuit drives the light-emitting device by the driving waveform whose pulse width is controlled in a unit of slot width $\Delta t$ and whose level in each slot is controlled at least in n stages of $A_1$ to $A_n$ (where n is an integer equal to or larger than 2, and $0<A_1<A_2<\ldots<A_n$). In the circuit, all driving waveforms having a falling portion from a predetermined level $A_k$ (where k is an integer equal to or larger than 2 and equal to and smaller than n) falls from the predetermined level $A_k$ through each level from a level $A_{k-1}$ to a level $A_1$ in order at least by one slot.

A further aspect of the drive circuit of a light-emitting device according to the present invention can be configured as follows. To emit the light-emitting device with the brightness corresponding to brightness data, the drive circuit drives the light-emitting device by the driving waveform whose pulse width is controlled in a unit of slot width $\Delta t$ and whose level in each slot is controlled at least in n stages of $A_1$ to $A_n$ (where n is an integer equal to or larger than 2, and $0<A_1<A_2<\ldots<A_n$). In the circuit, the driving waveform has: a rising portion up to a predetermined level $A_k$ (where k indicates an integer equal to or larger than 2 and equal to or smaller than n) through each level from a level $A_1$ to a level $A_{k-1}$ in order at least by one slot; and a falling portion from the level $A_k$ through each level from the level $A_{k-1}$ to the level $A_1$ in order at least by one slot (hereinafter referred to as a third driving method).

A light-emitting device can be correctly driven using the drive circuit according to this aspect of the present invention.

In each of the above mentioned aspects according to the present invention, the level immediately before rising up to the level $A_1$ in the rising portion of the driving waveform can be a value at which the light-emitting device cannot be practically driven. Similarly, the level immediately after falling from the level $A_1$ in the falling portion of the driving waveform can be a value at which the light-emitting device cannot be practically driven. The level at which the light-emitting device cannot be practically driven refers to a value at which the light-emitting device does not emit light corresponding to the lowest level of gray scale of brightness data when one slot of the level is input. Practically, the level which does not exceed a drive threshold of the light-emitting device is selected.

Assume that the light-emitting device is assigned a basic potential (for example, the selected potential for use in the matrix drive described later). When the light-emitting device is assigned the driving waveform according to this aspect of the present invention, the potential difference between the potential corresponding to each portion of the driving waveform (the potential when a level is controlled based on the potential control, or the potential for passing a current when the level is controlled based on the current control) and the basic potential is assigned to the light-emitting device. When the potential difference generates non-ignorable light emission on the display corresponding to the brightness data, the level indicates the drive threshold of the light-emitting device.

A desired configuration can be obtained by setting the level at which the light-emitting device is not practically driven before the driving waveform rises up to $A_1$ equal to the level at which the light-emitting device is not practically driven after the driving waveform falls from $A_1$. If the level (high or low) of a level is determined, a higher level refers to a value which provides more driving energy for a light-emitting device, but does not always relate to the level of the potential. For example, when predetermined potential is assigned as basic potential and the potential of a driving waveform is lower than the predetermined potential, the level whichever has lower potential is higher.

With the above mentioned configuration, a driving waveform can be preferably set by setting as follows the relationship between a first driving waveform and a second driving waveform obtained by increasing/decreasing the driving energy of the first driving waveform driving a light-emitting device. That is, when the slot in which the driving waveform rises up to the level $A_1$ is defined as a first slot, the levels of the first to a (k−1)th slot are respectively $A_1$ to $A_{k-1}$, the level of a k-th slot and a $(N_k+k-1)$th slot is $A_k$, and the levels of an $(N_k+k)$th to an $(N_k+2(k-1))$th slots are level $A_{k-1}$ to level $A_1$, based on which another driving waveform is obtained by one level increasing driving energy for driving the light-emitting device into the level $A_1$ for the $(N_k+2k-1)$th slot, thereafter one level increasing the driving energy by increasing the level from $A_1$ to $A_2$ in the $N_k+2(k-1)$th slot, and increasing the driving energy by increasing the level from $A_{k-1}$ to $A_k$ in the $(N_k+k)$th slot.

That is, the driving waveform obtained by one level increasing the driving energy of the driving waveform for driving the light-emitting device having a falling portion to a level at which the light-emitting device cannot be practically driven through each level from a level $A_k$ to a value smaller than the level $A_k$ in order by one slot has a waveform obtained by increasing to Al the level of the slot subsequent to the slot having the level $A_1$ in the falling portion of the driving waveform in the preceding stage, thereafter one level increasing the energy for driving the light-emitting device with one level increasing the level of the slot before the one in which the level is one level increased in the driving waveform in the two stages before.

The aspect of the present invention defines the waveform of a drive signal. When the aspect of the present invention relates to the second driving waveform obtained by one level increasing the drive energy of the first driving waveform corresponding to a certain level of energy, it does not limit a timing of applying the first and second driving waveforms in a predetermined period. For example, in the configuration in which the first driving waveform is set up from the second slot of a predetermined period when the first driving waveform is used, when the second driving waveform is used, the second driving waveform is included in an embodiment of setting up the second driving waveform from the first slot in the predetermined period. That is, the embodiment of the present invention is not limited to the configuration in which the timing of the rise of the first driving waveform is the same as the timing of the rise of the second driving waveform in a predetermined period (for example, a selection period in the matrix drive as described later).

Each of the above mentioned aspects of the present invention can also be described as follows. That is, according to a driving method of the present invention, the driving waveform obtained by one level increasing the driving energy of the driving waveform for driving the light-emitting device having a falling portion to a level at which the light-emitting device cannot be practically driven through each level from a level $A_k$ to a value smaller than the level $A_k$ in order by one slot has a waveform obtained by increasing to $A_1$ the level of the slot subsequent to the slot having the level $A_1$ in the falling portion of the driving waveform in the preceding stage, thereafter one level increasing the energy for driving the light-emitting device with one level increasing the level of the slot before the one in which the level is one level increased in the driving waveform in the two stages before.

Thus, by setting the relationship among the driving waveforms as described above, a change of a level in the consecutive slots in the falling portions of the respective driving waveforms can be within one level.

Especially, the relationship in which the driving waveform obtained by one level increasing the energy for driving the light-emitting device of the preceding driving waveform has the waveform obtained by one level increasing the level of the slot before the one in which the level is one level increased over the driving waveform of the two stages before can preferably apply the configuration in which the driving waveform depending on the relationship is satisfied by a series of driving waveforms up to the driving waveform whose level of the slot in which the level is increased from the driving waveform in the preceding stage and has a level one level higher than the level $A_k$. The driving waveform to be obtained by one level increasing the last driving waveform of the series of driving waveforms can be obtained as a waveform obtained by changing into $A_1$ the level of the slot subsequent to the slot having the level $A_1$ in the falling portion of the last driving waveform.

Furthermore, the following process can be applied when the level $A_k$ is the maximum permissible level, or when the update of the level is to be avoided if possible. That is, the relationship in which the driving waveform obtained by one level increasing the energy for driving the light-emitting device of the preceding driving waveform has the waveform obtained by one level increasing the level of the slot before the one in which the level is one level increased over the driving waveform of the two stages before can preferably apply the configuration in which the driving waveform depending on the relationship is satisfied by a series of driving waveforms up to the driving waveform whose level of the slot in which the level is increased from the driving waveform in the preceding stage and has a level one level higher than the level $A_k$. The driving waveform to be obtained by one level increasing the last driving waveform of the series of driving waveforms can be obtained as a waveform obtained by changing into $A_1$ the level of the slot subsequent to the slot having the level $A_1$ in the falling portion of the last driving waveform.

Furthermore, a series of driving waveforms having different driving energy in each stage can be set as follows. That is, when the slot in which the driving waveform rises up to the level $A_1$ is defined as a first slot, the levels of the first to a (k−1)th slot are respectively $A_1$ to $A_{k-1}$, the level of a k-th slot and a $(N_k+k-1)$th slot is $A_k$, and the levels of an $(N_k+k)$th to an $(N_k+2(k-1))$th slots are level $A_{k-1}$ to level $A_1$, based on which another driving waveform is obtained by one level decreasing driving energy for driving the light-emitting device from $A_k$ to $A_{k-1}$ for the k-th slot, thereafter one level decreasing the driving energy by increasing the level from $A_{k-1}$ to $A_{k-2}$ in the (k−1)th slot, and increasing the driving energy by increasing the level from $A_1$ to the level at which the light-emitting device cannot be practically driven in the first slot.

The aspect of the present invention defines the waveform of a drive signal. When the aspect of the present invention relates to the second driving waveform obtained by one level increasing the drive energy of the first driving waveform corresponding to a certain level of energy, it does not limit a timing of applying the first and second driving waveforms in a predetermined period. For example, in the configuration in which the first driving waveform is set up from the second slot of a predetermined period when the first driving waveform is used, when the second driving waveform is used, the second driving waveform is included in an embodiment of setting up the second driving waveform from the first slot in the predetermined period. That is, the embodiment of the present invention is not limited to the configuration in which the timing of the rise of the first driving waveform is the same as the timing of the fall of the second driving waveform in a predetermined period (for example, a selection period in the matrix drive as described later).

The embodiment can be described as follows. That is, a driving waveform having a rising portion up to a level $A_k$ in order at least by one slot from each level lower than the level $A_k$ can be obtained by a driving waveform having one level decreased energy for driving the light-emitting device as having a waveform indicating the level $A_{k-1}$ of the slot which is subsequent to the slot having the level $A_{k-1}$ in the rising portion in the preceding driving waveform and whose level is $A_k$, and the driving waveform having one level decreased energy for driving the light-emitting device has a one level decreased waveform from the level of the slot before the one from which the level of the driving waveform is one level decreased.

In each of the above mentioned aspects of the present invention, it is preferable that the level in the slot between two slots having the level $A_k$ is also $A_k$. Since the levels can be maintained in the portion other than the rising and falling portions, the light-emitting device can be more correctly driven and a driving waveform can be easily generated.

The following configuration is also preferable. That is, in the driving waveform including two slots having the level $A_k$ and including between the two slots other slots having the level $A_k$, with the level $A_k$ including the case in which k=1, and smaller than An, and the having two or three slots having the level $A_k$ by one level increasing the driving energy, the driving waveform having one level further increased driving energy has the level of the central slot in the three slots having the level $A_{k+1}$ changed from $A_k$.

It is also desired that the driving waveform obtained by increasing the driving energy for driving the light-emitting device more than a predetermined driving waveform increases the pulse width rather than raise the maximum level.

By prioritizing the increase of a pulse width over the raise of the level when the driving energy is increased, an effect of decreasing a current flowing in a moment can be expected. In this process, a preferred configuration for prioritizing the increase of the pulse width over the raise of the level is configured such that the maximum level cannot be exceeded when the driving energy is increased by increasing the pulse width of any level with the raising or falling through each level at least by one slot maintained.

The following configuration is also preferred. That is, the driving waveform obtained when the maximum level of the driving waveform is set high by one level increasing the driving energy for driving the light-emitting device is configured such that the maximum level can continue as much as possible by increasing by one the number of unit driving waveform blocks defined by the level difference $A_n-A_{n-1}, \ldots,$ or $A_n-A_1$ or the level difference between the level $A_1$ and the level which is the driving threshold of the light-emitting device, and the slot width Δt.

By prioritizing the increase of a pulse width over the raise of the level when the driving energy is increased, an effect of decreasing a current flowing in a moment can be expected. However, in the configuration of increasing the pulse width to increase the driving energy, it is necessary to use a higher level in a predetermined stage when the pulse width of a driving waveform is limited. When the level, especially the maximum level, is seriously considered, it is desired that the unit driving waveform blocks forming the driving waveform can be arranged such that the maximum level can continue for the longest possible period in the range of a stepped rise, a stepped fall, or both of them.

Furthermore, the following configuration is also preferable. That is, the driving waveform obtained by increasing the driving energy for driving the light-emitting device on a predetermined driving waveform is configured by adding unit driving waveform blocks defined by the level difference $A_n-A_{n-1}, \ldots,$ or $A_n-A_1$ or the level difference between the level $A_1$ and the level which is the driving threshold of the light-emitting device, and the slot width Δt by priority in the position where the maximum level $A_k$ including k=1 can be lower. Especially, the driving waveform obtained by increasing the driving energy for driving the light-emitting device on a predetermined driving waveform is configured by adding unit driving waveform blocks defined by the level difference $A_n-A_{n-1}, \ldots,$ or $A_2-A_1$ or the level difference between the level $A_1$ and the level which is the driving threshold of the light-emitting device, and the slot width Δt by priority in the position where the maximum level $A_k$ including k=1 can be lower, and the maximum level can continue the longer.

Practically, in the driving waveform whose maximum level $A_k$ which is the number of slots i is S−2(k−1) with the largest number of slots defined as S, the driving waveform obtained by one level further increasing the driving energy by adding the unit driving waveform blocks is the driving waveform having the level of an arbitrary slot in the (k+1)th to the (S−k)th slots changed from $A_k$ to $A_{k+1}$. The slot in which the level is changed from $A_k$ to $A_{k+1}$ is, for example, either the (k+1)th slot or the (S−k)th slot.

The driving waveform according to the present invention obtained by increasing the maximum level of the driving waveform by one level increasing the driving energy for driving the light-emitting device on a predetermined driving waveform can be an intermediate configuration between a configuration of rearranging the unit driving waveform blocks such that the maximum level can continue as much as possible by increasing by one the number of the unit driving waveform blocks which is used by the predetermined driving waveform, and a configuration obtained by adding by priority the unit driving waveform block in the position where the maximum level $A_k$ including k=1 can be lower. That is, the driving waveform whose maximum level is increased by one level increasing the driving energy for driving the light-emitting device on a predetermined driving waveform is obtained by rearranging the unit driving waveform blocks such that the maximum level can continue for at least two slots by increasing the number of the unit driving waveform blocks by one over the number used for the predetermined driving waveform.

Furthermore, the present invention also includes the configuration in which the maximum level does not continue for two or more slots. That is, the driving waveform obtained by increasing the maximum level by one level increasing the driving energy for driving the light-emitting device on a predetermined driving waveform is obtained by rearranging the unit driving waveform blocks such that the maximum level can continue for two or more slots by increasing by one the number of the unit driving waveform blocks over the number used in the predetermined driving waveform.

In each of the above mentioned aspects of the present invention, it is desired that the driving waveform having a level $A_1$ and the slot width $\Delta t$ is configured to have the driving energy for emitting light with the brightness corresponding to substantially 1 LSB of the brightness data.

The levels $A_1$ to $A_n$ can preferably form the configurations of different potential. For example, the levels $A_1$ to $A_n$ can form the configuration corresponding to the potential with which the brightness of the light-emitting device is substantially 1:2: . . :n. Furthermore, the levels $A_1$ to $A_n$ can form the configuration corresponding to the potential with which the level difference $A_m-A_{m-1}$ (where m indicates an integer equal to or larger than 1 and equal to or smaller than n, and the level $A_1$ is a driving threshold of a light-emitting device) is substantially constant. Furthermore, the levels $A_1$ to $A_n$ can also be different current values.

In addition, with the driving waveform having a substantially constant level difference $A_m-A_{m-1}$ (where m is an integer equal to or larger than 1 and equal to or smaller than n, and $A_0$ is a driving threshold of a light-emitting device), or $A_m-A_{m-1} \geqq A_{m-1}-A_{m-2}$ for m equal to or larger than 2, the level $A_k$ indicating the maximum level including the value when k=1, the level $A_k$ smaller than An, the level of the slot enclosed by the slots having the level $A_k$, and the $N_k+2(k-1)$ reaching a predetermined largest number of slots of S (where S indicates an integer equal to or larger than 2n−1), when the driving energy is increased by one level, and when, instead of changing the level of the slot which is adjacent to the slot having the level $A_1$ and has the level at which the light-emitting device cannot be practically driven, the number of the slots having the levels higher than the level $A_1$ is larger than and an integer closest to $(S \cdot k+2k+1)/(k+1)$, the driving waveform is changed into that in the third driving method having the maximum level $A_{k+1}$, and the number of the unit driving waveform blocks defined by the level difference $A_m-A_{m-1}$ and the slot width $\Delta t$ larger by one than the above mentioned driving waveform, the level gets smaller when the driving energy is one level increased, and the level of the slot closer to the slot one level higher gets one level larger.

With the configuration, the levels $A_1$ to $A_n$ can have the brightness of the light-emitting device of substantially 1:2: . .: in potential, and the levels $A_1$ to $A_n$ can indicate the level difference $A_m-A_{m-1}$ (where m is an integer equal to or larger than 1 and equal to or smaller than n) substantially constant in potential. The levels $A_1$ to $A_n$ can be configured as having the current value having the level of substantially 1:2: . . :n.

The present invention also includes the following aspects. That is, a drive circuit for generating a driving waveform corresponding to brightness gray-scale data: whose level is controlled by a plurality of discontinuous levels including the minimum level corresponding to the non-zero brightness gray-scale data and one or more non-minimum levels corresponding to larger brightness gray-scale data; which generates a driving waveform signal whose pulse width is controlled by discontinuous pulse widths; and whose driving waveform has a portion controlled by the non-minimum level at the head and the end of the driving waveform.

The level corresponding to non-zero brightness gray-scale data refers to a level at which a level at which light can be emitted corresponding to the brightness gray-scale data other than zero by applying the driving waveform controlled for the level to a light-emitting device.

The present invention also includes the following aspects. That is, a drive circuit for generating a driving waveform corresponding to brightness gray-scale data: whose level is controlled by a plurality of discontinuous levels including the minimum level corresponding to the non-zero brightness gray-scale data and one or more non-minimum levels corresponding to larger brightness gray-scale data; which generates a driving waveform signal whose pulse width is controlled by discontinuous pulse widths; and whose entire driving waveforms have a portion controlled by the non-minimum level at least at one of the head and the end of the driving waveform.

The present invention also includes the following aspects. That is, a drive circuit for generating a driving waveform corresponding to brightness gray-scale data: whose level is controlled by a plurality of discontinuous levels including the minimum level corresponding to the non-zero brightness gray-scale data, non-minimum levels corresponding to larger brightness gray-scale data, and an intermediate level between the minimum level and the non-minimum level; which generates a driving waveform signal whose pulse width is controlled by discontinuous pulse widths; as whose driving waveforms having a portion controlled by the non-minimum level, a portion controlled by the minimum level is included at the head at a predetermined time width, a portion controlled by the intermediate level is included immediately after, and a portion controlled by the non-minimum level larger than the intermediate level is included immediately after the portion at a time width larger than the predetermined time width; and which generates a driving waveform having a portion controlled by the non-minimum level larger than the intermediate level at a width larger than the predetermined time width.

There can be two or more intermediate levels.

The present invention also includes the following aspects. That is, a drive circuit for generating a driving waveform corresponding to brightness gray-scale data: whose level is controlled by a plurality of discontinuous levels including the minimum level corresponding to the non-zero brightness gray-scale data, non-minimum levels corresponding to larger brightness gray-scale data, and an intermediate level between the minimum level and the non-minimum level; which generates a driving waveform signal whose pulse width is controlled by discontinuous pulse widths; as whose driving waveforms having a portion controlled by the non-minimum level, a portion controlled by the minimum level is included at the end, a portion controlled by the intermediate level is included immediately before, and a portion controlled by the non-minimum level larger than the intermediate level is included before the portion controlled by the intermediate level at a time width larger than the predetermined time width; and which generates a driving waveform having a portion controlled by the non-minimum level larger than the intermediate level at a width larger than the predetermined time width.

The present invention also includes the following aspects. That is, in a method of driving the light-emitting device by a driving waveform whose pulse width is controlled in a slot width Δt and whose level is controlled in n stages of at least $A_1$ to $A_n$ (where n is an integer equal to or larger than 2, and $0<A_1<A_2<\ldots<A_n$) in each slot to emit a light-emitting device with the brightness corresponding to brightness data, a series of predetermined driving waveforms obtained by one level increasing the driving energy of the driving waveform for driving the light-emitting device having a falling portion through each level from a level $A_k$ to a value smaller than the level $A_k$ in order at least by one slot having a waveform obtained by increasing to $A_1$ the level of the slot subsequent to the slot having the level $A_1$ in the falling portion of the driving waveform in the preceding stage, thereafter one level increasing the energy for driving the light-emitting device with one level increasing the level of the slot before the one in which the level is one level increased in the driving waveform in the two stages before, from which a desired driving waveform is selected to drive the light-emitting device.

The series of driving waveforms can be, for example, from the predetermined driving waveform to the driving waveform subsequent to the predetermined driving waveform, and the driving waveform obtained by increasing to $A_1$ the level of the slot subsequent to the slot whose level is $A_1$ in the falling portion of the predetermined driving waveform, and the subsequent driving waveforms obtained by one level increasing the driving energy for driving the light-emitting device on the driving waveform in the preceding stage one level increasing the level of one slot before the slot obtained by one level increasing the level on the two stages before in the driving waveform in the previous driving waveform, thereby obtaining one or more driving waveforms and the driving waveform in the previous stage in the relation for which the level is increased in the slot whose level is the level $A_k$.

Furthermore, the series of driving waveforms can be the subsequent driving waveforms having the level $A_k$ in the slot in which the level is increased for the driving waveform in the preceding stage, a series of driving waveforms having a level one level higher than the level $A_k$ of the slot before the slot having the level $A_k$ in the preceding stage in the above mentioned relation, or the waveform obtained by increasing the level to $A_1$ of the slot subsequent to the slot whose level is $A_1$ in the falling portion of the driving waveform in the slot in which the level of the driving waveform in the preceding stage is increased.

The aspect of the present invention includes the following aspect. That is, in a method of driving the light-emitting device by a driving waveform whose pulse width is controlled in a slot width Δt and whose level is controlled in n stages of at least $A_1$ to $A_n$ (where n is an integer equal to or larger than 2, and $0<A_1<A_2<\ldots<A_n$) in each slot to emit a light-emitting device with the brightness corresponding to brightness data, the driving waveform obtained by one level decreasing the energy for driving the light-emitting device from a predetermined driving waveform having a rising portion up to the level $A_k$ through each level lower than the level $A_k$ in order at least by one slot has a waveform by changing the level $A_k$ of the slot subsequent to the slot having the level $A_{k-1}$ in the rising portion of the driving waveform in the preceding stage into the level $A_{k-1}$, and the driving waveform obtained by one level decreasing the energy for driving the light-emitting device is obtained by selecting a desired driving waveform from a series of driving waveforms obtained by one level decreasing the level of one slot before the slot obtained by one level decreasing the level from the driving waveform in the two stages before and driving the light-emitting device.

The aspect of the present invention includes the following aspect. That is, in a method of driving the light-emitting device by a driving waveform whose pulse width is controlled in a slot width Δt and whose level is controlled in n stages of at least $A_1$ to $A_n$ (where n is an integer equal to or larger than 3, and $0<A_1<A_2<\ldots<A_n$) in each slot to emit a light-emitting device with the brightness corresponding to brightness data, a plurality of driving waveform corresponding to plural pieces of brightness data have rising portions up to a predetermined level $A_k$ (where k indicates an integer equal to or larger than 3 and equal to or smaller than n), and includes a driving waveform having a rising portion up to the predetermined level $A_k$ through each level from a level $A_1$ to a level $A_{k-1}$ in order at least by one slot.

The aspect of the present invention includes the following aspect. That is, in a method of driving the light-emitting device by a driving waveform whose pulse width is controlled in a slot width Δt and whose level is controlled in n stages of at least $A_1$ to $A_n$ (where n is an integer equal to or larger than 3, and $0<A_1<A_2<\ldots<A_n$) in each slot to emit a light-emitting device with the brightness corresponding to brightness data, a plurality of driving waveform corresponding to plural pieces of brightness data have falling portions to a predetermined level $A_k$ (where k indicates an integer equal to or larger than 3 and equal to or smaller than n), and includes a driving waveform having a falling portion from the predetermined level $A_k$ through each level from a level $A_{k-1}$ to a level $A_1$ in order at least by one slot.

In each of the above mentioned aspects of the present invention, the light-emitting devices are a plurality of light-emitting device forming a matrix display, and apply to each light-emitting device the driving waveform corresponding to respective brightness data.

The present invention also includes the following configuration as an aspect of the display device according to the present invention.

In a display device having a multilight-emitting device by matrix-wiring a plurality of light-emitting devices using scanning signal wiring and information signal wiring, a scanning circuit connected to the scanning signal wiring, and a modulation circuit connected to the information signal wiring, the modulation circuit drives a light-emitting device selected by the scanning circuit in each of the above mentioned driving methods.

Practically, the scanning circuit sequentially selects each scanning signal wiring, assigns selected potential as basic potential to the selected scanning signal wiring, and assigns to a plurality of light-emitting devices connected to the selected scanning signal wiring a signal having the above mentioned driving waveforms through a plurality of information signal wiring to which the elements are connected.

With the configuration, it is desired that the time from starting the rise of the driving waveform to the reaching the maximum level $A_k$ can be set such that the time can be substantially equal to or larger than a time constant of 0% to 90% depending on the load of the information signal wiring of the multilight-emitting device and the driving capability of the drive circuit.

The time constant of 0% to 90% is used in measuring a driving waveform at a portion where the driving waveform is supplied to the wiring, and refers to the time required to reach the potential 0.9 times as high as the potential difference from the time when the potential starts changing in the portion when the driving waveform rises up to the desired potential. By raising the driving waveform in a time substantially equal to or longer than the time constant of 0% to 90%, a voltage 90% or more as high as the voltage to be applied to both ends of the electron sources can be applied, thereby obtaining the brightness of 90% or more than the desired amount of light emission.

With the configuration of distributing an electric current concurrently flowing through a plurality of information signal wirings, it is desired that the driving waveform to be applied to a part of the above mentioned plurality of information signal wirings is controlled such that the rise can start in the first half of the selection period, and the driving waveform to be applied to another part of the information signal wiring is controlled such that the fall can start in the second half of the selection period. In one selection period, a plurality of slots are set to control the pulse width. Practically, the driving waveform to be applied to a part of the above mentioned plurality of information signal wirings is applied such that the driving waveform can rise from the first (or close to first) slot for the pulse width control in the selection period independent of the corresponding driving energy (gray-scale), and the driving waveform to be applied to the remaining information signal wiring is applied such that the driving waveform can rise in the last (or close to the last) slot for the pulse width control in the selection period independent of the corresponding driving energy, thereby distributing the current concurrently flowing in a plurality of information signal wirings. Specifically, it is desired that the information signal wiring in which the rise timing of the driving waveform to be applied set in the first half in the selection period and the information signal wiring in which the fall timing of the driving waveform to be applied set in the second half in the selection period can be alternately arranged. At this time, it is desired that the time axis of the driving waveform can be configured opposite between a part of the plurality of information signal wiring and the remaining portions.

With the above mentioned configuration, the modulation circuit receives R-bit brightness data as image data, the pulse width is controlled within the range of the number of slots of $2^P$, and the level is controlled at the $n=2^Q$ stage. It is desired to set the relation of $R<P+Q$ for the data of R, P, and Q.

The present invention also includes the following aspect. That is, in a display device having a multilight-emitting device by matrix-wiring a plurality of light-emitting devices using scanning signal wiring and information signal wiring, a scanning circuit connected to the scanning signal wiring, and a modulation circuit connected to the information signal wiring, the modulation circuit includes a circuit for controlling a pulse width of a unit pulse of a slot width $\Delta t$ in a range of 0 to 22 to display R-bit brightness data to be input as image data, and a circuit for controlling a level within a range of the first to the $2^Q$-th level of a level level, and the data of the R, P, and Q has the relation of $R<P+Q$.

A light-emitting device according to the present invention can be an LED, an EL, and an electron emission device. The electron emission device does not emit light itself, but can be used as a light-emitting device using an object fluorescent through emitted electrons. The electron emission device can be a cold cathode device. A field emission (FE) type electron emission device, and an MIM type electron emission device can be preferably used. Especially, a surface conduction type emission device (SCE) can be preferably used. The surface conduction type emission device can generate a number of devices with uniform electron emission characteristic, and is a desired device.

According to the driving method of the present invention, a combination use of pulse width control and pulse level control enables the resolution of a level of pulse level control, that is, the minimum level difference, to be set as an easily realized value. Furthermore, the resolution of the pulse width control, that is, the slot width can be larger to lower the maximum frequency of a drive signal and the maximum level. Especially, by raising or dropping the driving waveform in a stepped form, the levels of the rising or falling portions can be protected against a sudden change. Thus, for example, an unnecessary radiation can be suppressed. Furthermore, an irregular driving waveform can be reduced to prevent the deterioration of the gray-scale characteristic at a low gray scale level. In addition, the occurrence of overshoot or ringing can be suppressed, and the application of an abnormal voltage to a light-emitting device can be prevented.

DETAILED DESCRIPTION OF THE PREFERRED EMBODIMENTS

Figure 1:
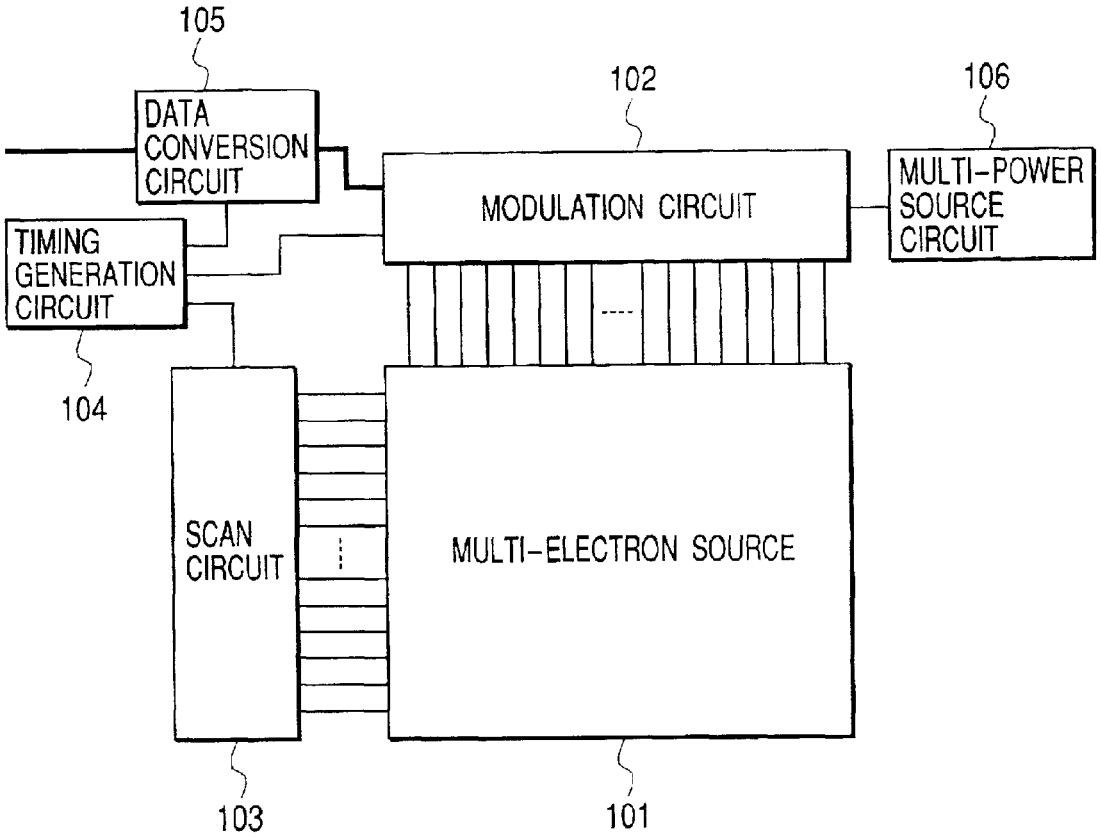
FIG. 1 is a block diagram of a multi-electron source drive circuit according to an embodiment of the present invention.

In one of preferable embodiments of the present invention, as for a driving waveform at the time when the number of slots whose maximum levels are $A_k$ becomes $N_k$ (here, $N_k$ is an integer which is one or more) from $N_k-1$ by increasing the drive energy of a driving waveform by one step, by letting a slot where the waveform rises to a level $A_1$ be a first slot, let levels of first to (k−1)-th slots be $A_1$ to $A_{k-1}$ respectively, and let levels of k-th to ($N_k$+k−1)-th slots be $A_k$, and let levels of ($N_k$+k)-th to ($N_k$+2 (k−1))-th slots be $A_{k-1}$ to $A_1$ respectively. Levels of other slots except them are made to be values at which a device is not driven substantially. Then, against this, a driving waveform having drive energy with one more step is obtained by changing the level of a ($N_k$+2k−1)-th slot from the value, at which a device is not driven substantially, to $A_1$, and it is possible to form the driving waveform obtained by increasing the above-described drive energy at a time by one step by changing the level of a ($N_k$+2(k−1))-th slot from $A_1$ to $A_2$ hereafter, and changing the level of a ($N_k$+k)-th slot from $A_{k-1}$ to $A_k$. In addition, it is also good to reverse the order of this waveform setting method.

In order to carry a maximum level, in the case that the above-described drive energy is increased by one more step for a driving waveform whose above-described maximum level $A_k$ is smaller than $A_n$ while including the case of k=1, and in which the number of the slots whose levels are the maximum level $A_k$ becomes three from two, the level of the (k+1)-th slot is changed to $A_{k+1}$ from $A_k$ instead of changing the level of the above-described ($N_k$+2k−1)-th slot to $A_1$ from 0.

Namely, the driving waveform having the drive energy, increased by one more step, for the driving waveform where the number of the slots whose levels are $A_k$ becomes three from two by increasing one more step of drive energy for the previous driving waveform is made into the geometry of changing the level of a center slot among three slots, having levels of the above-described driving waveform which are $A_k$, from $A_k$ to $A_{k+1}$. In addition, it is also good to make the driving waveform, having drive energy, increased by one more step, for the driving waveform where the number of slots whose levels are $A_k$ becomes four from three by increasing one more step of drive energy for the previous driving waveform, be in the geometry of changing the levels of slots except both ends out of the four slots, whose levels of the above-described driving waveform are $A_k$, to $A_{k+1}$ from $A_k$. Hereafter, the drive method using such a driving waveform train is called "V14 driving".

Alternatively, in the case that the above-described drive energy is increased by one more step for a driving waveform whose above-described maximum level $A_k$ is smaller than $A_n$ while including the case of k=1, and in which the above-described ($N_k$+2(k−1))-th slot reaches the maximum slot number S (here, S is an integer which is 2n−1 or more), the driving waveform is changed into a driving waveform in which pulse width is the number of slots that is equal to or more than (S·k+2k+1)/(k+1) and closest to this, whose maximum level is Ak+1, and which shows step-like leading and trailing edges where the number of the above-described unit driving waveform blocks is larger by one than that of the driving waveform instead of changing the level of the above-described ($N_k$+2k−1)-th slot to $A_1$ from the level at which a device is not driven substantially. Then, if there is a plurality of slots whose levels are any values of $A_1$ to $A_k$, and are the same, a level of a slot whose level is smaller and which is closer to a slot, whose level is larger by one step, is enlarged by one step when making the above-described drive energy increase by one step further henceforth.

Hereafter, the drive method using such a driving waveform train is called "Vn driving". In this Vn driving, in order to maintain monotonicity at the time of carrying a maximum level, it is preferable that a level and level difference are $A_n-A_{n-1} \geqq \ldots \geqq A_2-A_1>A_1$, or are almost constant, and in particular, it is preferable that $A_n-A_{n-1} \ldots =A_2-A_1=A_1$. In addition, it is preferable that a unit driving waveform block which is determined by level difference $A_n-A_{n-1}, \ldots$, or $A_2-A_1$, or level difference between a level $A_1$ and a level which becomes a drive threshold of a device, and slot width $\Delta t$ has the drive energy which makes the above-described light emitting device emit light in luminance brightness corresponding to 1 LSB of luminance brightness data (luminance brightness corresponding to the minimum gradation) respectively.

Another method of carrying the maximum level forms the above-described driving waveform by preferentially adding a unit driving waveform block, which is determined by level difference $A_n-A_{n-1}, \ldots$, or $A_2-A_1$, or level difference between a level $A_1$ and a level which becomes a drive threshold of a device, and slot width $\Delta t$, to a location where the maximum level $A_k$ including k=1 is lower and the maximum levels continue, and changes a level of an arbitrary slot among a (k+1)-th slot to a (S−k)-th slot, and preferably, a level of a leading or trailing slot in the above-described range to Ak+1 from $A_k$ when making the above-described drive energy increase by one more step for a driving waveform where the number of slots whose leveld are the maximum level $A_k$ is S−2(k−1) with letting the maximum number of slots be S. Hereafter, the drive method using such a driving waveform train is called "new Vn driving".

EXAMPLES

Hereafter, examples of the present invention will be described.

Example 1

Figure 34:
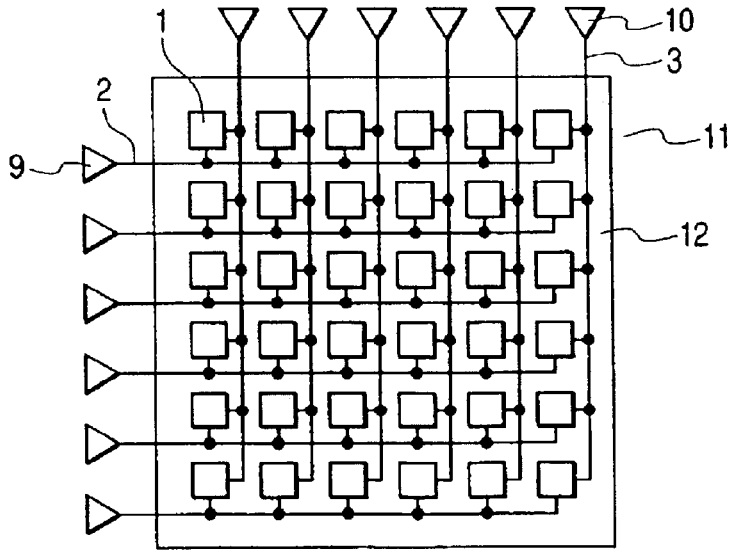
FIG. 34 is a structural diagram of a multi-electron beam source.
Figure 35:
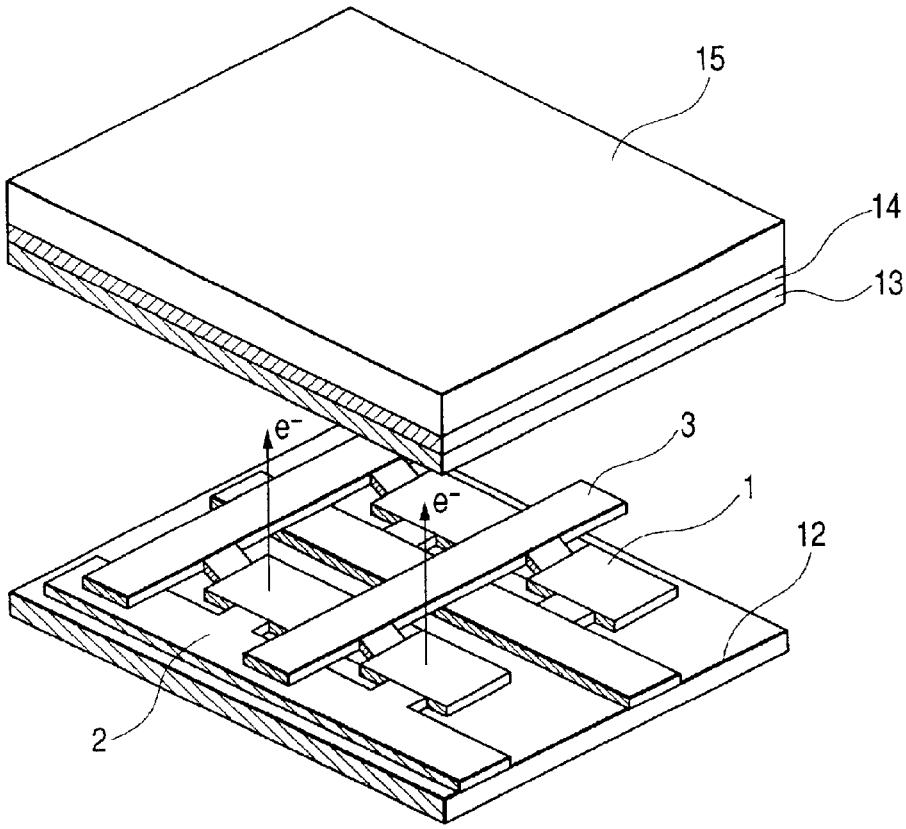
FIG. 35 is an exploded perspective view of the multi-electron source in FIG. 34.
Figure 36:
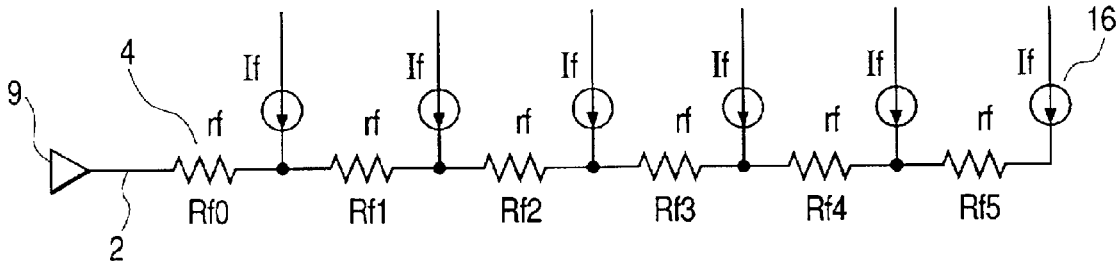
FIG. 36 is an equivalent circuit diagram at the time when all the pixels connected to a certain selection electrode light up.
Figure 37:
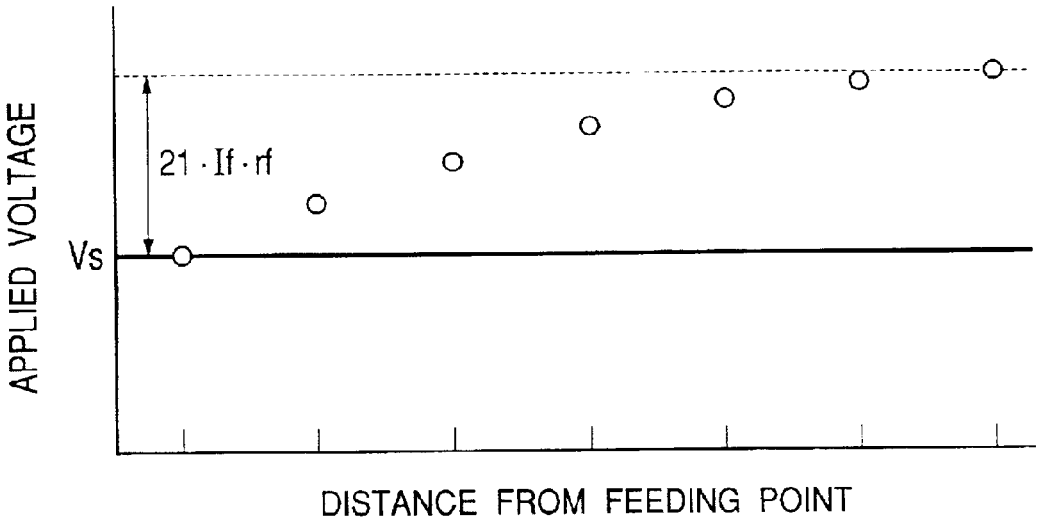
FIG. 37 is a graph showing the voltage of each portion on a selection electrode in the circuit shown in FIG. 36.
Figure 38A:
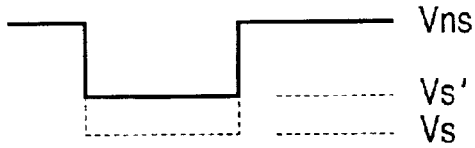
FIGS. 38A, 38B and 38C are charts of driving waveforms applied to a pixel in the most distant edge in the circuit shown in FIG. 36.
Figure 38B:
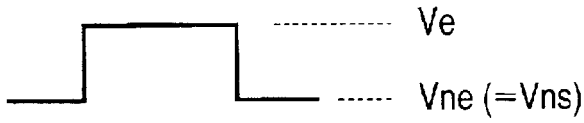
Figure 38C:
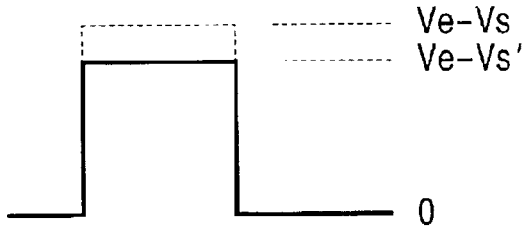

FIG. 1 is a block diagram of a multi-electron source drive circuit according to an example of the present invention. This figure shows a multi-electron source 101, a modulation circuit 102, a scan circuit 103, a timing generation circuit 104, a data conversion circuit 105, and a multi-power source circuit 106. A multi-electron source 101 is driven in this structure. As shown in FIG. 34, the multi-electron source 101 comprises an electron source (electron emission device) 1 provided in an intersection of row-directional wiring 2 and column-directional wiring 3. As an electron source, although the SCE type, FE type, and MIM type electron emission device are known as described above, in this Example, the SCE type electron emission device was used.

The data conversion circuit 105 converts drive data, used for driving the multi-electron source 101 from the external, into a format suitable for the modulation circuit 102. The modulation circuit 102 is connected to the column-directional wiring of the multi-electron source 101, and inputs a modulated signal into the multi-electron source 101 according to the drive data, which is given data conversion, from the data conversion circuit 105. The scan circuit 103 is connected to the row-directional wiring of the multi-electron source 101, and selects a row of the multi-electron source 101 to which an output of the modulation circuit 102 is applied. Although line sequential scanning which sequentially selects a row at a time is generally performed, it is no problem to select a plurality of rows or to select a plane, without being limited to this. The timing generation circuit 104 generates timing signals for the modulation circuit 102, scan circuit 103, and data conversion circuit 104. The multi-power source circuit 106 outputs a plurality of supply values, and controls an output value of the modulation circuit 102. Generally, although being a voltage source circuit, the multi-power source circuit 106 is not limited to this.

Figure 2:
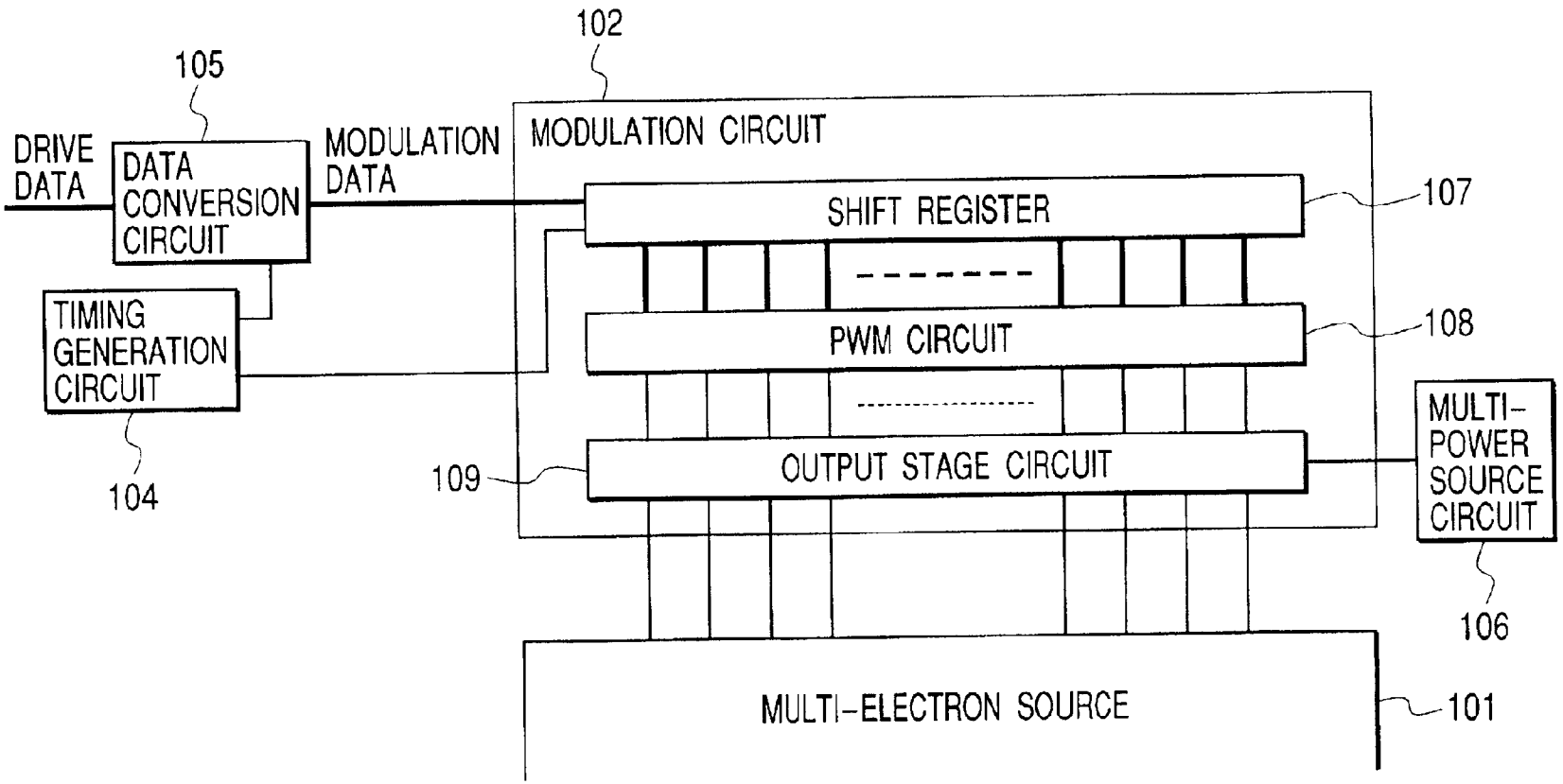
FIG. 2 is a block diagram of a modulation circuit in FIG. 1.

Next, the modulation circuit 102 will be described in detail with a block diagram in FIG. 2. FIG. 2 is a block diagram showing the internal structure of the modulation circuit 102. The modulation circuit 102 comprises a shift register 107, a PWM circuit 108, and an output stage circuit 109. The modulation data which is given format conversion of drive data by the data conversion circuit 105 is inputted into the shift register 107, and modulation data according to the column-directional wiring of the multi-electron source 101 is transmitted by the shift register 107. The output stage circuit 109 is connected to the multi-power source circuit 106, and outputs a driving waveform according to the present invention. The PWM circuit 108 inputs modulation data according to the column-directional wiring of the multi-electron source 101 from the shift register 107, and generates a pulse width output according to each output voltage of the output stage circuit 106. In addition, the timing signal for the control of the shift register 107 and PWM circuit 108 is inputted from the timing generation circuit 104.

Figure 3:
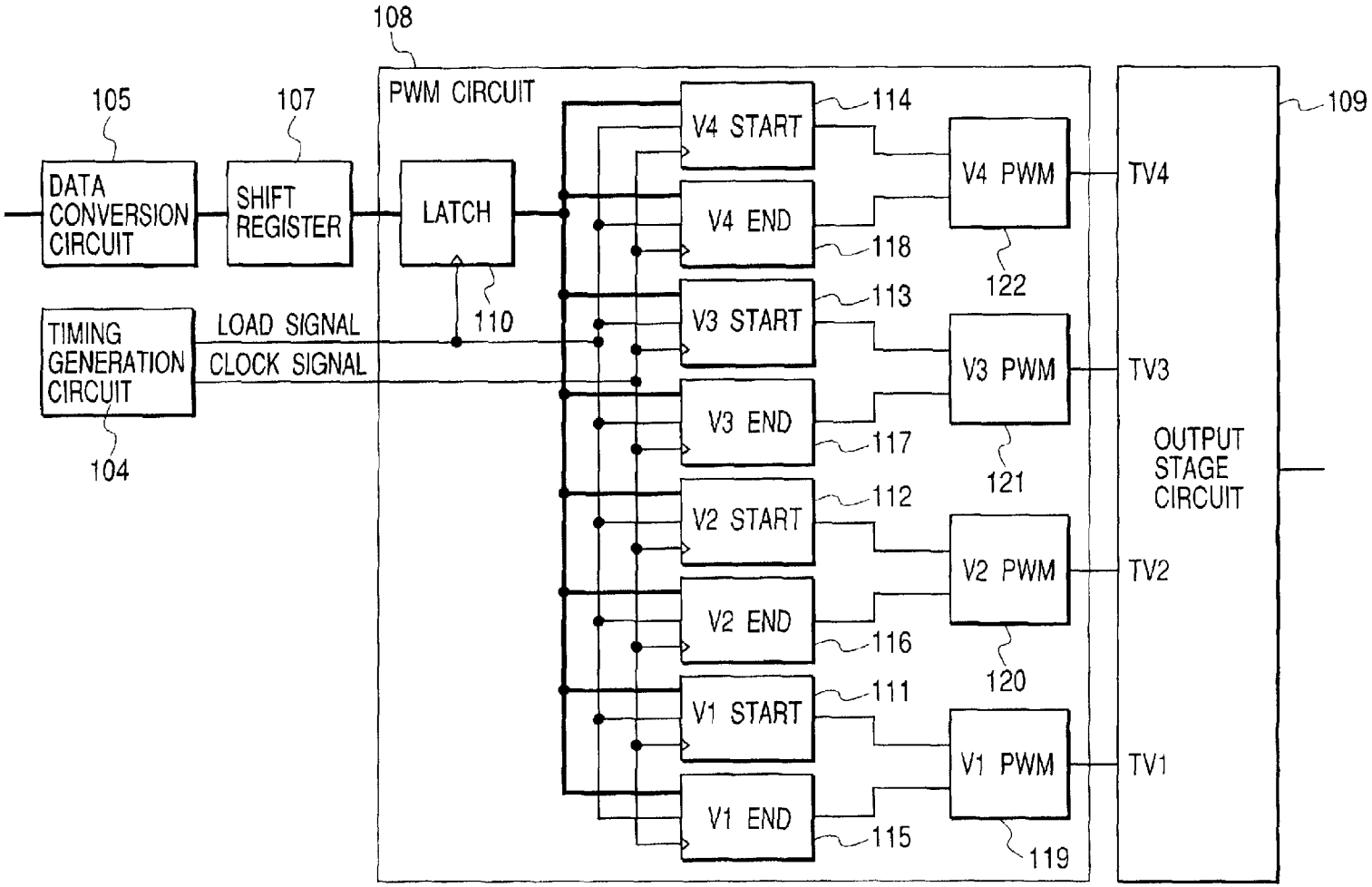
FIG. 3 is a block diagram of a PWM circuit in FIG. 2.

Next, the PWM circuit 108 will be described in detail with a block diagram in FIG. 3. FIG. 3 is a block diagram showing the internal structure of the PWM circuit 108. Although the case of 4 stages of voltage output stages circuit will be described as an example here, the PWM circuit 108 is not limited to this. The PWM circuit 108 comprises a latch 110, a V1 start circuit 111, a V2 start circuit 112, a V3 start circuit 113, a V4 start circuit 114, a V1 end circuit 115, a V2 end circuit 116, a V3 end circuit 117, a V4 end circuit 118, a V1 PWM generation circuit 119, a V2 PWM generation circuit 120, a V3 PWM generation circuit 121, and a V4 PWM generation circuit 122. The latch circuit 110 latches each modulation data outputted from each shift register 107 according to a load signal outputted from the timing generation circuit 104. Here, the load signal outputted from the timing generation circuit 104 is also used as a start timing signal of each PWM signal.

The modulation data latched by the latch circuit 110 is further inputted into the V1 to V4 start circuits 111 to 114, and the V1 to V4 end circuits 115 to 118. Next, a start signal outputted from V1 start circuit 111 and an end signal outputted from the V1 end circuit 115 are inputted into the V1 PWM circuit 119, and a PWM output corresponding to an output voltage V1 is inputted into the output stage circuit 109. Similarly, a start signal outputted from V2 start circuit 112 and an end signal outputted from the V2 end circuit 116 are inputted into the V2 PWM circuit 120, a PWM output corresponding to an output voltage V2 is inputted into the output stage circuit 109, a start signal outputted from the V3 start circuit 113 and an end signal outputted from the V3 end circuit 117 are inputted into the V3 PWM circuit 121, a PWM output corresponding to an output voltage V3 is inputted into the output stage circuit 109, a start signal outputted from the V4 start circuit 114 and an end signal outputted from the V4 end circuit 118 are inputted into the V4 PWM circuit 122, and a PWM output corresponding to an output voltage V4 is inputted into the output stage circuit 109.

Here, in order to create a driving waveform according to the present invention, the start signal outputted from the V2 start circuit 112 is outputted in the timing later than the start signal outputted from the V1 start circuit 111, the start signal outputted from the V3 start circuit 113 is outputted in the timing later than the start signal outputted from the V2 start circuit 112, and the start signal outputted from V4 start circuit 114 is outputted in the timing later than the start signal outputted from the V3 start circuit 113. Furthermore, the end signal outputted from the V3 end circuit 117 is outputted in the timing later than the end signal outputted from the V4 end circuit 118, the end signal outputted from the V2 end circuit 116 is outputted in the timing later than the end signal outputted from the V3 end circuit 117, and the end signal outputted from the V1 end circuit 115 is outputted in the timing later than the end signal outputted from the V2 end circuit 116.

Next, the V1 to V4 start circuits 111 to 114, V4 to V1 end circuits 115 to 118, and V1 to V4 PWM circuits 119 to 122 will be described in detail. By showing a first circuit example in FIG. 4 and a second circuit example in FIG. 5, these will be described.

Figure 4:
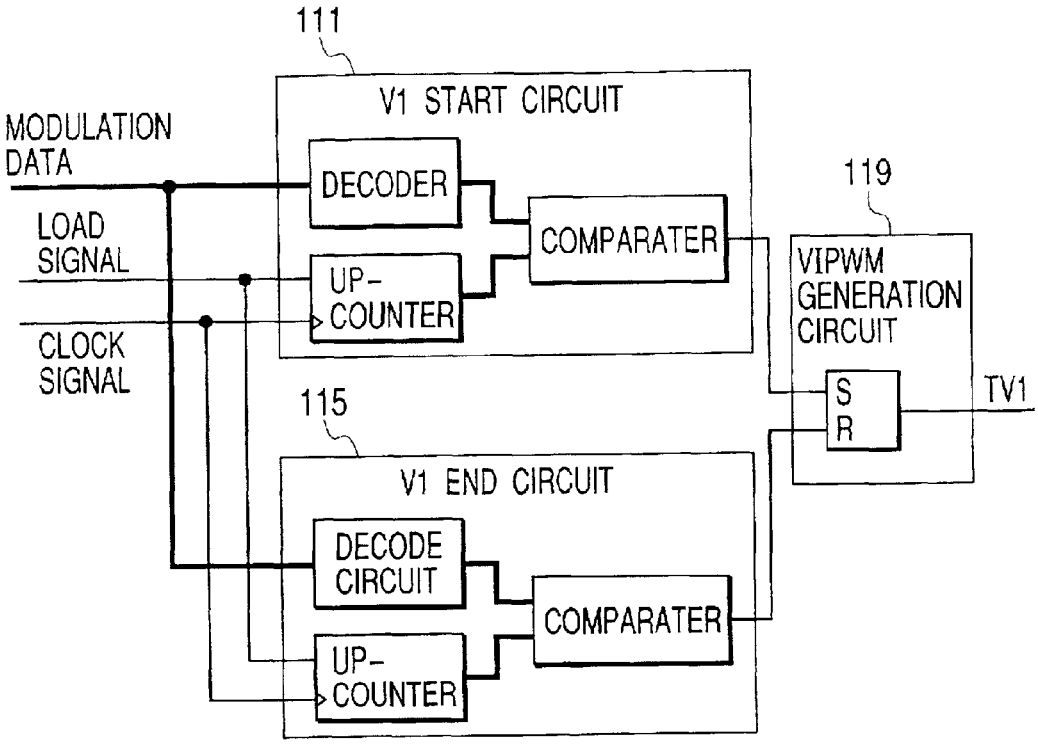
FIG. 4 is a block diagram showing an example of the principal part structure of the PWM circuit of FIG. 3.

FIG. 4 shows circuit configuration for performing arrangement so that leading edges of output waveforms to a plurality of modulation signal wiring of the multi-electron source 101 may be almost aligned. Here, although only the V1 start circuit 111, V1 end circuit 115, and V1 PWM generation circuit 119 are shown, other start circuits, end circuits, and PWM generation circuits have the same configuration as the above-described circuits The V1 start circuit 111 comprises a decode circuit, an up counter, and a comparator, the V1 end circuit 115 comprises a decode circuit, an up counter, and a comparator, and the V1 PWM generation circuit 119 comprises an RS flip-flop.

The data which is decoded with a control signal included in modulation data in the decode circuit in the V1 start circuit 111 is outputted. When an output value of the decode circuit in the V1 start circuit 111 and an output value of the up counter in the V1 start circuit 111 coincide with each other, a V1 start signal is outputted from the comparator in the V1 start circuit 111. Since a signal wave form is determined every gradation value of modulation data, the decode circuit is set so that data corresponding to a gradation value of modulation data can be outputted. Here, since V1 which is the minimum level among levels corresponding to gradation values which are not 0 is used when a gradation value of modulation data is not zero, the decode circuit is constituted so that an output with which a start signal which specifies a start of a V1 output by comparison with an output value of the up counter is generated may be outputted when a gradation value of modulation data is not zero. In a signal wave form corresponding to a gradation value of modulation data, since it is determined every gradation value whether V2, V3, and V4 are required, the decode circuit compared with an output of the up counter also in the V2, V3, and V4 start circuits performs an outputs according to the gradation value of the modulation data. On the other hand, data which is decoded with a control signal included in modulation data in the decode circuit in the V1 end circuit 111 is outputted. Since the timing of ending a V1 output is determined by a gradation value of the modulation data, the decode circuit outputs an output according to the gradation value. The operation of the V2, V3, and V4 start circuits is the same. When an output value of the decode circuit in the V1 end circuit 111 and an output value of the up counter in the V1 end circuit 111 coincide with each other, a V1 end signal is outputted from the comparator in the V1 end circuit By inputting the above start signal and end signal into the V1 PWM generation circuit 119, a PWM waveform TV 1 corresponding to the V1 output is outputted. In FIG. 4, the V1 PWM generation circuit 119 comprises an RS flip-flop. A signal which starts in the input timing of a start signal and falls in the input timing of an end signal by the start signal being inputted into a set terminal S of this RS flip prop, and the end signal being inputted into a reset terminal R is outputted from the RS flip-flop as a PWM waveform TV1 of the V1 PWM generation circuit 119. In addition, although the RS flip-flop is used as the V1 PWM generation circuit 119, a JK flip-flop or another circuit is sufficient here.

Figure 5:
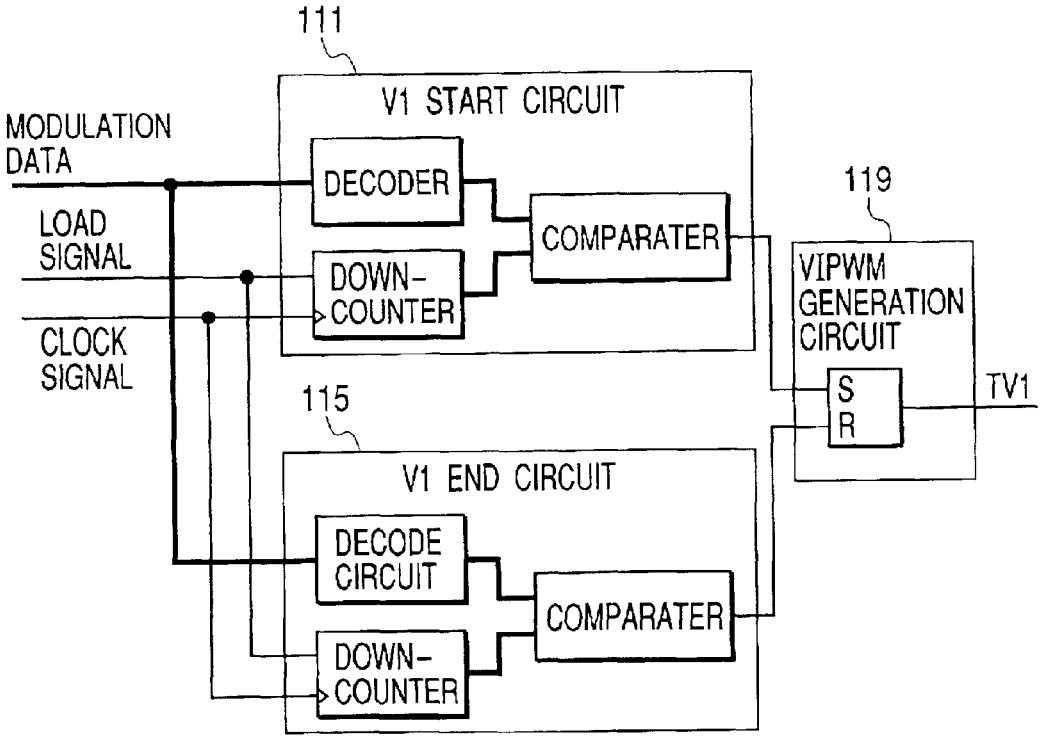
FIG. 5 is a block diagram showing another example of the principal part structure of the PWM circuit of FIG. 3.

Next, as a second circuit example, FIG. 5 shows circuit configuration for performing arrangement so that trailing edges of output waveforms to a plurality of modulation signal wiring of the multi-electron source 101 may be almost aligned. The V1 start circuit 111 comprises a decode circuit, a down counter, and a comparator, the V1 end circuit 115 comprises a constant circuit, a down counter, and a comparator, and the V1 PWM generation circuit 119 comprises an RS flip-flop. Here, although only the V1 start circuit 111, V1 end circuit 115, and V1 PWM generation circuit 119 are shown, other start circuits, end circuits, and PWM generation circuits have the same configuration as the above-described circuits The data which is decoded with a control signal included in modulation data in the decode circuit in the V1 start circuit 111 is outputted. When an output value of the decode circuit in the V1 start circuit 111 and an output value of the down counter in the V1 start circuit 111 coincide with each other, a V1 start signal is outputted from the comparator in the V1 start circuit 111. Data which is decoded with a control signal included in modulation data in the decode circuit in the V1 end circuit 111 is outputted. When an output value of the decode circuit in the V1 end circuit 111 and an output value of the down counter in the V1 end circuit 111 coincide with each other, a V1 end signal is outputted from the comparator in the V1 end circuit 111. By inputting the above start signal and end signal into the V1 PWM generation circuit 119, a PWM waveform TV 1 corresponding to the V1 output is outputted.

Although the circuit shown in either FIG. 4 or FIG. 5 can be used for the above-described PWM circuit 108 and the above-described output stage circuit 109 in response to each column-directional wiring of the multi-electron source 101, as a third example, it is possible to alternately perform leading alignment and trailing alignment by providing the circuit in FIG. 4 and the circuit in FIG. 5 by turns in the column-directional wiring.

Figure 6:
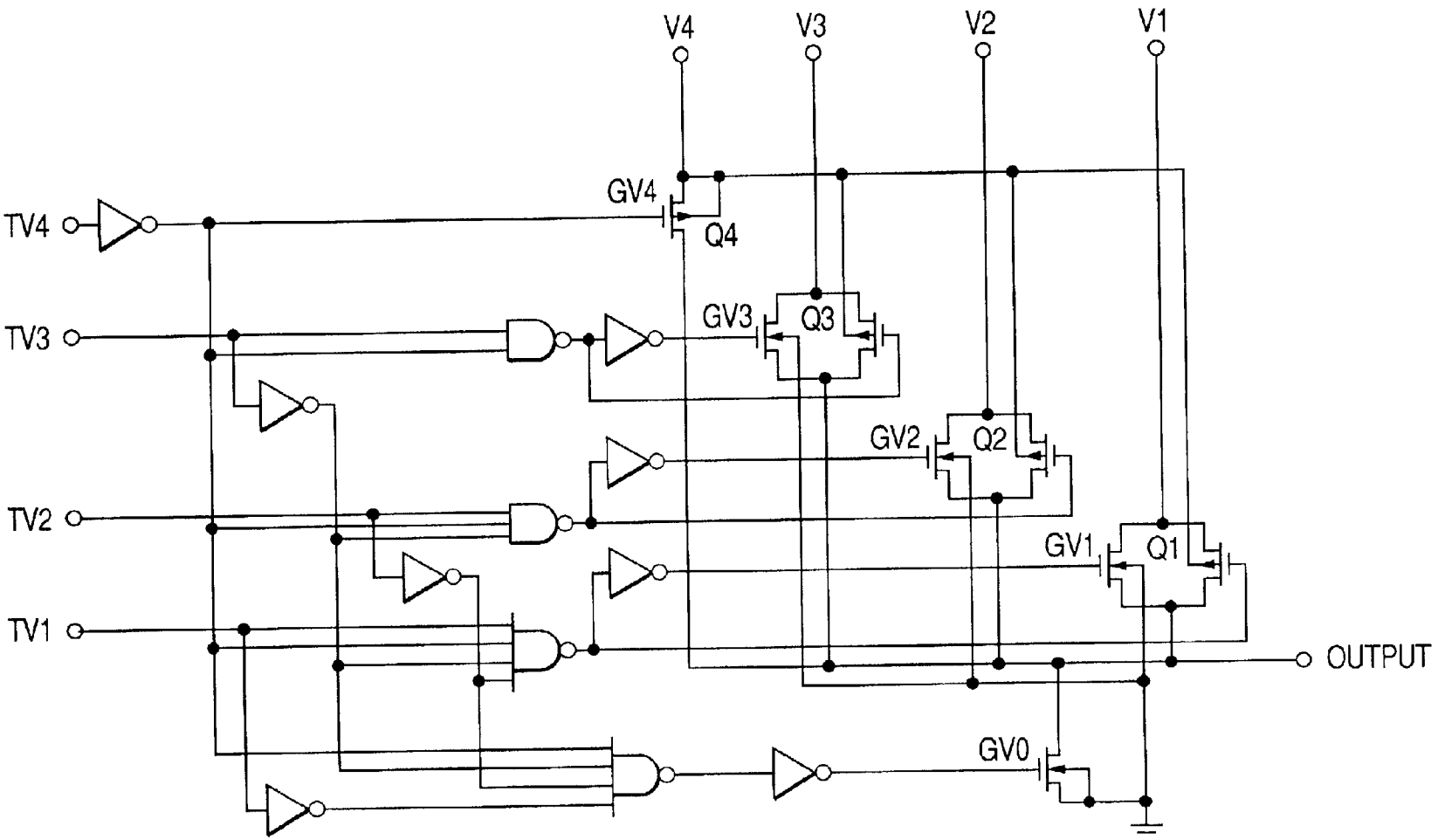
FIG. 6 is a circuit diagram showing an example of an output stage circuit in FIG. 2.
Figure 39:
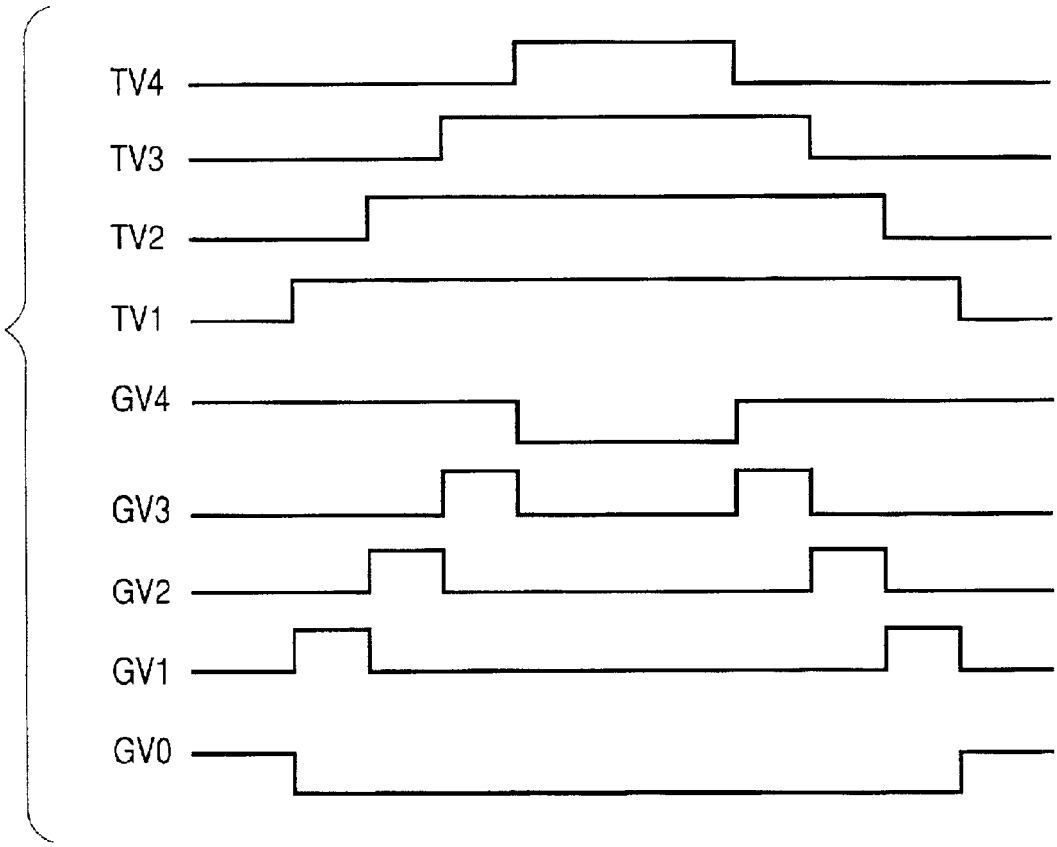
FIG. 39 is a waveform chart of signals TV4 to TVl and GV4 to GV0 in FIG. 6.
Figure 9:
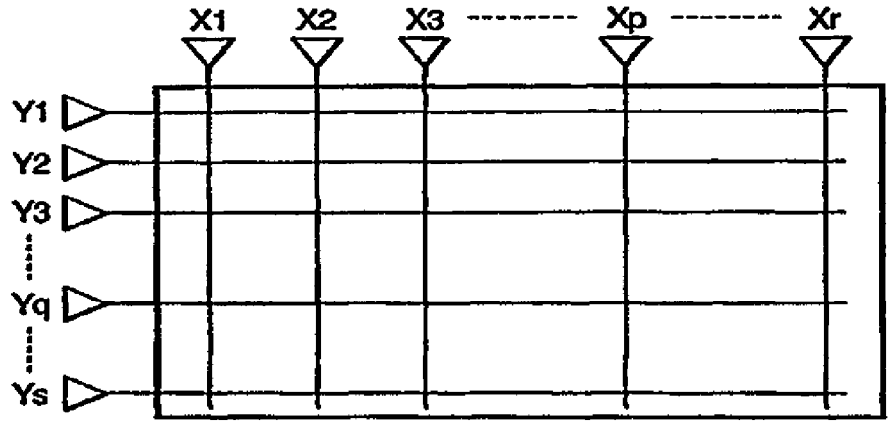
Figure 10:
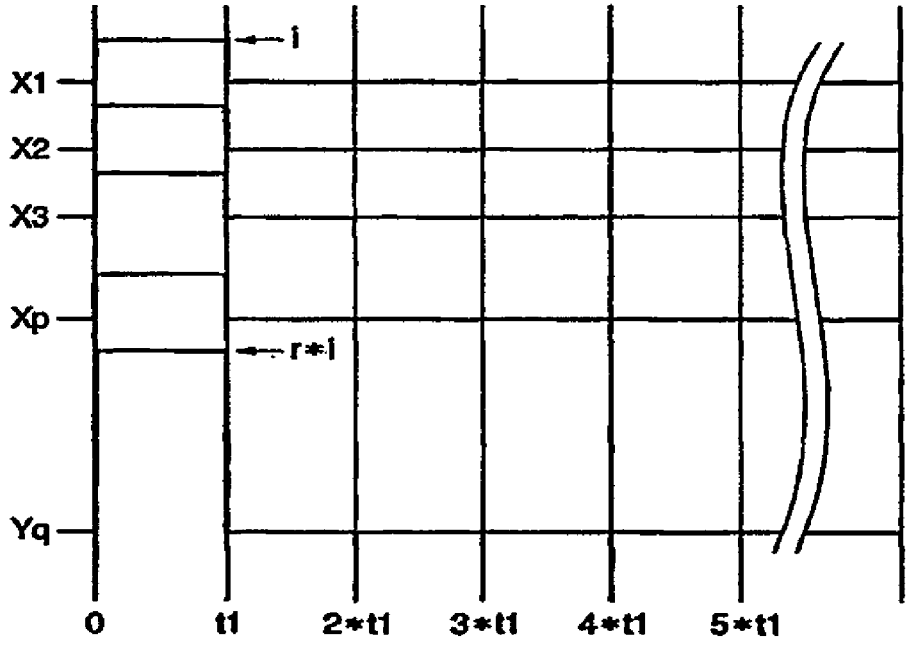
FIG. 10 PRIOR ART
Figure 16:
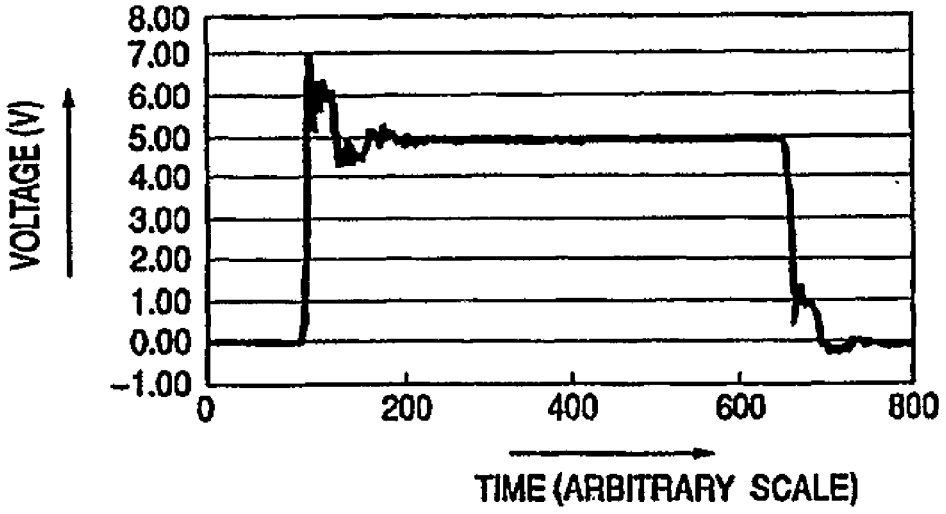
FIG. 16 PRIOR ART
Figure 17:
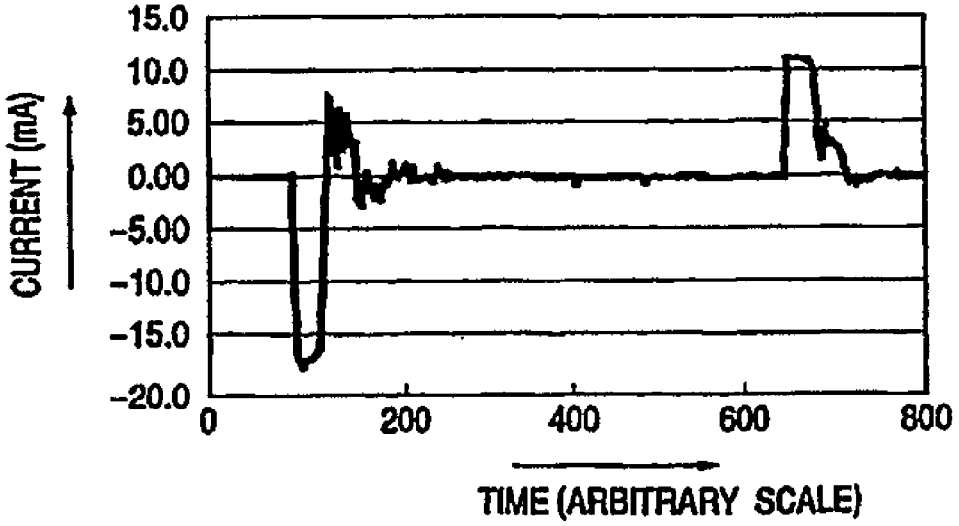
FIG. 17 PRIOR ART
Figure 32:
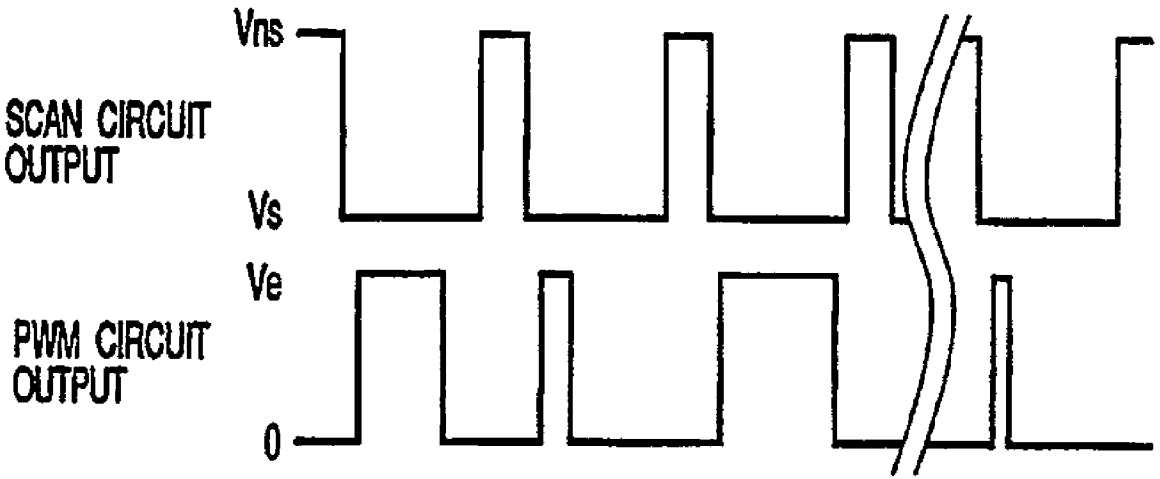
FIG. 32 PRIOR ART
Figure 33:
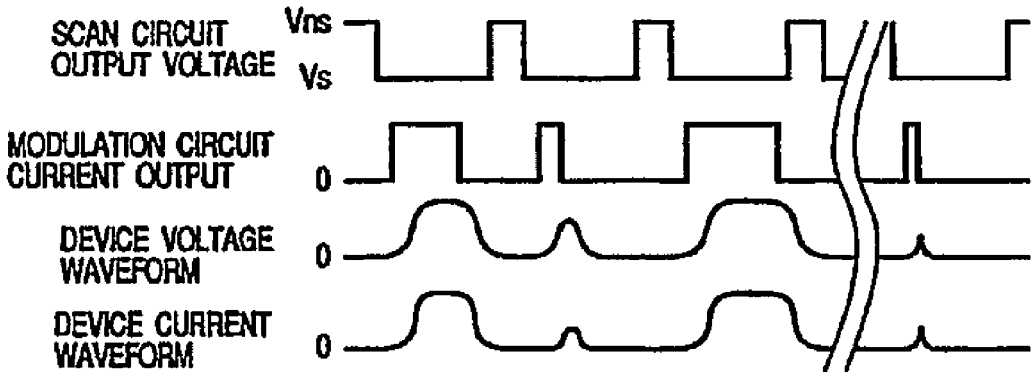
FIG. 33 PRIOR ART
Figure 34:
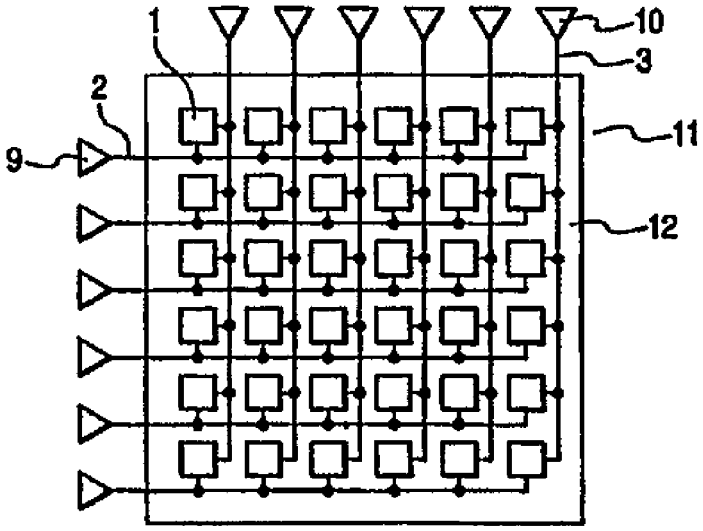

FIG. 6 shows an example of a circuit which is used every column-directional wiring as the output stage circuit 109 shown in FIGS. 2 and 3. In the circuit in FIG. 6, potentials V1 to V4 are $0<V1<V2<V3<V4$, and they are outputted corresponding to PWM output waveforms TV1 to TV4 respectively. Q1 to Q4 are transistors or paired transistors which output potentials V1 to V4 to an output terminal Out respectively by turning on. PWM output waveforms TV1 to TV4 are applied to gates GV1 to GV4 of respective transistors Q1 to Q4 through a logical circuit so that two or more transistors out of Q1 to Q4 should not turn on simultaneously even if two or more among these are in H-level, and so that only the largest potential among potentials V1 to V4 corresponding to PWM output waveforms TV1 to TV4 which are in H-level is outputted to an output terminal Out. FIG. 39 shows an example of waveforms of TV4 to TV1, and GV4 to GVO.

Figure 7:
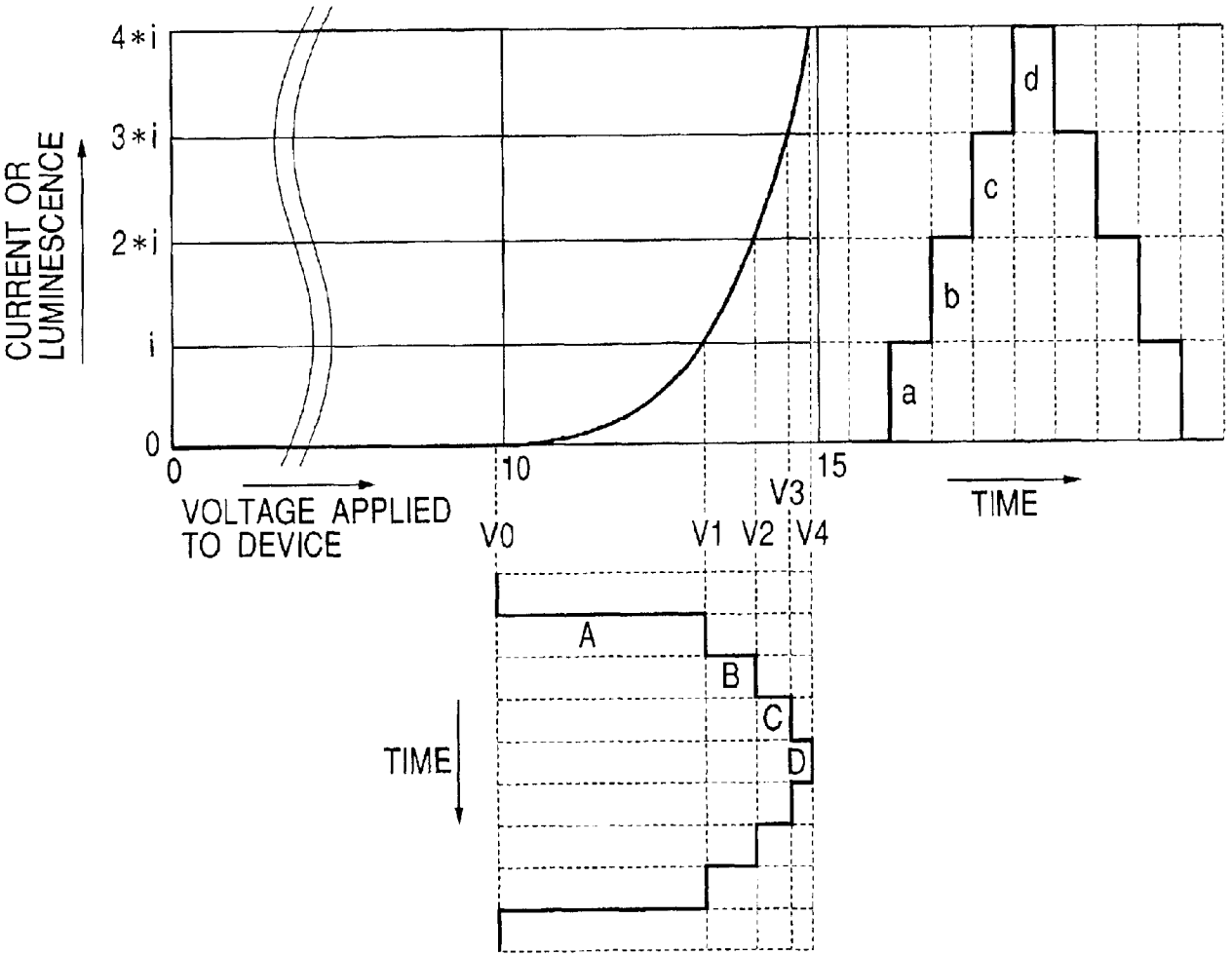
FIG. 7 is a graph showing the voltage/luminescence intensity characteristics of a light-emitting device (current equal dividing)

FIG. 7 shows the voltage/luminescence intensity characteristic of a light-emitting device whose voltage/luminescence intensity characteristic has nonlinear threshold characteristics like an LED or an electron emission device. A horizontal axis denotes the applied voltage, and a vertical axis denotes the luminescence intensity. The luminescence of respective regions a, b, c and d in the time series chart of luminescence becomes equivalent by setting respective drive level potentials V1, V2, V3, and V4 so that the ratio of luminescence intensity may be set at 1:2:3:4. That is, it is possible to equalize the luminescence of unit driving waveform blocks A, B, C and D which consist of unit pulse width Δt shown in the time series chart of a driving waveform, and unit levels, i.e., V4–V3, V3–V2, V2–V1, and V1–V0 by optimally setting respective drive level potentials V1, V2, V3, and V4. Here, potentials V1 to V4 are set so that the luminescence of respective unit driving waveform blocks A to D almost coincides with 1 LSB (one gradation) of luminance brightness data.

In addition, selection potential is given to a device via scan signal wiring as basic potential. Here, the selection potential is −9.9 V. Therefore, regardless of the influence of voltage drop, when a level of a driving signal is V1, V2, V3, or V4, a voltage applied to a device is V1–(−9.9) [V], V2–(−9.9) [V], V3–(−9.9) [V], or V4–(−9.9) [V] respectively. In addition, V0 is chosen so that V0–(−9.9) [V] may become equal to or less than a drive voltage threshold of a device. Here, V0 is made to be ground potential. In addition, this value is made to be the same as the drive threshold of a device here. Thus, the drive voltage threshold of a device is 9.9 [V].

Figure 8:
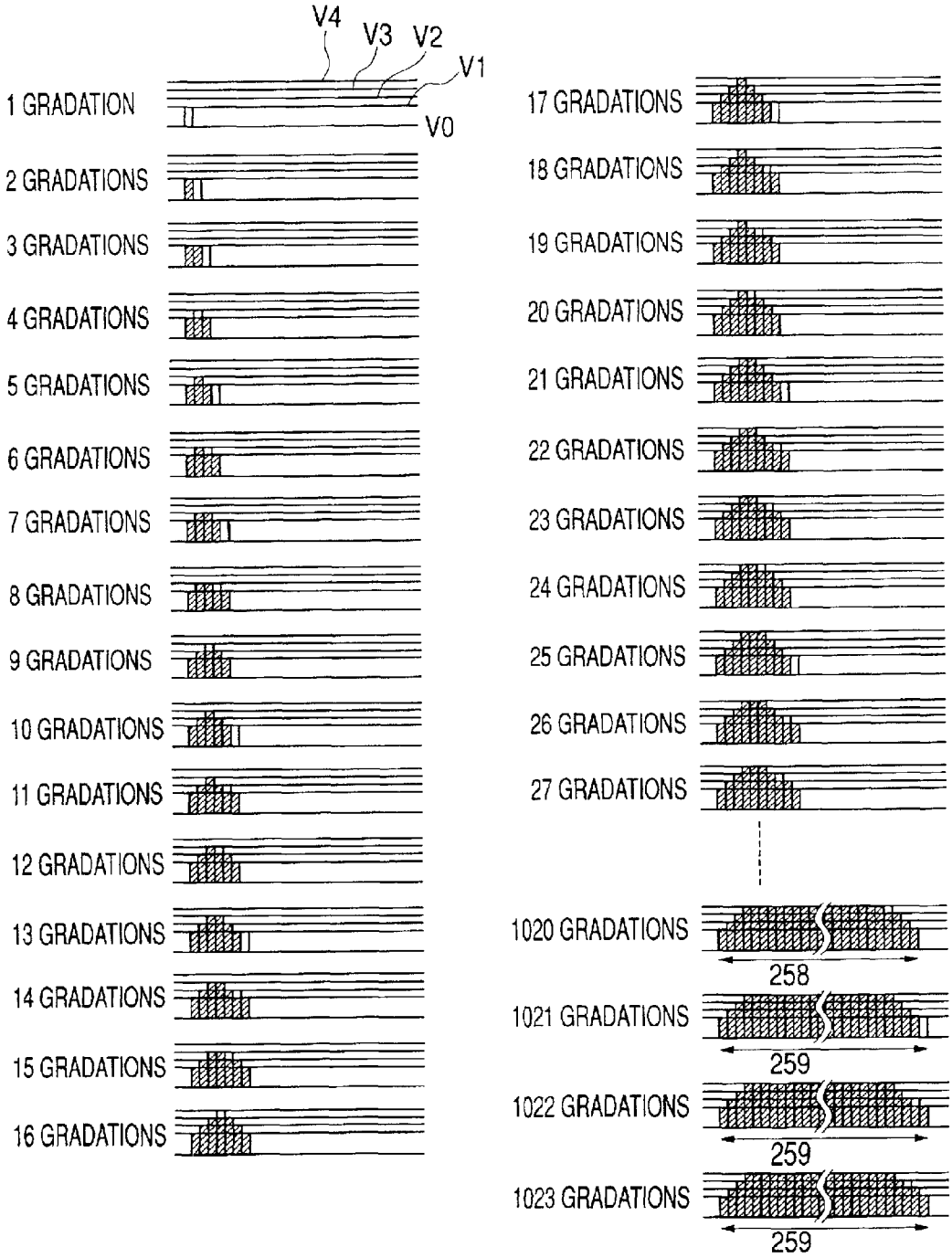
FIG. 8 is a waveform chart showing an example of V14 driving waveforms by the current equal dividing.

FIG. 8 shows a V14 driving waveform as an example of the geometry of a driving waveform for expressing gradations. In FIG. 8, a signal of each gradation consists of the number of unit driving waveform blocks according to the number of gradations. One gradation consists of one unit driving waveform block, two gradations do two unit driving waveform blocks, and N gradations do N unit driving waveform blocks. In the figure, a reverse unit driving waveform block in an N-th gradation denotes differential from a (N−1)-th gradation. A driving waveform in the N-th gradation is formed by adding a unit drive block to the location, where a driving waveform continues, in the driving waveform in the (N−1)-th gradation. When a driving waveform is formed in this manner, it is possible to guarantee monotonicity even if voltage/luminescence intensity characteristics are changed, or even if there is dispersion between light emitting devices.

In this Example, the pulse width control of a unit pulse with slot width Δt is performed in a zero to 259 range by using P=9 bits so as to display image data with the data bit length of R=10, and level (amplitude) control is performed in a range of peak levels of 1 to 4 levels, i.e., a range of levels V1 to V4 by using Q=2 bits including a remaining 1 bit. That is, in order to display 10-bit image data, respective above-described data R, P, and Q have the relation of R<P+Q.

If, for example, 2 bits in high order are used for level control and pulse width is controlled by the remaining 8 bits in the case of R=P+Q, it is not possible to express all the 10-bit picture data when a trailing edge of a driving waveform is made to be step-like. Thus, the number of gradations falls. However, in this Example, since pulse width is controlled in 9 bits so as to become R<P+Q, thereby, all the 10-bit picture data can be expressed.

As shown in FIG. 8, by outputting all the levels of one level (potential V1) to k level (potential Vk) of driving waveforms in turns from a low level to a high level at the time of the startup of the driving waveform in the case that the highest drive level in the N-th gradation is k, and maintaining the output of each level for unit pulse width Δt or more, it becomes possible to reduce a current which flows at the time of the startup of the driving waveform.

Similarly, by outputting all the levels of k level potential (potential Vk) to one level potential (potential V1) of driving waveforms in turns from a high level to a low level at the time of the fall of the driving waveform, and maintaining the output of each level for unit pulse width Δt or more, it becomes possible to reduce a current which flows at the time of the fall of the driving waveform.

Figure 12:
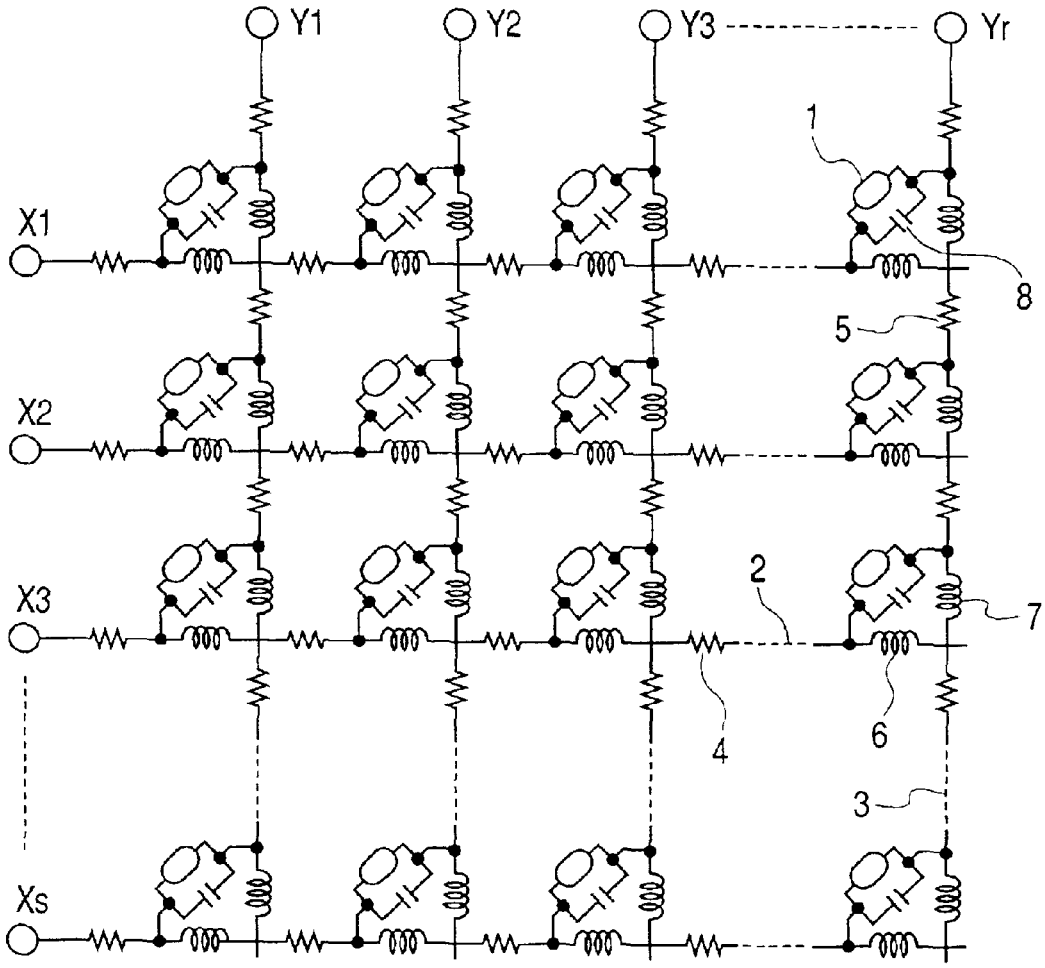
FIG. 12 is an equivalent circuit diagram of the multi-light emitting device in FIG. 1.

FIG. 12 is an equivalent circuit diagram of a multi-light emitting device. In actual driving, although selection potential is applied to the row-directional wiring 2 to be selected and drive potential is applied to the column-directional wiring 3, a model was simplified for intuitive understanding, and simulation was performed by using a single-bit column-directional wiring model shown in FIG. 13. Parasitic resistance was 10 Ω, parasitic inductance was 300 nH, parasitic capacitance was 10 pF, and a modulation circuit was formed by four kinds of power supplies, and MOS transistors.

Figure 13:
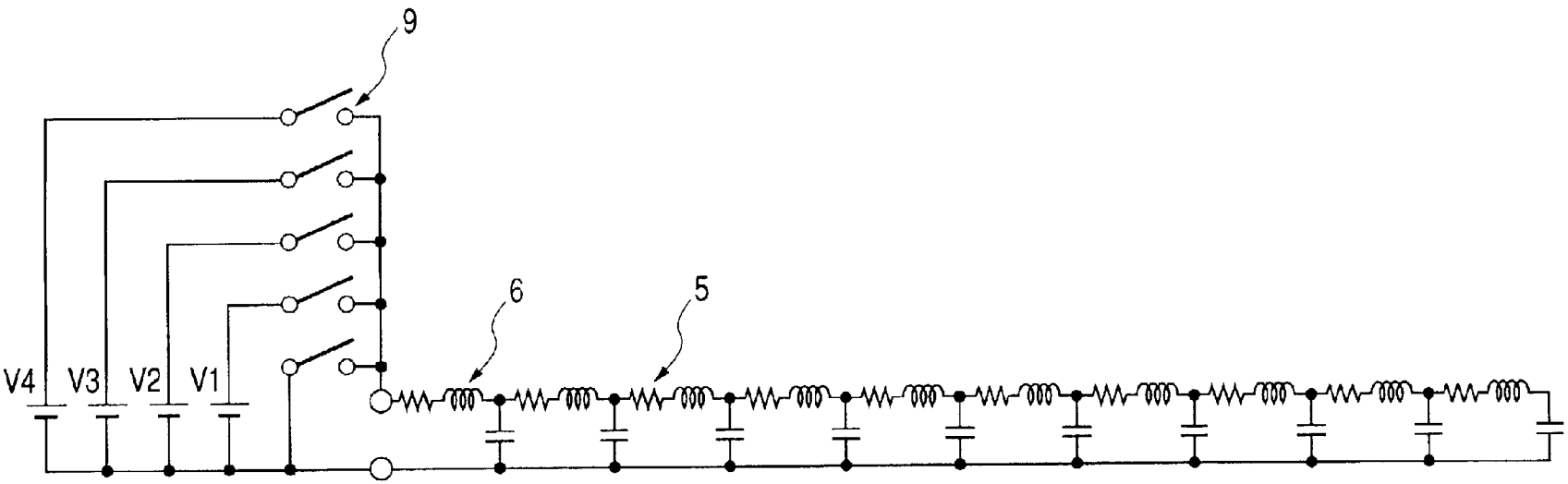
FIG. 13 is a diagram of a single bit column-directional wiring model of the equivalent circuit diagram in FIG. 12.
Figure 14:
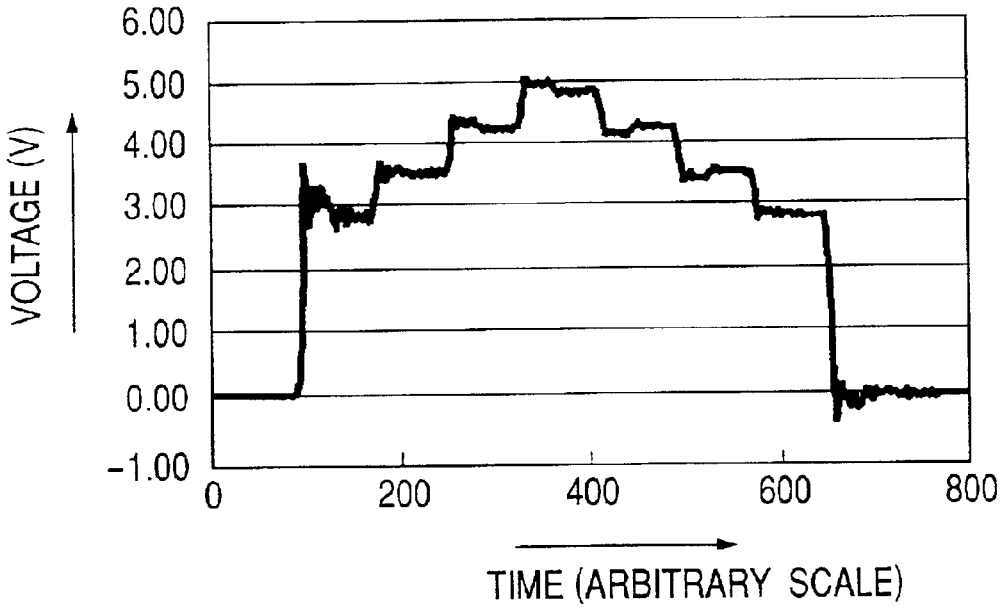
FIG. 14 is a voltage waveform chart at an end of row-directional wiring in the model in FIG. 13.
Figure 15:
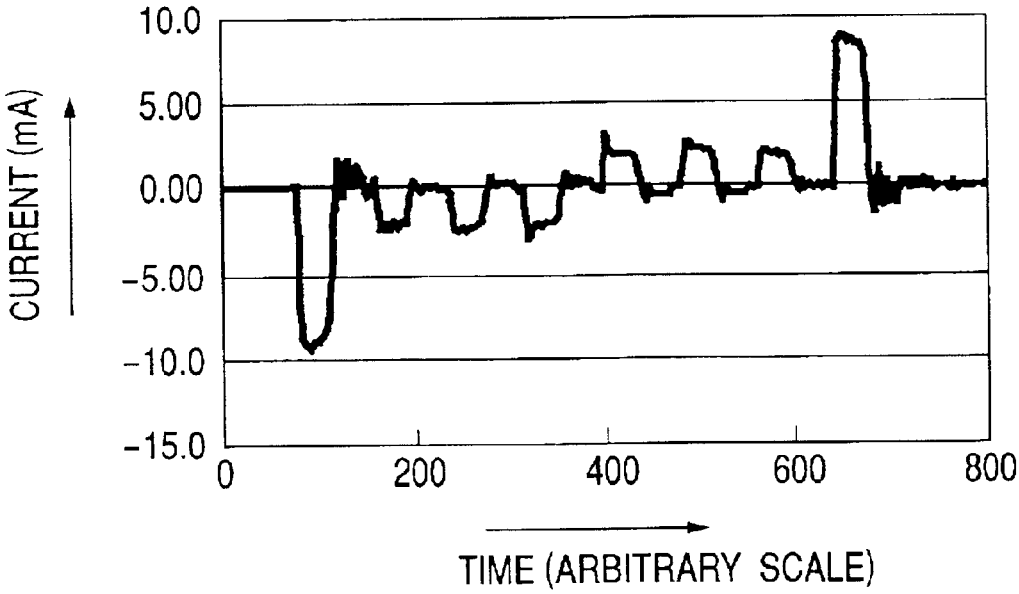
FIG. 15 is a current waveform chart flowing into column-directional wiring in the model in FIG. 13.

In the circuit in FIG. 13, the simulation was performed in the case that a driving waveform with nine gradations in FIG. 8 was generated on conditions that V0=0 V, V1=3 V, V2=3.7 V, V3=4.4 V, and V4=5.0 V. FIG. 14 shows a voltage waveform in an end of the row-directional wiring, and FIG. 15 shows a waveform of a current which flows into the column-directional wiring.

Figure 16:
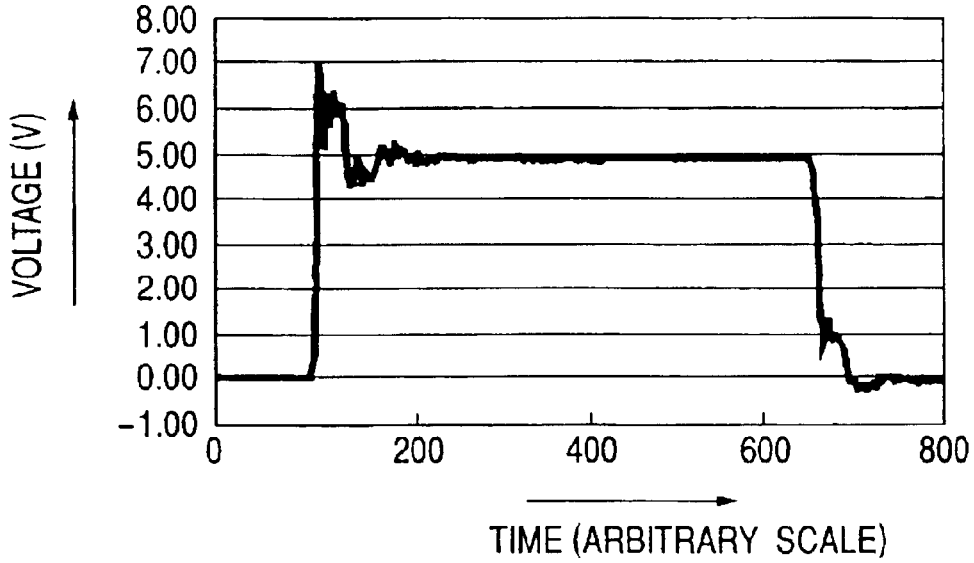
FIG. 16 is a voltage waveform chart at an end of row-directional wiring in the case of driving with a conventional waveform.
Figure 17:
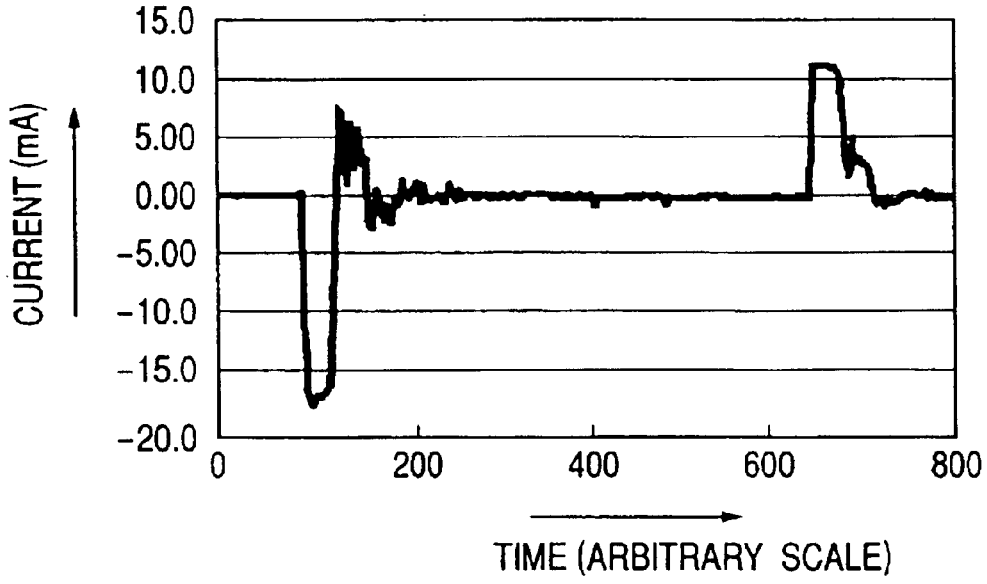
PRIOR ART FIG. 17
FIG. 17 is a current waveform chart flowing into column-directional wiring in the case of driving with a conventional waveform.

For comparison, FIG. 16 shows a voltage waveform in an end of the row-directional wiring in the case that a driving waveform was generated on conditions that V0=0 V and V1=V2=V3=V4=5.0 V, that is, in the case of driving by a conventional waveform, and FIG. 17 shows a waveform of a current which flows into the column-directional wiring.

When driving is performed by the driving waveform of this Example (FIG. 8), it can be seen that the current which flows into the column-directional wiring is fallen in half in comparison with the driving by the conventional waveform. In consequence, although the driving by the conventional waveform generates an overshoot voltage of about 2 V, the driving by the driving waveform of this Example makes an overshoot voltage fall at about 0.8 V.

Thus, according to this Example, it becomes possible to provide a driving waveform and a drive method that make it possible in a low-cost drive circuit to realize fine gradation, to reserve the monotonicity of gradation, to realize the uniform luminescence of a light emitting device, to reduce radiated noise, and to stabilize a driving waveform.

Example 2

Figure 18:
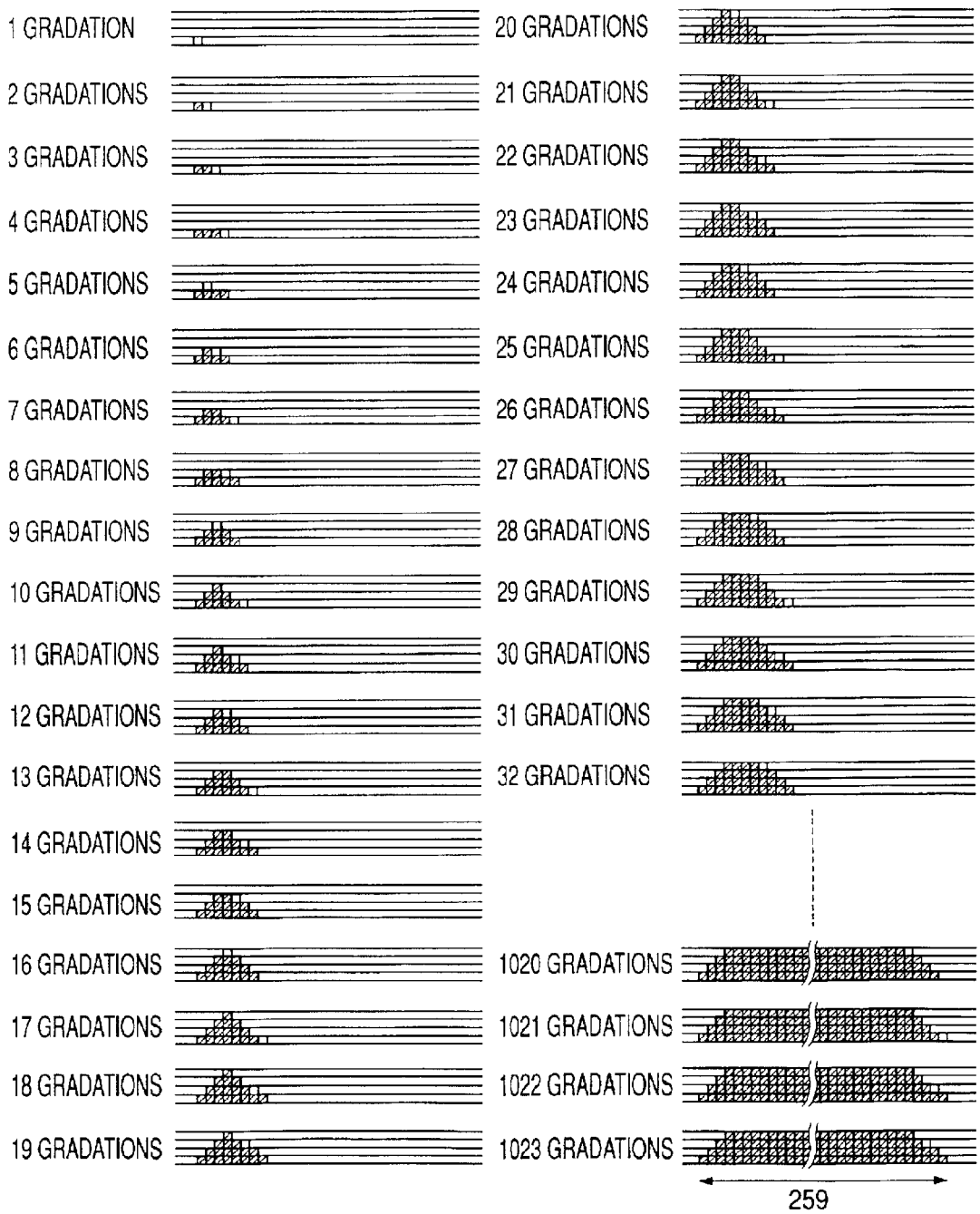
FIG. 18 is a waveform chart showing an example of V14 driving waveforms by voltage equal dividing.
Figure 19:
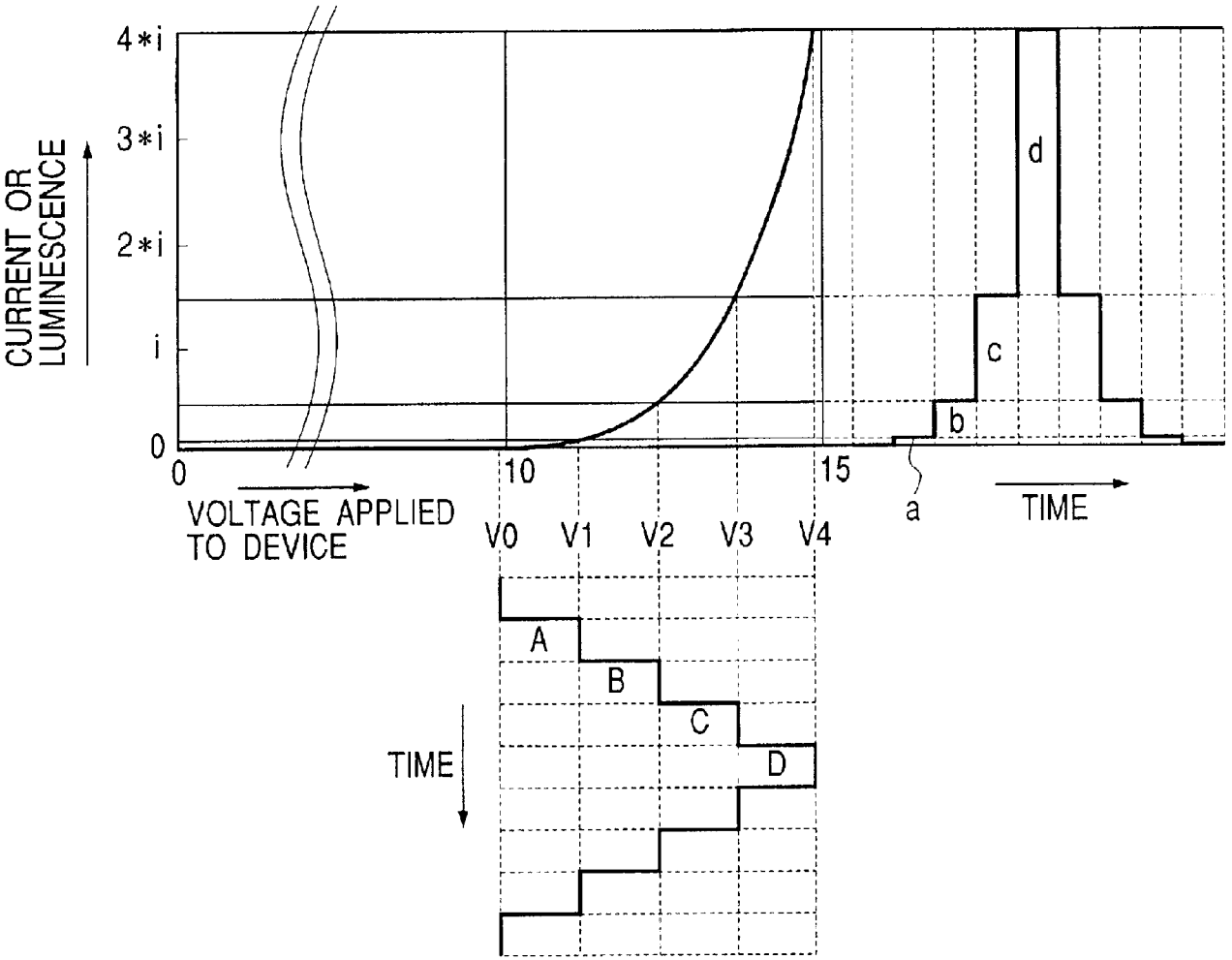
FIG. 19 is a graph showing the voltage/luminescence intensity characteristics of a light emitting device (voltage equal dividing)

FIG. 18 shows another example of V14 waveforms. Driving waveforms in FIG. 7 show an example in the case of setting respective drive level potentials V1, V2, V3, and V4 so that a ratio of luminescence intensity might be set to 1:2:3:4. In an LED or an electron emission device, since luminescence intensity is proportional to a drive current in general, hereafter, this is called a current equal dividing method. On the other hand, FIG. 19 shows the case that it is determined to make a ratio of V1, V2, V3, and V4 be 1:2:3:4, i.e., to make potential differences V4−V3, V3−V2, V2−V1, and V1−V0 (reference potential V0 of a driving waveform was made the same as a drive threshold of a device also here) fixed, and hereafter, this is called a voltage equal dividing method. FIG. 19 shows the voltage/current (luminescence intensity) in the voltage equal dividing method.

In FIG. 18, a reverse unit driving waveform block in an N-th gradation denotes differential from a (N−1)-th gradation. A driving waveform in the N-th gradation is formed by adding a unit drive block to the location, where a driving waveform continues, in the driving waveform in the (N−1)-th gradation. Luminescence a to d of unit drive blocks A to D in FIG. 19 which are used in FIG. 18 have the relation of a<b<c<d. Therefore, although, in the waveform in FIG. 8 where the luminescence of unit drive blocks A to D is fixed, the difference between a third gradation and a fourth gradation is the unit drive block B, in the waveform in FIG. 18, a change between a third gradation and a fourth gradation, which are low gradations, is made small as the unit drive block A.

Figure 20:
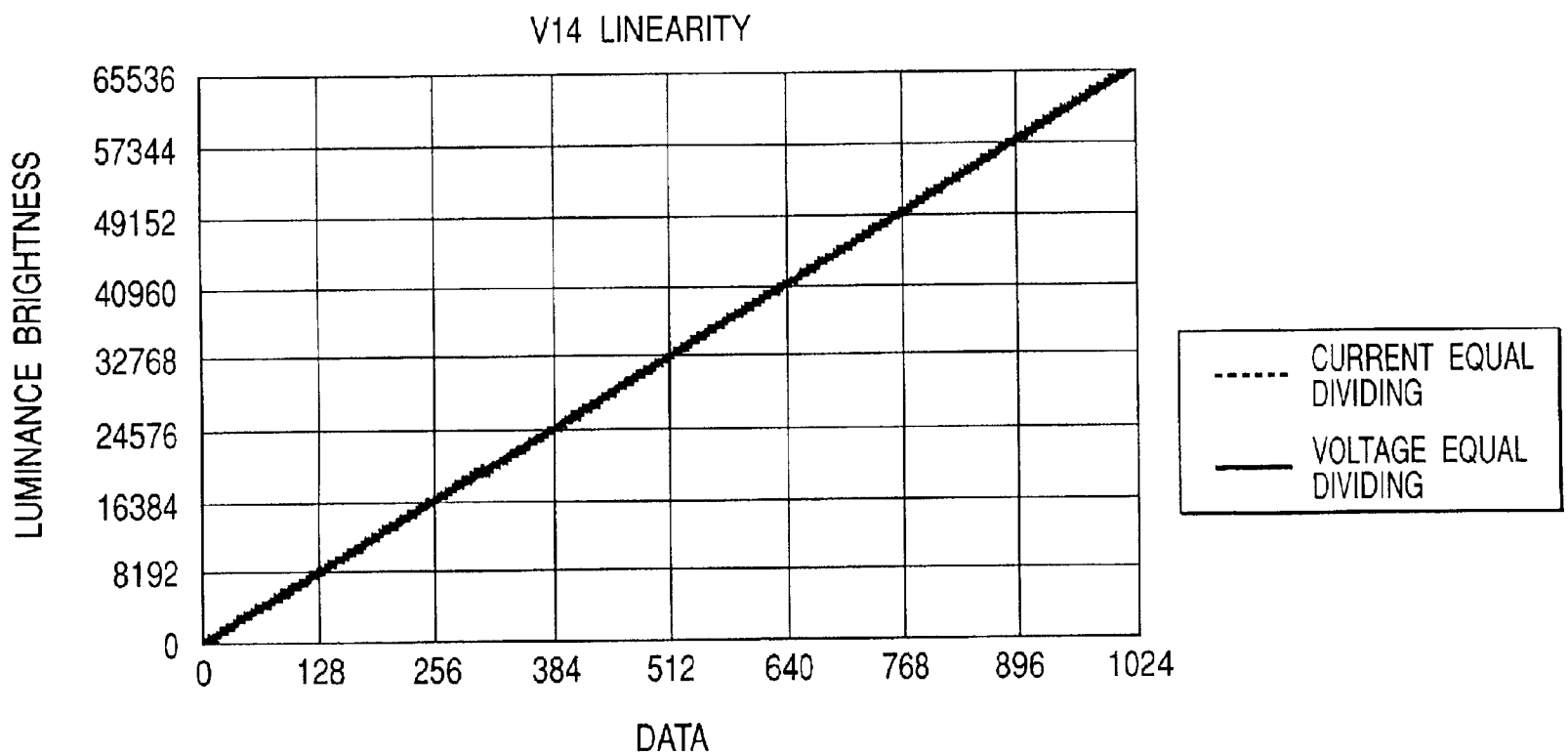
FIG. 20 is a graph showing linearity in V14 driving in FIGS. 8 and 18.

FIG. 20 shows linearity in the V14 driving. When a driving waveform is formed in this manner, it is possible to guarantee monotonicity even if voltage and luminescence intensity characteristics are changed, or even if there is dispersion between light emitting devices.

As shown in FIG. 18, by outputting all the levels of one level (potential V1) to k level (potential Vk) of driving waveforms in turns from a low level to a high level at the time of the startup of the driving waveform in the case that the highest drive level in the N-th gradation is k, and maintaining the output of each level for unit pulse width Δt or more, it becomes possible to reduce a current which flows at the time of the startup of the driving waveform.

Similarly, by outputting all the levels of k level potential (potential Vk) to one level potential (potential V1) of driving waveforms in turns from a high level to a low level at the time of the fall of the driving waveform, and maintaining the output of each level for unit pulse width Δt or more, it becomes possible to reduce a current which flows at the time of the fall of the driving waveform.

Example 3

Figure 21:
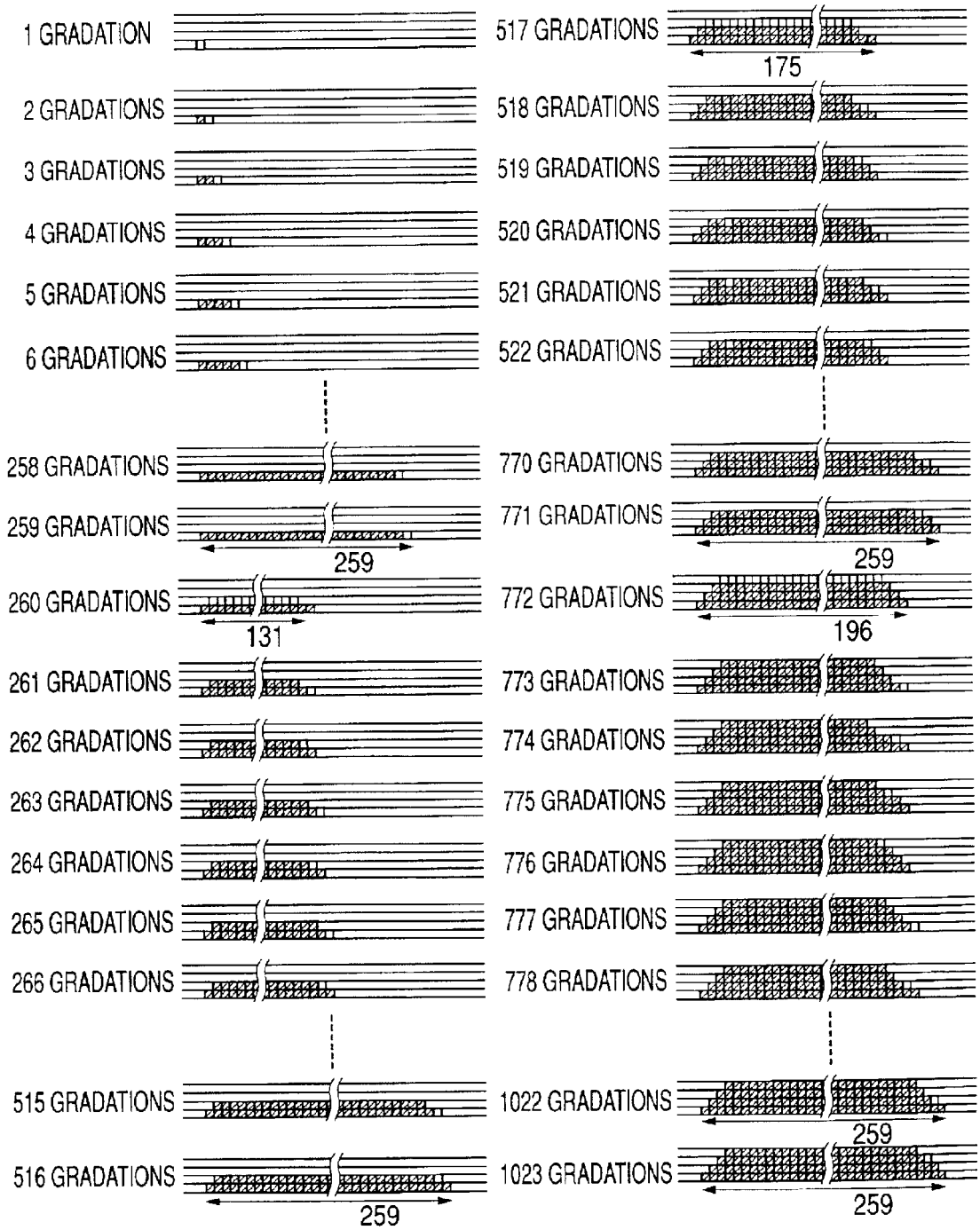
FIG. 21 is a waveform chart showing an example of Vn driving waveforms.

FIG. 21 shows an example of Vn driving waveforms. This waveform is for performing driving with a waveform where a level of a driving waveform of data N is made to be k (k is an integer that is one or more, and less than n) when luminance brightness data consists of R bits and luminance brightness data is approximately $0<N<(2^R)$ (k/n−1). In the driving waveform in FIG. 8, if the number of unit drive blocks (the number of slots) of the level k of the driving waveform in an (n−1)-th gradation becomes 3 by adding a unit drive block to a driving waveform in an (n−2)-th gradation when a level k is three or less, a unit drive block with a level of k+1 is added to a driving waveform in the following n-th gradation. However, in driving waveforms in FIG. 21, a level (level) is not carried until the number of unit drive blocks with a level of 1 (level 1; the minimum level) reaches a predetermined maximum number S (in this Example, 259) when increasing gradation, but when the number reaches the maximum number S and gradation is increased by one step next, carrying is performed by turning back so that the number of unit drive blocks in level 1 may become a number that is (S·k+2k+1)/(k+1) or more and may be the nearest to this, and the number of blocks in the one upper level may become smaller by two or three than that in a lower level.

For example, in the case of S=259, when the number of unit drive blocks in level 1 in a 259th gradation becomes full, i.e., 259, in the following 260th gradation, the number of blocks in level 1 becomes 131 and that in level 2 does 129. Similarly, when the number of unit drive blocks in level 1 is 259 and that in level 2 is 257 in a 516th gradation, and hence, the number of unit drive blocks in level 1 becomes full, the number of blocks in level 1 becomes 175, that in level 2 does 172, and that in level 3 does 170 in the following 517th gradation. In addition, when the number of blocks in level 1 is 259, that in level 2 is 257, that n level 3 is 255, and hence, the number of unit drive blocks in level 1 becomes full in a 771st gradation, the number of blocks in level 1 becomes 196, that in level 2 does 194, that in level 3 does 192, that in level 4 does 190 in the following 772-th gradation, and hence, maximum levels are carried by one respectively.

According to driving waveforms in FIG. 21, in the case of n=4 and k=1, i.e., luminance brightness data being between zero and ¼ of the maximum luminance brightness, a current per one light emitting device becomes ¼ and a current which flows into the selected row-directional wiring also becomes r·i/4 by making an effective portion of amplitude of a pulse width modulation waveform be one fourth of a conventional pulse width modulation waveform, and making pulse width be four times. Hence, it also becomes possible to reduce the amount of a voltage drop to one fourth, and to reduce the reduced amount of a voltage, applied to a light-emitting device, to one fourths. Similarly, when n=4 and k=2, i.e., luminance brightness data is between zero and ½ of the maximum luminance brightness, it becomes possible to reduce the amount of a voltage drop to one half, and when n=4 and k=3, i.e., luminance brightness data is between zero and ¾ of the maximum luminance brightness, it becomes possible to reduce the amount of a voltage drop to three fourths.

Figure 9:
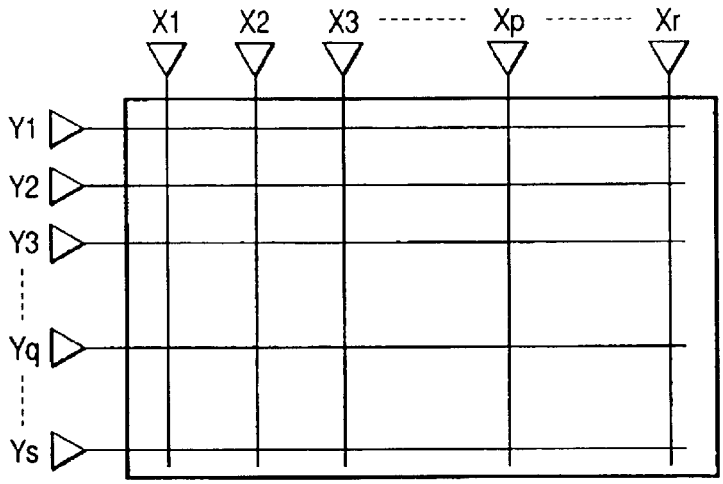
FIG. 9 is a structural diagram of an rXs matrix type image display unit.
Figure 10:
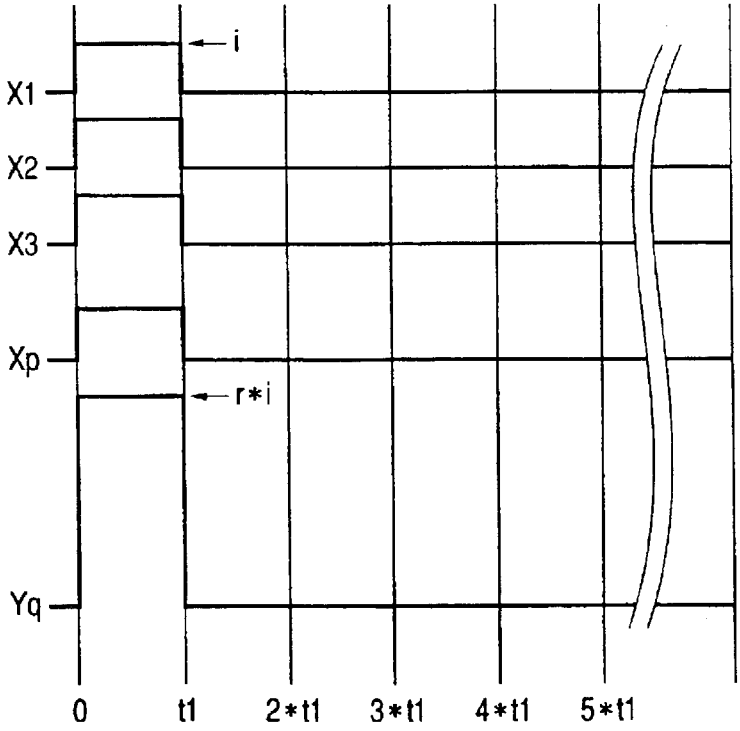
FIG. 10 PRIOR ART
FIG. 10 is a waveform chart of a driving waveform in a pulse width modulation circuit by conventional technology in the case that luminance brightness data is between zero and ¼ of the maximum luminance brightness.

FIG. 9 shows an rXs matrix type image display unit. FIG. 10 is a waveform chart of driving waveforms in a pulse width modulation circuit by conventional technology in the case that n=4 and k=1, i.e., luminance brightness data is between zero and ¼ of the maximum luminance brightness. Let a current per one light-emitting device be i. It can be seen that a voltage drop arises by a current which flows into the selected row-directional wiring Yq and is r·i, and a voltage applied to a light emitting device decreases.

Figure 11:
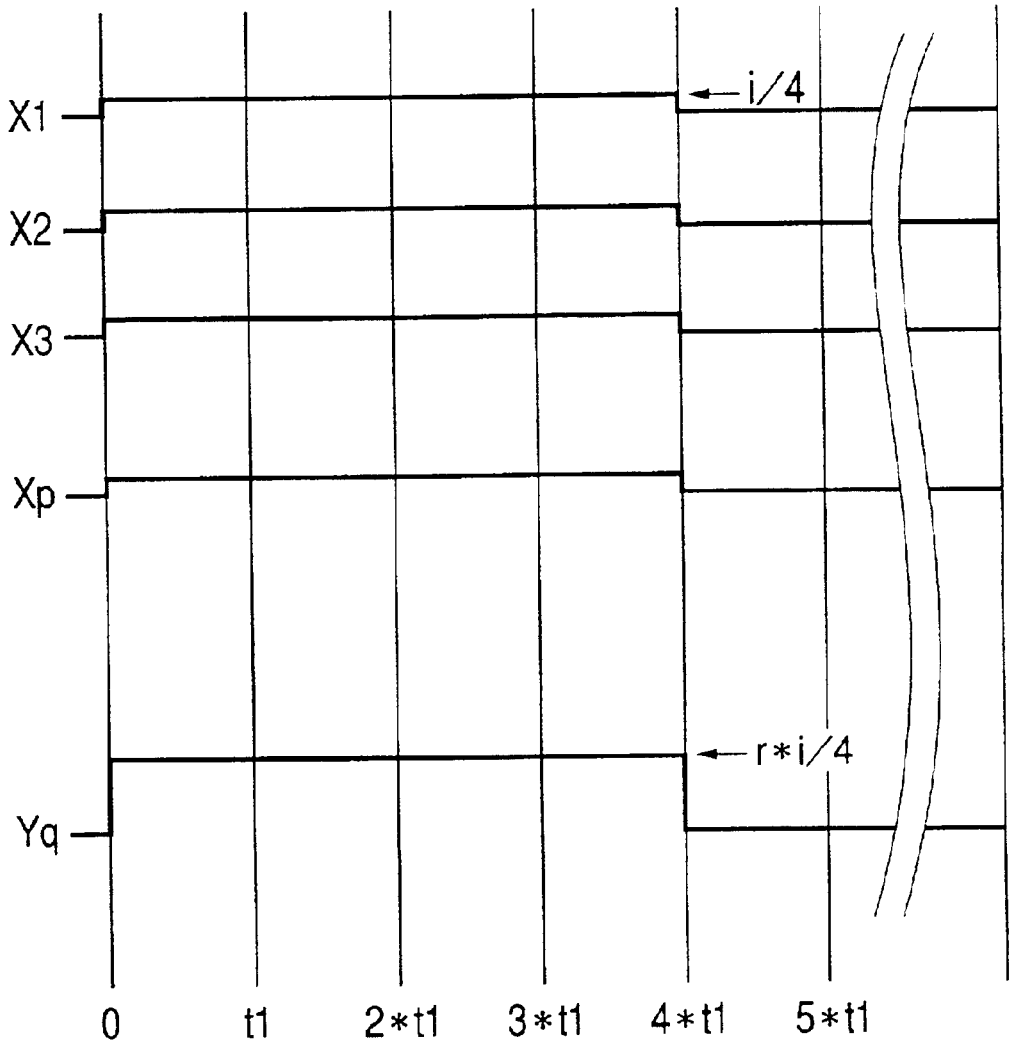
FIG. 11 is a waveform chart of driving waveforms in a pulse width modulation circuit by a first embodiment in the case that luminance brightness data is between zero and ¼ of the maximum luminance brightness.

FIG. 11 is a waveform chart of driving waveforms in a pulse width modulation circuit according to this Example in the case that n=4 and k=1, i.e., luminance brightness data is between zero and ¼ of the maximum luminance brightness. FIG. 11 shows a situation of performing driving by making an effective portion of amplitude of a pulse width modulation waveform (a portion obtained by subtracting a portion, included in a drive voltage threshold of a device from amplitude; in this Example, since V0 which becomes the reference potential of a modulation waveform is made to be the same value as a drive threshold of a device, a portion obtained by subtracting a portion, included in a drive voltage threshold of a device, from amplitude =amplitude of a modulation waveform) be one fourths, and by making pulse width be 4 times. A current per one light-emitting device becomes i/4, and a current flowing into the selected row-directional wiring also becomes r·i/4. Hence, it also becomes possible to reduce the amount of a voltage drop to one fourth, and to reduce the reduced amount of a voltage, applied to a light-emitting device, to one fourths.

Similarly, when n=4 and k=2, i.e., luminance brightness data is between zero and ½ of the maximum luminance brightness, it becomes possible to reduce the amount of a voltage drop to one half, and when n=4 and k=3, i.e., luminance brightness data is between zero and ¾ of the maximum luminance brightness, it becomes possible to reduce the amount of a voltage drop to three fourths.

Figure 22:
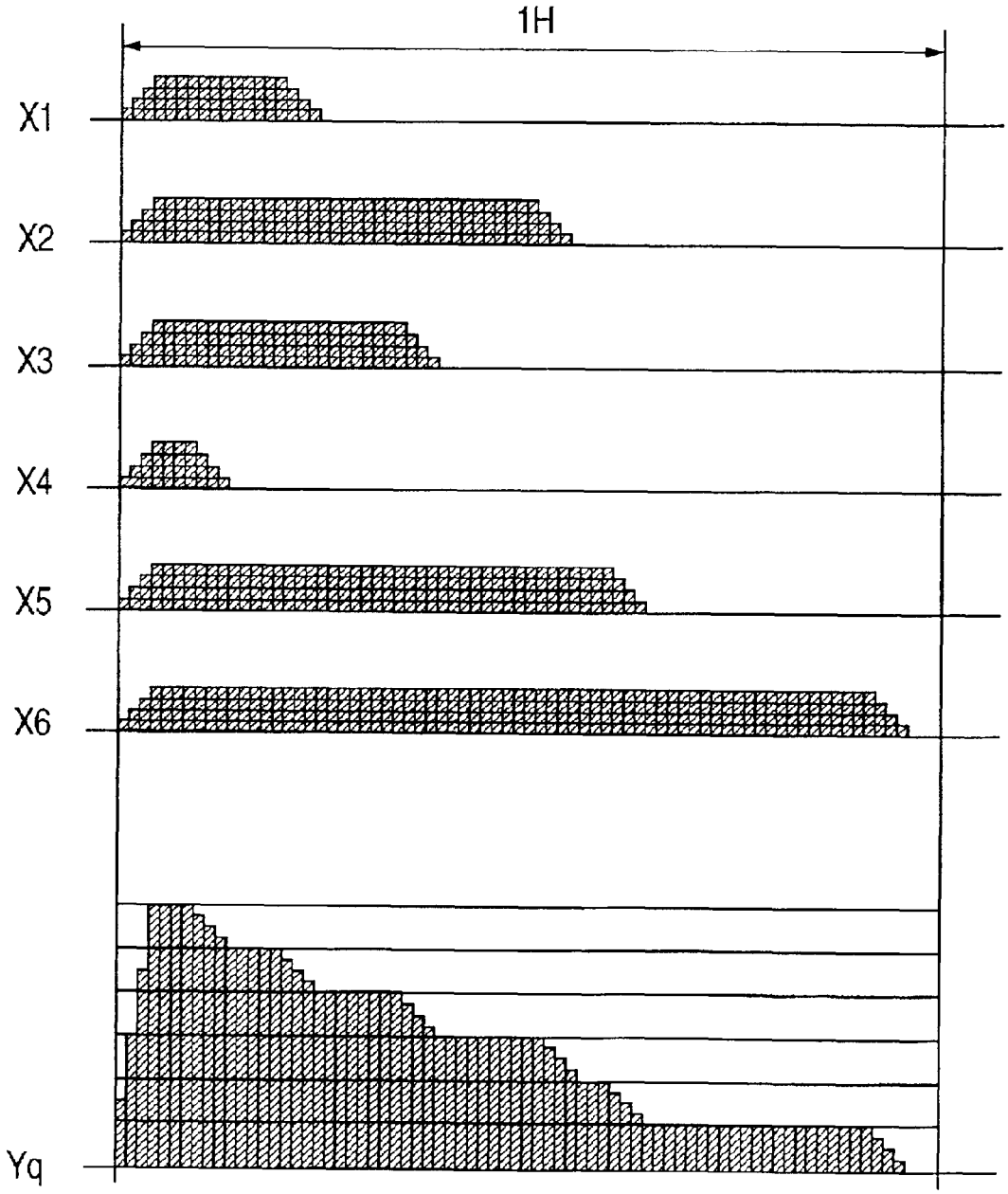
FIG. 22 is a waveform chart showing modulation waveforms and a current, which flows in arbitrary scan wiring Yq, in V14 driving (front alignment)
Figure 23:
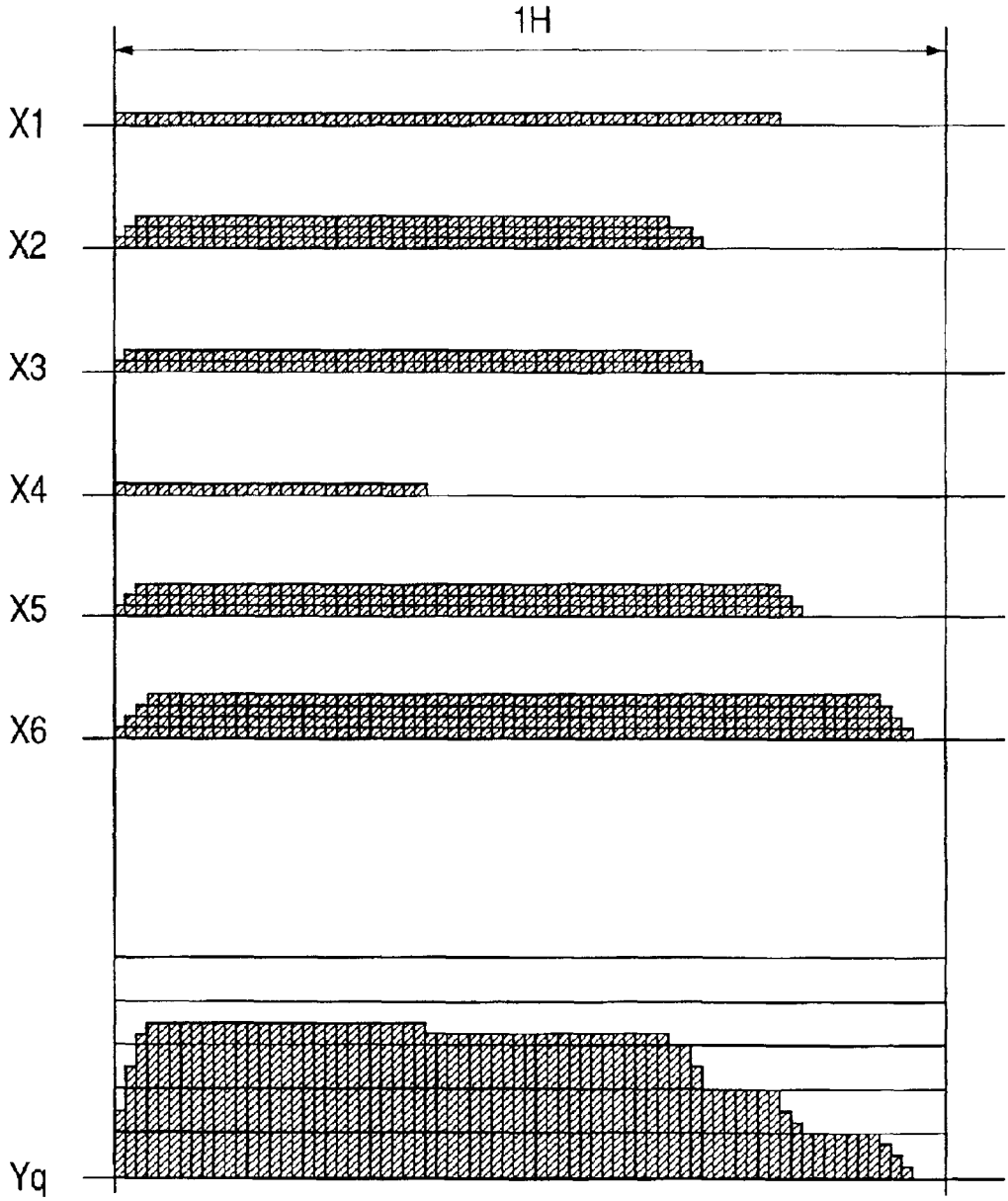
FIG. 23 is a waveform chart showing modulation waveforms and a current, which flows in arbitrary scan wiring Yq, in Vn driving (front alignment)

FIG. 22 shows an example of modulation waveforms and a current, which flows in arbitrary scan wiring Yq, in V14 driving (front alignment) according to a first or a second Example. FIG. 23 shows an example of modulation waveforms and a current, which flows in arbitrary scan wiring Yq, in Vn driving (front alignment) according to this Example. It can be seen that a peak of a current flowing into scan wiring in the Vn driving according to this Example is sharply reduced by equalizing the current.

Figure 24:
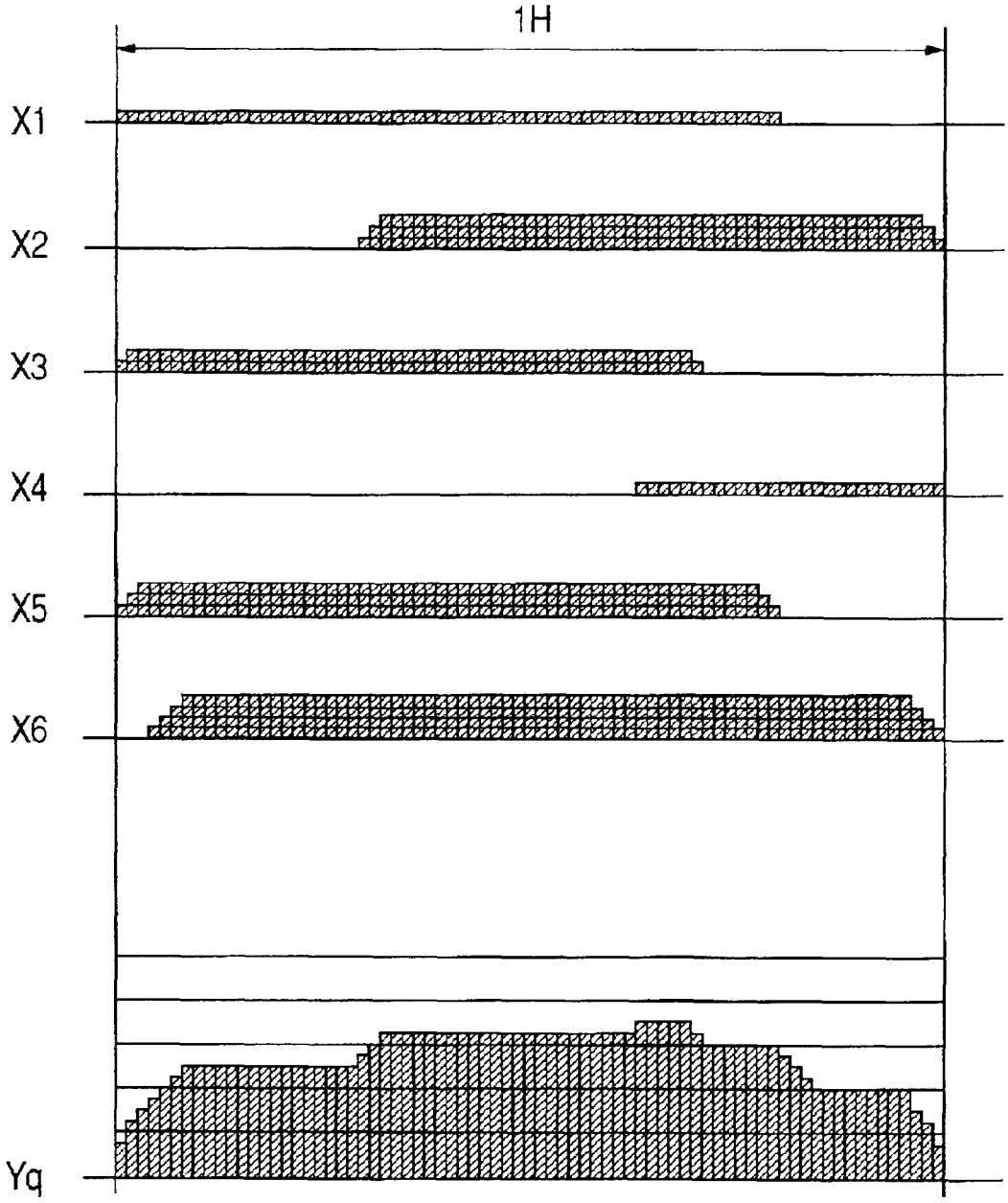
FIG. 24 is a waveform chart showing modulation waveforms and a current, which flows in arbitrary scan wiring Yq, in the case of using front and back alignment in Vn driving.

FIG. 24 shows a current, which flows in arbitrary scan wiring (row-directional wiring) Yq, in the case of using front and back alignment in Vn driving. Furthermore, the current is equalized. Here, front alignment means to perform control so that a leading edge of a driving waveform becomes a first half in one selection period, and it is preferable to generate a first unit drive block in a predetermined slot in the first half of pulse width control. In addition, back alignment means to perform control so that a trailing edge of a driving waveform becomes a second half in one selection period, and it is preferable to generate a last unit drive block in a predetermined slot in the second half of pulse width control. In addition, when these predetermined slots are fixed, it is preferable to set a first slot in one selection period as a predetermined slot in the first half, and to set a last slot as a predetermined slot in the second half, but it is also good to set inner slots. Moreover, it is also good to set respective predetermined slots in the first half or second half according to the gradation or modulation waveform of a light emitting device to be driven through the column-directional wiring or other column-directional wiring every column-directional wiring. Alternatively, it is also good to set the same slot to all the column-directional wiring that drives them as respective predetermined slots in the first half or the second half according to the gradation or modulation waveform of a plurality of light emitting devices selected simultaneously.

Example 4

Figure 25:
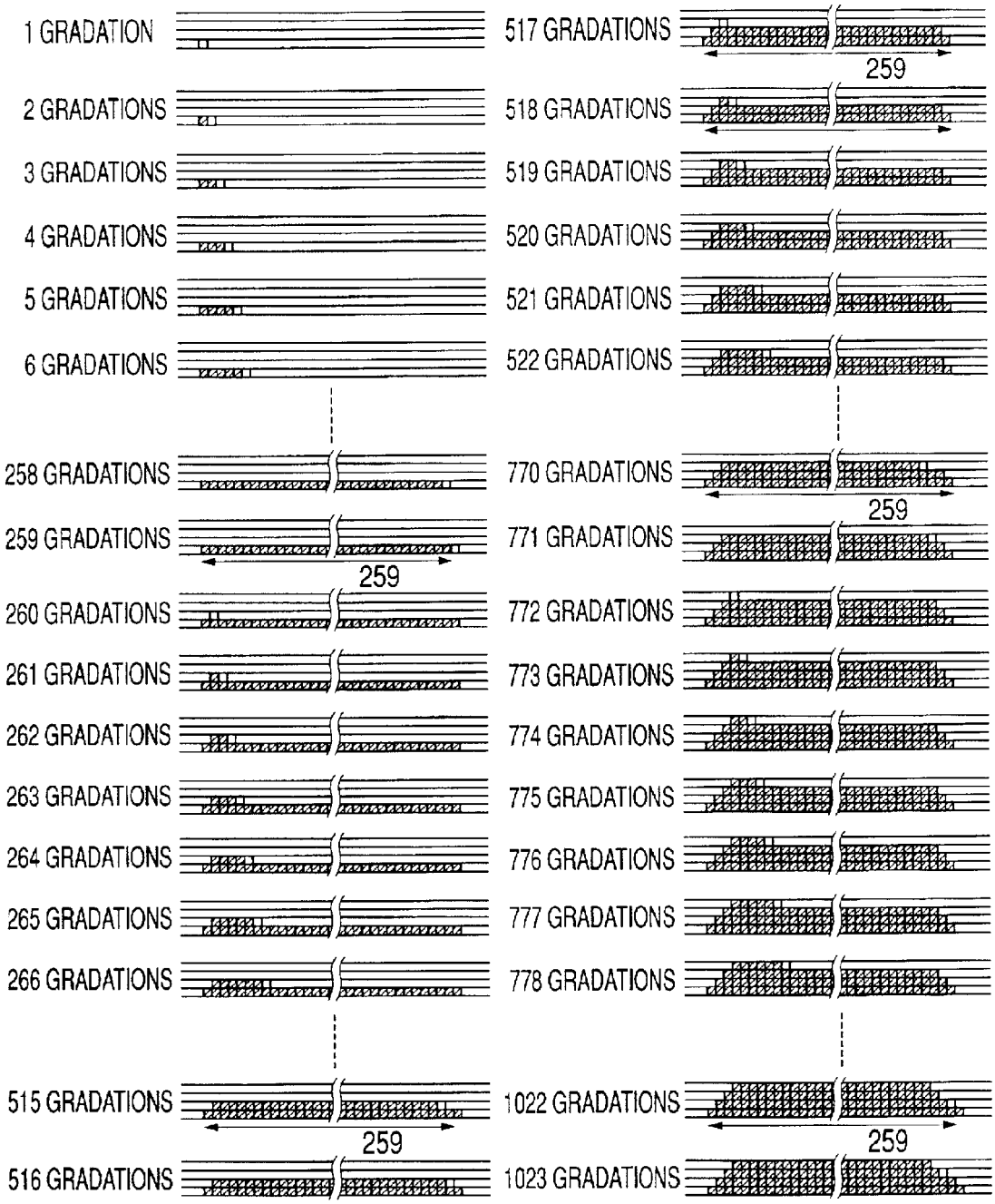
FIG. 25 is a waveform chart showing an example of new Vn driving waveforms.

FIG. 25 shows driving waveforms in new Vn driving. In the case that gradation is increased, these driving waveforms are arranged in good order such that unit drive blocks with a level of 1 (level 1) are first arranged until they reach the predetermined maximum number S (in this Example, 259), next, unit drive blocks in level 2 (potential V2) are arranged until they reach a (S−1)-th slot from a second slot, −−, and unit drive blocks in level k (potential Vk) are arranged until they reach a (S+1−k)-th slot from a k-th slot.

Figure 26:
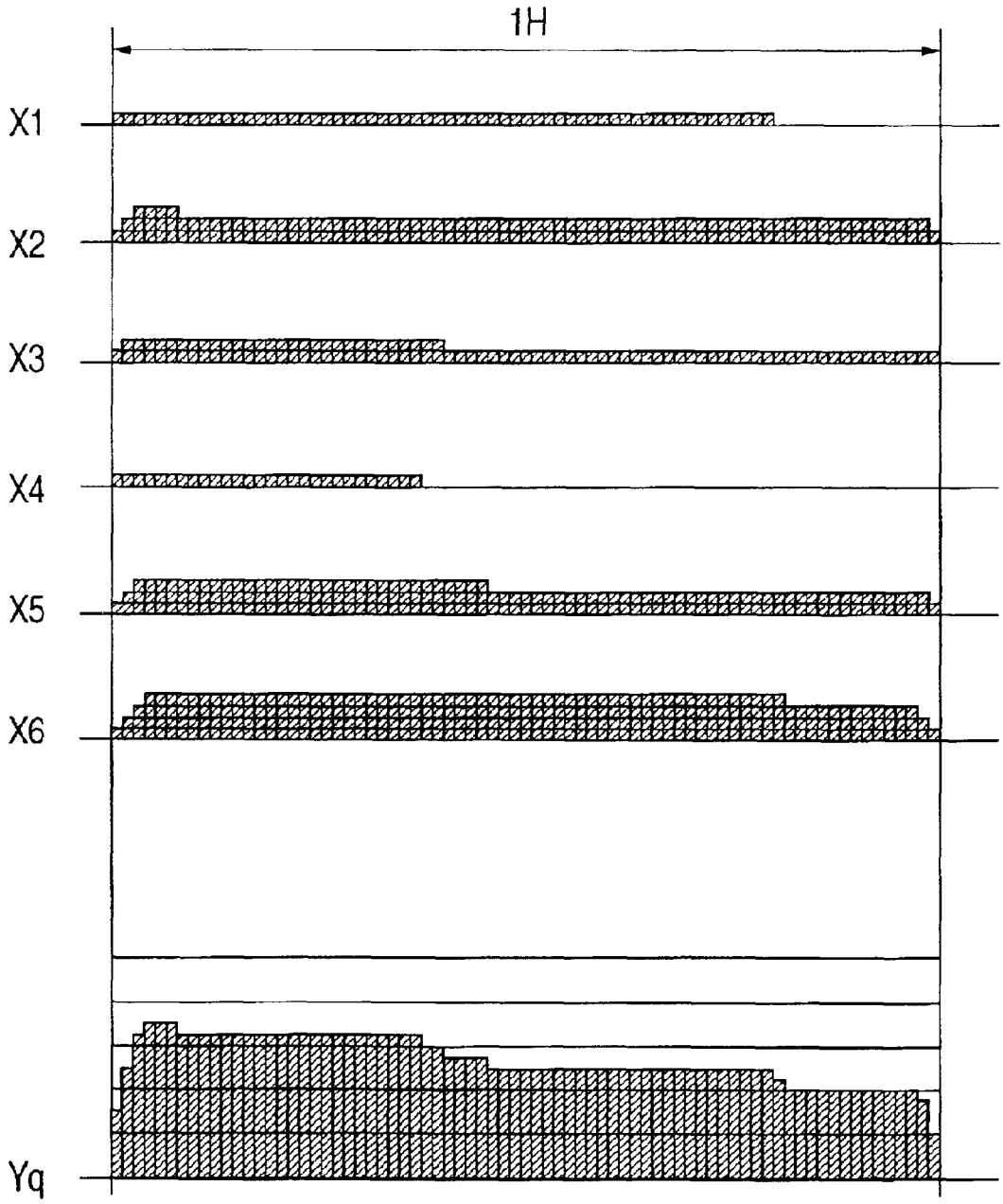
FIG. 26 is a waveform chart showing an example of modulation waveforms and a current, which flows in arbitrary scan wiring Yq, in new Vn driving (front alignment)
Figure 27:
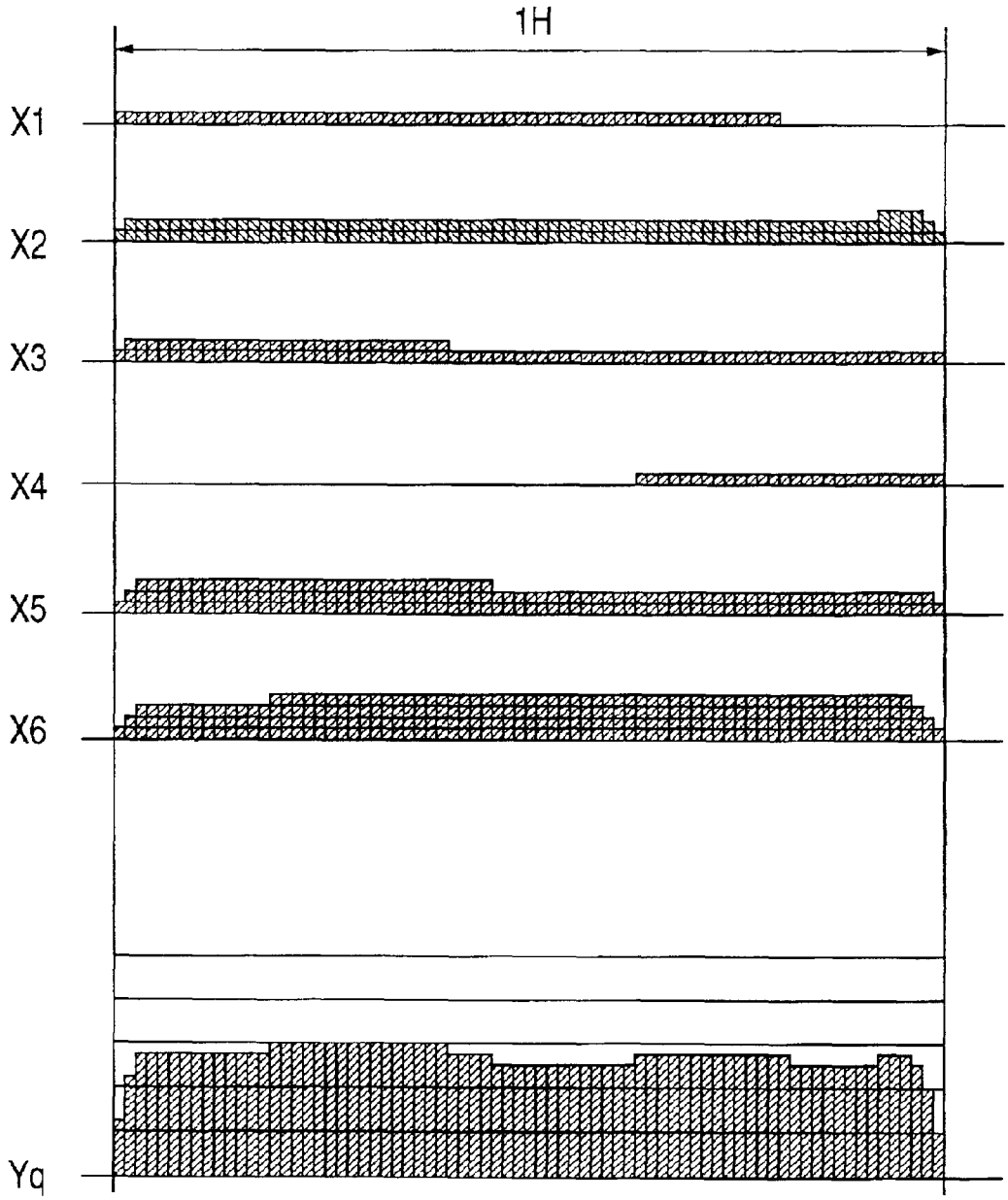
FIG. 27 is a waveform chart showing modulation waveforms and a current, which flows in arbitrary scan wiring Yq, in the case of using front and back alignment in new Vn driving.
Figure 28:
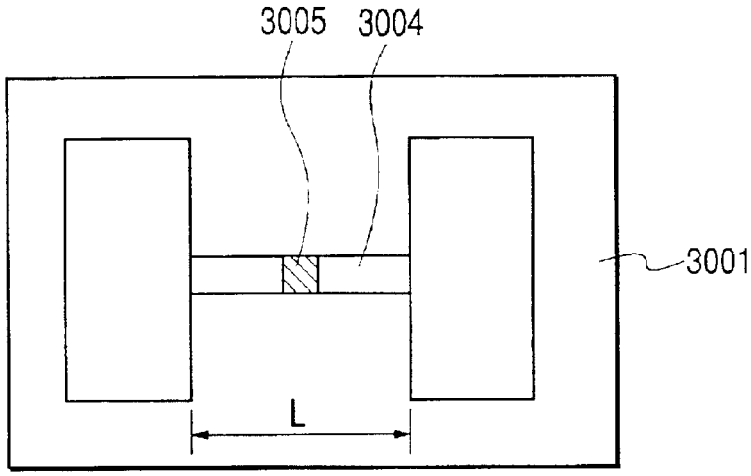
FIG. 28 is a schematic diagram showing an example of the device structure of a surface conductive emission device.
Figure 29:
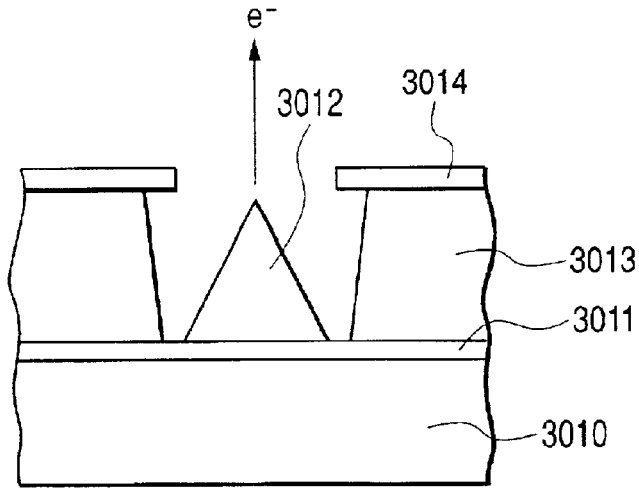
FIG. 29 is a sectional view showing an example of the device structure of an FE type device.
Figure 30:
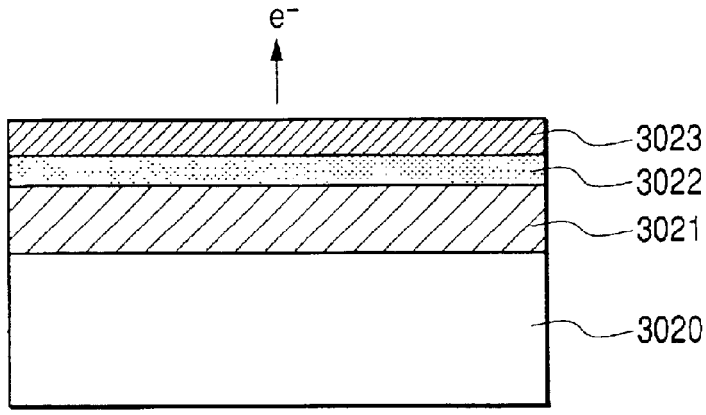
FIG. 30 is a sectional view showing an example of the device structure of an MIM type device.
Figure 31:
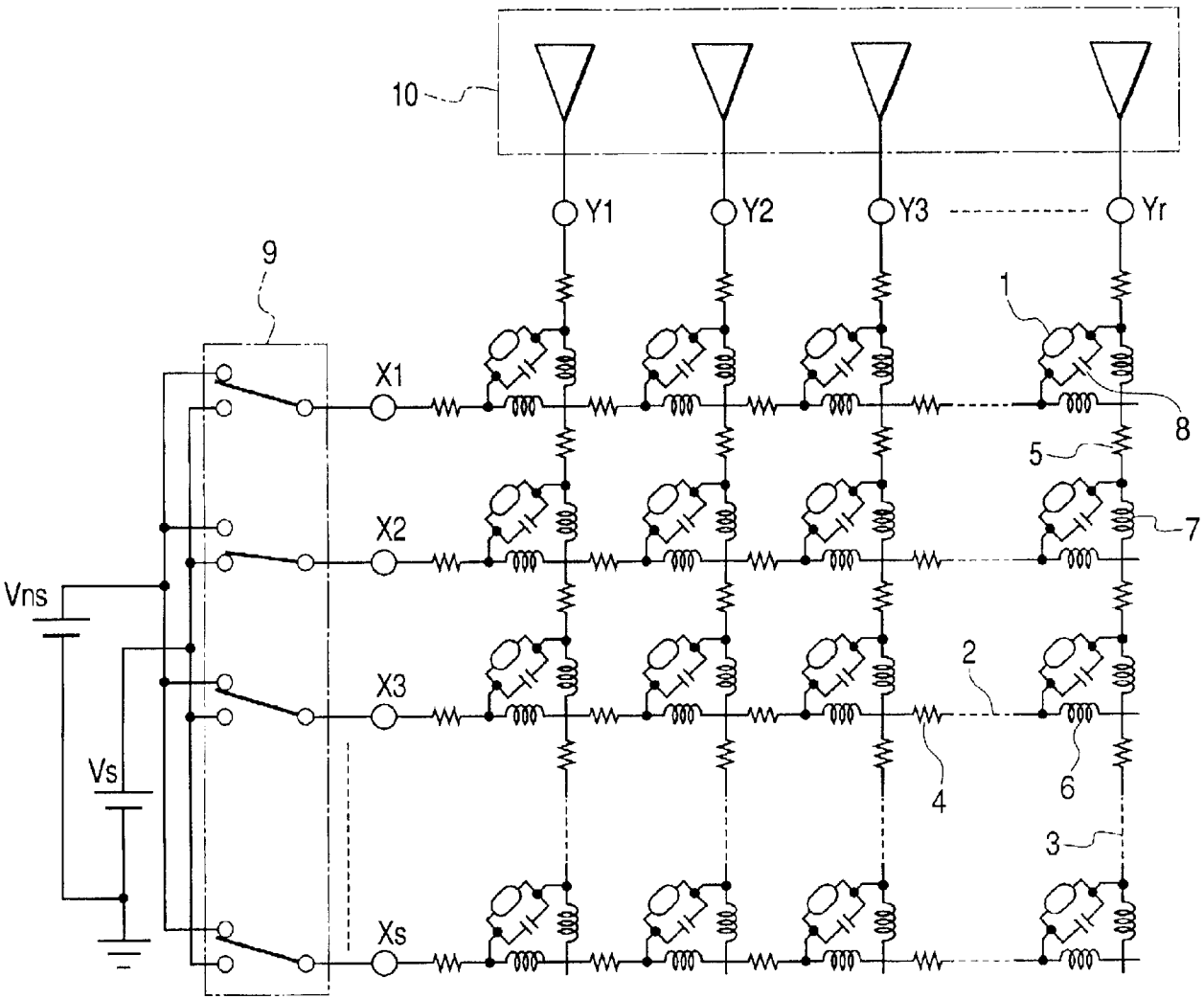
FIG. 31 is a wiring diagram showing the electric structure of a multi-electron beam source.

FIG. 26 shows an example of modulation waveforms and a current, which flows in arbitrary scan wiring Yq, in new Vn driving (front alignment). The current is equalized. Furthermore, by using front and back alignment in the new Vn driving, it becomes possible to make a current, which flows into the scan wiring Yq, almost uniform as shown in FIG. 27 within a 1H period.

Here, in regard to a matrix panel which has information wiring of 1920×3, and scan wiring of 1024, the reduction effect of a current flowing into the information wiring will be computed. Let the maximum current flowing in a device be 0.8 mA. When a modulation waveform is set so that a drive current may be equally divided as shown in FIG. 7, since the maximum of a current change per device is 0.8 mA in conventional simple PWM or V14 driving, the maximum of a current change per one scan wiring, ΔIy is as follows:

$$\Delta Iy=0.8\ mA\times1920\times3=4.608\ A$$

Since the maximum becomes one half by using front and back alignment together, $$\Delta Iy=2.304\ A$$

Since a change of a current is 0.8 mA/4=0.2 mA in the portion except leading and trailing edges of a waveform in the new Vn driving, $$\Delta Iy=0.2\ mA\times1920\times3=1.152\ A$$

Furthermore, since front alignment and back alignment are repeated every device by using the front and back alignment together, the maximum of a current change becomes one half as follows:

$$\Delta Iy=576\ mA.$$

Modified Examples of Examples

In the Vn driving in FIG. 21, and the new Vn driving in FIG. 25, it is possible to set a modulation waveform such that a drive current may be equally divided as shown in FIG. 7, or to set it such that an effective portion of amplitude of drive potential may be equally divided as shown in FIG. 19. In order to prevent ringing and an overshoot which are generated at the time of startup and fall of a waveform, it is effective to make voltages between potential (V0) whose potential difference from basic potential serves as a drive voltage threshold of a device, V1, V2, V3, and V4 equal. FIG. 19 shows the relation between the applied voltage and the luminescence in the case of equally dividing an effective portion of amplitude of drive potential. It can be seen that the luminescence of unit driving waveform blocks A, B, C and D which consist of unit pulse width and unit levels which are shown in a time series chart of a driving waveform does not become equal.

FIG. 20 shows the relation between the luminance brightness and the data in the cases of current equal dividing and voltage equal dividing in the V14 driving. Although linearity is spoiled a little in a low luminance brightness region, monotonicity is guaranteed and this can be treated by data correction etc.

As for γ correction, the relation between the luminance brightness data and the luminance brightness becomes a curve deeper than the 2.2nd power of reverse γ characteristics (resolution of luminance brightness becomes high in a low luminance brightness region), usually used, by setting the voltage equal dividing of V1 to V4 which can minimize ringing generation. In consequence, it becomes possible to enhance the resolution of luminance brightness in low to middle luminance brightness at the time of reverse γ conversion.

Although four levels of level control are performed and the number of gradations are 1024 that is from 0 to 1023 in the Examples described above, there is no limitation of a control level and the number of gradations in the present invention.

According to the present invention, it becomes possible to provide a driving waveform and a drive method that make it possible in a low-cost drive circuit to realize fine gradation, to reserve the monotonicity of gradation, to realize the uniform luminescence of a light emitting device, to reduce radiated noise, and to stabilize a driving waveform. In addition, it becomes possible to provide a light emitting device control method which can reduce the bias of luminance brightness distribution in an inexpensive drive circuit.

What is claimed is:

1. A drive circuit for driving a device, wherein the drive circuit comprises a circuit which outputs a driving signal having a driving waveform whose pulse width is controlled in a unit of slot width $\Delta t$ and whose level in each slot is predetermined as one of $A_1$ to $A_n$, where n is an integer equal to or larger than 2, and $A_1<A_2<\ldots<A_n$, $A_1$ to $A_n$ correspond to non-zero gradation levels, and wherein in the circuit, the driving waveform has a rising portion up to a predetermined level $A_k$, where k indicates an integer equal to or larger than 2 and equal to or smaller than n, through a level corresponding to a non-zero gradation level smaller than $A_k$ from level $A_1$ to a level $A_{k-1}$ in order at least by one slot, and a falling portion from the predetermined level $A_k$ through a level corresponding to a non-zero gradation level smaller than $A_k$ from the level $A_{k-1}$ to the level $A_1$ in order at least by one slot.

2. A display device, comprising a plurality of devices, a selection signal wiring, and a plurality of information signal wirings; and the drive circuit according to claim 1, wherein the drive circuit supplies the driving signal having the driving waveform to the plurality of information signal wirings.

3. The display device according to claim 2, wherein a time from starting a rise of the driving waveform to reaching the level $A_k$ can be set such that the time can be substantially equal to or larger than a time constant of 0% to 90% depending on a load of the information signal wiring and a driving capability of the drive circuit.

4. The display device according to claim 2, further comprising a scanning circuit connected to the selection signal wiring, wherein the driving signal applied to first selected ones of the information signal wirings is controlled such that a rise can start in a first half of a selection period during which the scanning circuit selects the selection signal wiring, and the driving signal applied to second selected ones of the information signal wirings is controlled such that a fall can start in a second half of the selection period.

5. The display device according to claim 2, wherein a time axis of the driving waveform of the driving signal supplied to first selected ones of the information signal wirings is configured opposite to that of a driving waveform of a driving signal supplied to second selected ones of the information signal wirings.

6. The display device according to claim 2, wherein the drive circuit further comprises a modulation circuit which receives R-bit brightness data as image data, the pulse width is controlled within a range of a number of slots of $2^P$, and the level is controlled at an $n=2^Q$ stage wherein a relationship R<P+Q is met for R, P, and Q, and wherein P and Q are bit numbers.

7. The display device according to claim 2, wherein each device comprises a surface conduction type emission device.

8. The drive circuit according to claim 1, wherein the device driven by the drive circuit is a light-emitting device.

9. A display device, comprising a plurality of devices, a selection signal wiring and a plurality of information signal wirings, a scanning circuit connected to the selection signal wiring, and a modulation circuit connected to the information signal wirings, wherein the modulation circuit includes a circuit for controlling a pulse width of a unit pulse of a slot width $\Delta t$ in a range of 0 to $2^P$, and a circuit for controlling a level within a range of a first to $2^Q$-th level of a level so as to display based on R-bit brightness data to be inputted as image data, and data of R, P, and Q has a relation of R<P+Q.

10. The display device according to claim 9, wherein the plurality of devices are light-emitting devices.

11. A drive circuit, comprising a circuit for generating a driving signal having a waveform by which a device is driven, wherein the waveform has a pulse width which is determined by a gradation value of modulation data, the waveform has a head portion having a predetermined time width and a level being used correspondingly with a non-zero gradation value, a subsequent portion which has a level higher than the level of the head portion, immediately after the head portion, an end portion having a predetermined time width and a level being used correspondingly with a non-zero gradation value, and a preceding portion which has a level higher than the level of the end portion, immediately before the end portion.

12. A drive circuit according to claim 11, wherein the waveform has a further subsequent portion immediately after the subsequent portion, and the further subsequent portion has a level higher than the level of the subsequent portion.

13. A drive circuit according to claim 11, wherein the waveform has a further preceding portion immediately before the preceding portion, and the further preceding portion has a level higher than the level of the preceding portion.

14. A drive circuit according to claim 11, wherein the circuit generates at least one other driving waveform having a pulse width which is determined by at least one other gradation value of a modulation signal, the at least one other driving waveform has no portion which has a level higher than a level of a head of the at least one other driving waveform.

15. The drive circuit according to claim 11, wherein a device driven by the driving signal is a light-emitting device.

16. A driving waveform by which a device is driven, comprising:

a head portion having a predetermined time width and a level being used correspondingly with a non-zero gradation value;

a subsequent portion which has a level higher than a level of a head portion immediately after the portion;

an end portion having a predetermined time width and a level being used correspondingly with a non-zero gradation value; and a preceding portion which has a level higher than a level of an end portion immediately before the end portion, wherein the waveform has a pulse width which is determined by gradation value of modulation data.

17. The driving waveform according to claim 16, wherein the device driven by the driving waveform is a light-emitting device.

18. A method for driving a device, comprising the steps of generating and outputting at least one driving signal, the at least one driving signal having a driving waveform whose pulse width is controlled in a unit of slot width $\Delta t$ and whose level in each slot is predetermined as one of $A_1$ to $A_n$, where n is an integer equal to or larger than 2, $A_1<A_2<\ldots<A_n$, and $A_1$ to $A_n$ correspond to non-zero gradation levels, wherein the driving waveform has a rising portion up to a predetermined level $A_k$, where k indicates an integer equal to or larger than 2 and equal to or smaller than n, wherein the rising portion rises through a level corresponding with a non-zero gradation level smaller than $A_k$ from level $A_1$ to a level $A_{k-1}$ in order at least by one slot, and also has a falling portion from the predetermined level $A_k$ through a level corresponding with the non-zero gradation level smaller than $A_k$ from the level $A_{k-1}$ to the level $A_1$ in order at least by one slot.

19. The method according to claim 18, wherein the device driven by the method is a light-emitting device.

* * * * *

UNITED STATES PATENT AND TRADEMARK OFFICE

CERTIFICATE OF CORRECTION

PATENT NO. : 6,995,516 B2
APPLICATION NO. : 10/167666
DATED : February 7, 2006
INVENTOR(S) : Tadashi Aoki et al.

It is certified that error appears in the above-identified patent and that said Letters Patent is hereby corrected as shown below:

ON TITLE PAGE ITEM (56) FOREIGN PATENT DOCUMENTS

"JP 06-342636 12/1994" should read --JP 6-342636 12/1994--.

ON TITLE PAGE ITEM (56) OTHER PUBLICATIONS

After Dittmer: "S lid" should read --Solid--; and
After Araki: "n" should read --on--.

SHEET 4

FIG. 4, "COMPARATER" (four occurrences) should read --COMPARATOR--.

SHEET 8

Replace Figure 10 with attached, amended Figure 10.

SHEET 13

Replace Figure 16 with attached, amended Figure 16.

SHEET13

Replace Figure 17 with attached, amended Figure 17.

SHEET 26

Figure 32:
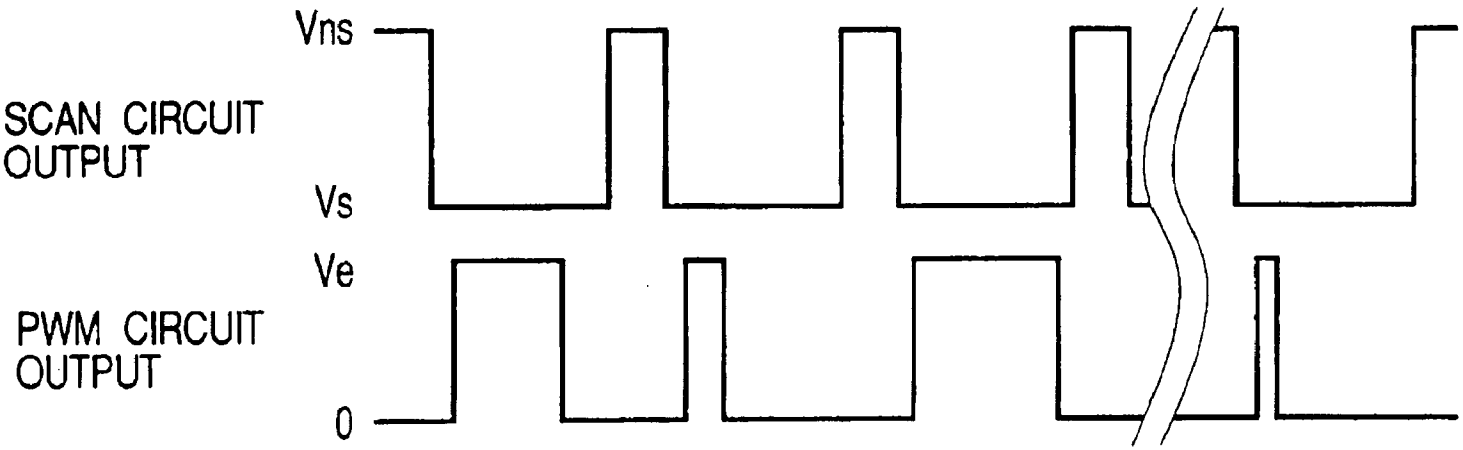
FIG. 32 is an output waveform chart of a conventional scan circuit and a conventional pulse width modulation circuit.

Replace Figure 32 with attached, amended Figure 32.

SHEET 27

Figure 33:
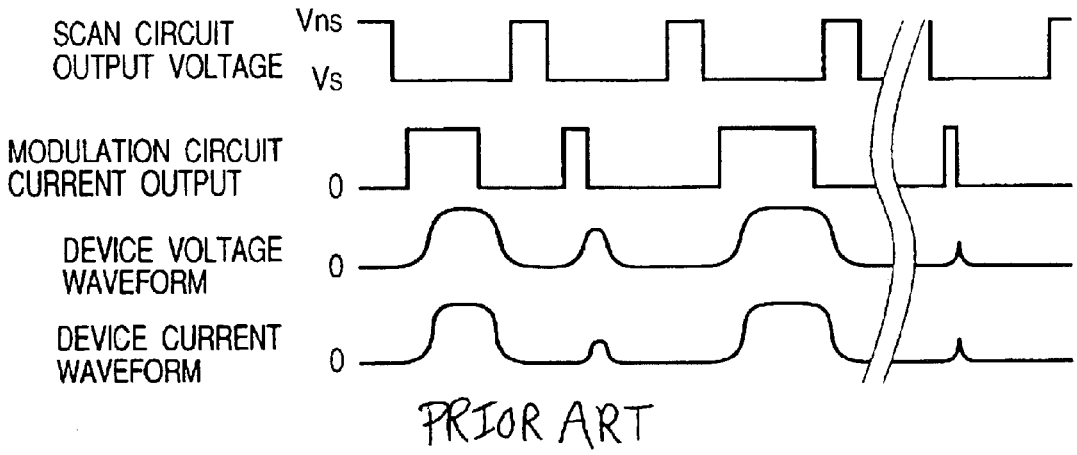
FIG. 33 is an output waveform chart of a conventional scan circuit and a conventional pulse width modulation circuit.

Replace Figure 33 with attached, amended Figure 33.

COLUMN 1

Line 27, "occurring" should read --occurs--.

UNITED STATES PATENT AND TRADEMARK OFFICE

CERTIFICATE OF CORRECTION

PATENT NO. : 6,995,516 B2
APPLICATION NO. : 10/167666
DATED : February 7, 2006
INVENTOR(S) : Tadashi Aoki et al.

It is certified that error appears in the above-identified patent and that said Letters Patent is hereby corrected as shown below:

COLUMN 2

Line 10, “Advance” should read --Advances--.

COLUMN 4

Line 24, “1/(60x1080x210) ≈ 15” should read --1/(60x1080x$2^{10}$) ≈ 15--.

COLUMN 8

Line 26, (close up space).

COLUMN 11

Line 47, “the” should be deleted; and
Line 55, “raise” should read --raises--.

COLUMN 12

Line 38, “the” should be deleted.

COLUMN 16

Line 21, “waveform” should read --waveforms--;
Line 38, “data, a” should read --data, ¶a--; and
Line 39, “waveform” should read --waveforms--.

COLUMN 17

Line 2, “wiring” should read --wirings--; and
Line 49, “wiring” should read --wirings--.

COLUMN 18

Line 1, “to 22” should read --to $2^P$--.

COLUMN 21

Line 34, “leveld” should read --levels--.

UNITED STATES PATENT AND TRADEMARK OFFICE

CERTIFICATE OF CORRECTION

PATENT NO. : 6,995,516 B2
APPLICATION NO. : 10/167666
DATED : February 7, 2006
INVENTOR(S) : Tadashi Aoki et al.

It is certified that error appears in the above-identified patent and that said Letters Patent is hereby corrected as shown below:

COLUMN 23

Line 60, “outputs” should read --output--.

COLUMN 24

Line 4, “circuit” should read --circuit 111.--;
Line 11, “prop,” should read --flop--; and
Line 29, “circuits” should read --circuits.--.

COLUMN 27

Line 12, “Luminescence” should read --Luminescents--.

COLUMN 31

Line 17, “comprising” should read --comprising:--.

Signed and Sealed this

Twenty-seventh Day of February, 2007

JON W. DUDAS
*Director of the United States Patent and Trademark Office*